US005818168A

United States Patent [19]

Ushifusa et al.

[11] Patent Number: 5,818,168

[45] Date of Patent: Oct. 6, 1998

[54] GAS DISCHARGE DISPLAY PANEL HAVING COMMUNICABLE MAIN AND AUXILIARY DISCHARGE SPACES AND MANUFACTURING METHOD THEREFOR

[75] Inventors: Nobuyuki Ushifusa, Yokohama; Seiichi Tsuchida, Yokosukka; Teruo Takai, Isehara; Ken Hashimoto, Mobara; Hiroshi Ohtaka, Yokohama; Michitaka Ohsawa, Fujisawa; Eiji Matsuzaki, Yokohama; Masaji Ishigaki, Yokohama; Norio Yatsuda, Yokohama; Takashi Sasaki, Hiratsuka; Yuji Sano, Zushi, all of Japan

[73] Assignee: Hitachi, Ltd., Tokyo, Japan

[21] Appl. No.: 525,976

[22] Filed: Sep. 7, 1995

[30] Foreign Application Priority Data

| | | | |
|---|---|---|---|
| Sep. 7, 1994 | [JP] | Japan | 6-214000 |
| Sep. 7, 1994 | [JP] | Japan | 6-214003 |
| Apr. 17, 1995 | [JP] | Japan | 7-090710 |

[51] Int. Cl.[6] ..... H01J 17/49

[52] U.S. Cl. ..... 313/582; 313/584; 313/586; 313/587

[58] Field of Search ..... 313/582, 583, 313/584, 585, 586, 491, 492, 587

[56] References Cited

FOREIGN PATENT DOCUMENTS 404123748 4/1992 Japan ..... 313/582

OTHER PUBLICATIONS

Otsuka, Akira; "Commercially manufacturing of display which can display 260 thousand colors in 21 inches diagonally", *Flat Panel Display*, 1994, pp. 198–201.

*Primary Examiner*—Sandra L. O'Shea
*Assistant Examiner*—Jay M. Patidar
*Attorney, Agent, or Firm*—Fay Sharpe Beall Fagan Minnich & McKee

[57] ABSTRACT

A gas discharge display panel which provides sufficient contrast and good accuracy and is high in yield. When a voltage is applied to auxiliary discharge electrodes, auxiliary discharge occurs in an auxiliary discharge space and excited charged particles communicate with a main discharge space through a priming path made in a discharge space separation bulkhead. In this state, when an alternating voltage is applied between bus electrodes on a front substrate, main discharge occurs in the main discharge space, causing Xe atoms in the sealed gas to generate ultraviolet rays, causing a phosphor to emit light. However, since the auxiliary discharge is shielded by a bulkhead and a barrier rib, the phosphor does not emit light when only auxiliary discharge occurs.

22 Claims, 45 Drawing Sheets

COLOR FILTER MANUFACTURING PROCESS FLOWCHART

PRIOR ART

PRIOR ART

PRIOR ART

FIG.42

TABLE 1

WEIGHT % OXIDE OF DIELECTRIC FILMS FORMED FROM ORGANOMETALLIC GELS

| No. | $SiO_2$ | $Al_2O_3$ | $TiO_2$ | $ZrO_2$ | $B_2O_3$ |
|---|---|---|---|---|---|
| 1 | 100 | | | | |
| 2 | 37 | 63 | | | |
| 3 | 42.9 | | 57.1 | | |
| 4 | 54 | 46 | | | |
| 5 | 39.6 | 33.7 | 26.7 | | |
| 6 | 38.5 | 32.8 | | 28.7 | |
| 7 | 32.6 | 29.4 | 17.1 | 18.4 | 2.5 |
| 8 | 32.8 | | | 67.2 | |
| 9 | 22.7 | 77.3 | | | |
| 10 | 23.6 | 40.1 | 36.3 | | |
| 11 | 84 | 13 | | | 3 |
| 12 | 22.1 | 37.7 | | 40.2 | |

(THE COMPOSITION RATIO EXCLUDES INEVITABLE IMPURITIES.)

FIG. 43

TABLE 2

| No. | EMBODIMENT | BARRIER RIB 11 | | BARRIER RIB 12 | |
|---|---|---|---|---|---|
| | | INTERVAL | THICKNESS | INTERVAL | THICKNESS |
| 1 | EMBODIMENT 1, EMBODIMENT 7, EMBODIMENT 11 | BARRIER RIB ALONG MAIN DISCHARGE ELECTRODES : 1.2mm<br>BARRIER RIB AT A RIGHT ANGLE TO MAIN DISCHARGE ELECTRODES : 0.4mm | 0.10mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : 1.2mm | 0.07mm<br>0.12mm |
| 2 | EMBODIMENT 2, EMBODIMENT 15, EMBODIMENT 18, EMBODIMENT 26 | BARRIER RIB ALONG MAIN DISCHARGE ELECTRODES : 1.2mm<br>BARRIER RIB AT A RIGHT ANGLE TO MAIN DISCHARGE ELECTRODES : 0.4mm | 0.10mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : NONE | 0.07mm<br>0 mm |
| 3 | EMBODIMENT 3, EMBODIMENT 16, EMBODIMENT 19, EMBODIMENT 25, EMBODIMENT 27 | BARRIER RIB ALONG MAIN DISCHARGE ELECTRODES : NONE<br>BARRIER RIB AT A RIGHT ANGLE TO MAIN DISCHARGE ELECTRODES : 0.4mm | 0 mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : NONE | 0.07mm<br>0 mm |
| 4 | EMBODIMENT 4, EMBODIMENT 28 | BARRIER RIB ALONG MAIN DISCHARGE ELECTRODES : 1.2mm<br>BARRIER RIB AT A RIGHT ANGLE TO MAIN DISCHARGE ELECTRODES : 0.4mm | 0.1 mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : 1.2mm | 0.09mm<br>0.12mm |
| 5 | EMBODIMENT 5 | BARRIER RIB ALONG MAIN DISCHARGE ELECTRODES : 1.2mm<br>BARRIER RIB AT A RIGHT ANGLE TO MAIN DISCHARGE ELECTRODES : 0.4mm | 0.10mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : NONE | 0.09mm<br>0 mm |
| 6 | EMBODIMENT 6 | BARRIER RIB ALONG MAIN DISCHARGE ELECTRODES : NONE<br>BARRIER RIB AT A RIGHT ANGLE TO MAIN DISCHARGE ELECTRODES : 0.4mm | 0 mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : NONE | 0.09mm<br>0 mm |
| 7 | EMBODIMENT 17, EMBODIMENT 20 | BARRIER RIB ALONG MAIN DISCHARGE ELECTRODES : NONE<br>BARRIER RIB AT A RIGHT ANGLE TO MAIN DISCHARGE ELECTRODES : 0.4mm | 0 mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : 1.2mm | 0.07mm<br>0.1 mm |
| 8 | EMBODIMENT 21, EMBODIMENT 22, EMBODIMENT 23 | BARRIER RIB ALONG MAIN DISCHARGE ELECTRODES : 1.2mm<br>BARRIER RIB AT A RIGHT ANGLE TO MAIN DISCHARGE ELECTRODES : 0.4mm | 0.10mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : NONE | 0.07mm<br>0 mm |
| 9 | EMBODIMENT 24 | BARRIER RIB ALONG MAIN DISCHARGE ELECTRODES : NONE<br>BARRIER RIB AT A RIGHT ANGLE TO MAIN DISCHARGE ELECTRODES : 0.4mm | 0 mm<br>0.07mm | BARRIER RIB ALONG AUXILIARY DISCHARGE ELECTRODES : 0.4mm<br>BARRIER RIB AT A RIGHT ANGLE TO AUXILIARY DISCHARGE ELECTRODES : NONE | 0.07mm<br>0 mm |

FIG. 44A

TABLE 3

| No. | EMBODIMENT | SIZE OF BULKHEAD 13 (THICKNESS) | SIZE OF DISCHARGE SPACE | | LOCATION OF PRIMING PATH |
|---|---|---|---|---|---|
| | | | MAIN DISCHARGE SPACE | AUXILIARY DISCHARGE SPACE | |
| 1 | EMBODIMENT 1, EMBODIMENT 7, EMBODIMENT 11 | 0.1mm | DIRECTION AT A RIGHT ANGLE TO MAIN DISCHARGE ELECTRODES : 1.1mm DIRECTION PARALLEL TO MAIN DISCHARGE ELECTRODES : 0.33mm HEIGHT : 0.3mm | DIRECTION AT ARIGHT ANGLE TO AUXILIARY DISCHARGE ELECTRODES : 0.33mm DIRECTION PARALLEL TO AUXILIARY DISHARGE ELECTRODES : 1.08mm HEIGHT : 0.1mm | IN CONTACT WITH BARRIER RIB PARALLEL TO MAIN DISCHARGE ELECTRODES. MORE THAN 0.1mm APART FROM BARRIER RIB AT A RIGHT ANGLE TO THE MAIN DISCHARGE ELECTRODES. |
| 2 | EMBODIMENT 2, EMBODIMENT 15, EMBODIMENT 18, EMBODIMENT 26 | 0.1mm | DIRECTION AT A RIGHT ANGLE TO MAIN DISCHARGE ELECTRODES : 1.1mm DIRECTION PARALLEL TO MAIN DISCHARGE ELECTRODES : 0.33mm HEIGHT : 0.3mm | DIRECTION AT A RIGHT ANGLE TO AUXILIARY DISCHARGE ELECTRODES : 0.33mm DIRECTION PARALLEL TO AUXILIARY DISHARGE ELECTRODES : SPREAD ALL THE VALID AREA HEIGHT : 0.1mm | IN CONTACT WITH BARRIER RIB PARALLEL TO MAIN DISCHARGE ELECTRODES. MORE THAN 0.1mm APART FROM BARRIER RIB AT A RIGHT ANGLE TO THE MAIN DISCHARGE ELECTRODES. |
| 3 | EMBODIMENT 3, EMBODIMENT 16, EMBODIMENT 19, EMBODIMENT 25, EMBODIMENT 27 | 0.1mm | DIRECTION AT A RIGHT ANGLE TO MAIN DISCHARGE ELECTRODES : SPREAD ALL THE VALID AREA DIRECTION PARALLEL TO MAIN DISCHARGE ELECTRODES : 0.33mm HEIGHT : 0.3mm | DIRECTION AT A RIGHT ANGLE TO AUXILIARY DISCHARGE ELECTRODES : 0.33mm DIRECTION PARALLEL TO AUXILIARY DISHARGE ELECTRODES : SPREAD ALL THE VALID AREA HEIGHT : 0.1mm | MORE THAN 0.1mm APART FROM BARRIER RIB AT A RIGHT ANGLE TO THE MAIN DISCHARGE ELECTRODES. |
| 4 | EMBODIMENT 4, EMBODIMENT 28 | 0.1mm | DIRECTION AT A RIGHT ANGLE TO MAIN DISCHARGE ELECTRODES : 1.1mm DIRECTION PARALLEL TO MAIN DISCHARGE ELECTRODES : 0.33mm HEIGHT : 0.3mm | DIRECTION AT A RIGHT ANGLE TO AUXILIARY DISCHARGE ELECTRODES : 0.31mm DIRECTION PARALLEL TO AUXILIARY DISHARGE ELECTRODES : 1.08mm HEIGHT : 0.1mm | IN CONTACT WITH BARRIER RIB PARALLEL TO MAIN DISCHARGE ELECTRODES. MORE THAN 0.1mm APART FROM BARRIER RIB AT A RIGHT ANGLE TO THE MAIN DISCHARGE ELECTRODES. |

FIG. 44B

| | | | | | |
|---|---|---|---|---|---|
| 5 | EMBODIMENT 5 | 0.1mm | DIRECTION AT A RIGHT ANGLE TO MAIN DISCHARGE ELECTRODES : 1.1mm DIRECTION PARALLEL TO MAIN DISCHARGE ELECTRODES : 0.33mm HEIGHT : 0.3mm | DIRECTION AT A RIGHT ANGLE TO AUXILIARY DISCHARGE ELECTRODES : 0.31mm DIRECTION PARALLEL TO AUXILIARY DISHARGE ELECTRODES : SPREAD ALL THE VALID AREA HEIGHT : 0.1mm | IN CONTACT WITH BARRIER RIB PARALLEL TO MAIN DISCHARGE ELECTRODES. MORE THAN 0.1mm APART FROM BARRIER RIB AT A RIGHT ANGLE TO THE MAIN DISCHARGE ELECTRODES. |
| 6 | EMBODIMENT 6 | 0.1mm | DIRECTION AT A RIGHT ANGLE TO MAIN DISCHARGE ELECTRODES : SPREAD ALL THE VALID AREA DIRECTION PARALLEL TO MAIN DISCHARGE ELECTRODES : 0.33mm HEIGHT : 0.3mm | DIRECTION AT A RIGHT ANGLE TO AUXILIARY DISCHARGE ELECTRODES : 0.31mm DIRECTION PARALLEL TO AUXILIARY DISHARGE ELECTRODES : SPREAD ALL THE VALID AREA HEIGHT : 0.1mm | IN CONTACT WITH BARRIER RIB PARALLEL TO MAIN DISCHARGE ELECTRODES. MORE THAN 0.1mm APART FROM BARRIER RIB AT A RIGHT ANGLE TO THE MAIN DISCHARGE ELECTRODES. |
| 7 | EMBODIMENT 17, EMBODIMENT 20 | 0.1mm | DIRECTION AT A RIGHT ANGLE TO MAIN DISCHARGE ELECTRODES : SPREAD ALL THE VALID AREA DIRECTION PARALLEL TO MAIN DISCHARGE ELECTRODES : 0.33mm HEIGHT : 0.3mm | DIRECTION AT A RIGHT ANGLE TO AUXILIARY DISCHARGE ELECTRODES : 0.33mm DIRECTION PARALLEL TO AUXILIARY DISHARGE ELECTRODES : 1.1mm HEIGHT : 0.1mm | IN CONTACT WITH BARRIER RIB PARALLEL TO MAIN DISCHARGE ELECTRODES. MORE THAN 0.1mm APART FROM BARRIER RIB AT A RIGHT ANGLE TO THE MAIN DISCHARGE ELECTRODES. |
| 8 | EMBODIMENT 21, EMBODIMENT 22, EMBODIMENT 23 | 0.1mm | DIRECTION AT A RIGHT ANGLE TO MAIN DISCHARGE ELECTRODES : 1.1mm DIRECTION PARALLEL TO MAIN DISCHARGE ELECTRODES : 0.33mm HEIGHT : 0.3mm | DIRECTION AT A RIGHT ANGLE TO AUXILIARY DISCHARGE ELECTRODES : 0.33mm DIRECTION PARALLEL TO AUXILIARY DISHARGE ELECTRODES : SPREAD ALL THE VALID AREA HEIGHT : 0.1mm | IN CONTACT WITH BARRIER RIB PARALLEL TO MAIN DISCHARGE ELECTRODES. WITHIN 0.05mm APART FROM BARRIER RIB AT RIGHT ANGLE TO THE MAIN DISCHARGE ELECTRODES. |
| 9 | EMBODIMENT 24 EMBODIMENT 23 | 0.1mm | DIRECTION AT A RIGHT ANGLE TO MAIN DISCHARGE ELECTRODES : SPREAD ALL THE VALID AREA DIRECTION PARALLEL TO MAIN DISCHARGE ELECTRODES : 0.33mm HEIGHT : 0.3mm | DIRECTION AT A RIGHT ANGLE TO AUXILIARY DISCHARGE ELECTRODES : 0.33mm DIRECTION PARALLEL TO AUXILIARY DISHARGE ELECTRODES : SPREAD ALL THE VALID AREA HEIGHT : 0.1mm | WITHIN 0.05mm APART FROM BARRIER RIB AT RIGHT ANGLE TO THE MAIN DISCHARGE ELECTRODES. |

GAS DISCHARGE DISPLAY PANEL HAVING COMMUNICABLE MAIN AND AUXILIARY DISCHARGE SPACES AND MANUFACTURING METHOD THEREFOR

BACKGROUND OF THE INVENTION

1. Field of the Invention

This invention relates to a gas discharge display panel such as a plasma display panel, and in particular to an AC-driven gas discharge display panel capable of high-definition, high-contrast display and suitable for inexpensive color display, as well as a manufacturing method therefor.

2. Description of the Related Art

A gas discharge display panel, such as a plasma display panel, has features such as a wide viewing angle, easy-to-see display because of self light emission, and a slim form, and is used for a display device of an office automation machine, etc. In addition, it is to be expected that in the future, gas discharge display panels will be applied to high-quality television set, etc.

Gas discharge display panels are roughly classified into AC-driven and DC-driven display panels. AC-driven plasma display panels provide a memory function and high intensity because of the effect of a dielectric layer covering electrodes, and they are made practical on duration of life by applying protective films, etc.; it is commercially practical as a multi-purpose video monitor.

FIG. 22 is a partial perspective view showing the structure of a plasma display panel in practical use. This gas discharge color display panel comprises a rear substrate 2 and a front substrate 1 placed facing each other. The rear substrate 2 comprises barrier ribs 3*a* for spacing the rear substrate 2 and the front substrate 1 at a given interval. The front substrate 1 and the rear substrate 2 are connected via the barrier ribs 3*a*. In FIG. 22, for ease of viewing, the front substrate 1 and the barrier ribs 3*a* of the rear substrate 2 are shown separated.

The front substrate 1 has a structure where display electrodes (transparent electrodes) 5, bus electrodes 6, a dielectric layer 7*a*, and an MgO film (protective film) 8*a* are formed on a front glass plate 4*a*. The rear substrate 2 has a structure where address electrodes 9, barrier ribs 3*a*, and a fluorescent layer 14 are formed on a rear glass plate 4*b*. The front substrate 1 and the rear substrate 2 are placed in parallel with each other and pasted so that sides on which the electrodes are formed are opposed to each other, whereby a discharge space 3*f* is formed between the front substrate 1 and the rear substrate 2. The display electrodes 5 and the address electrodes 9 are made to cross at right angles via the discharge space 3*f*.

FIGS. 20A–20C and 21 are sectional views of the gas discharge display panel. FIG. 20A is a sectional view of the gas discharge display panel when a part of the display panel is cut away on a plane parallel with the address electrodes 9 and perpendicular to the surfaces of the substrates 1 and 2. FIG. 20B is a sectional view taken on line A of FIG. 20A; the cut-away face is a plane perpendicular to the address electrodes 9 and the surfaces of the substrates 1 and 2. FIG. 20C is a sectional view taken on line B of FIG. 20A; the cut-away face is a plane perpendicular to the address electrodes 9 and the surfaces of the substrates 1 and 2. In FIGS. 20A–20C, for ease of viewing, only the sectional views are illustrated and the structure which would be seen when looking at the screen is not illustrated. FIG. 21 is a sectional view on a plane taken on line C of FIG. 20A.

As shown in FIG. 20B and 20C, a discharge cell (display cell) is formed for each pair of transparent electrodes 5*a* and 5*b* between the substrates 1 and 2, and a discharge space 3*f* is formed by the substrates 1 and 2 and the barrier ribs 3*a*. A fluorescent layer 14 is formed in the discharge cell. Discharge gas is sealed in the space 3*f* in the cell. In the conventional display panel, as shown in FIG. 21, the barrier ribs 3*a* are shaped like parallel bars and the discharge space 3*f* of transversely or longitudinally contiguous cells is not separated by the barrier rib 3*a*.

When an alternating voltage is applied between the electrode 5, 6 on the front substrate 1 and the address electrode 9 formed on the rear substrate 2, auxiliary discharge occurs in each cell 3*f* formed by the front substrate 1, the rear substrate 2, and the barrier ribs 3*a*. When the auxiliary discharge is used to apply an alternating voltage between parallel electrode 5*a*, 6*a* and electrode 5*b*, 6*b* formed on the front substrate 1 for each cell, main discharge occurs. Ultraviolet rays produced by the main discharge cause the fluorescent layer 14 applied to the cell inside to emit light. Display on the display panel is made by light from the fluorescent layer 14 observed through the front substrate 1.

The conventional gas discharge display panel discussed here is described on pages 198–201 of Flat Panel Display 1994 (edited by Nikkei Microdevices, 1993).

The following method is known as a conventional manufacturing method for such a gas discharge color display panel:

First, a pair of transparent substrates are provided. Generally, soda glass plates having a distortion point of about 450° C. are used as substrates used for gas discharge color display panels.

A predetermined pattern of electrode paste is printed on one of the glass substrates (rear substrate) by a thick film printing method and the paste is dried at 100°–150° C., then calcined at 500°–600° C. Next, to form discharge cells to be made into pixels, a predetermined pattern of barrier rib formation paste is printed by the thick film printing method on the side of the rear substrate on which the electrode pattern is formed, and is dried at 100°–150° C., whereby a large number of cells arranged like a matrix are formed on the rear substrate. To provide sufficient discharge space, the barrier rib is required to have a thick film thickness (for example, 160–200 $\mu$m) and one thick film printing step cannot provide sufficient film thickness. Therefore, printing and drying of the barrier rib formation paste are repeated more than once. A predetermined pattern of fluorescent paste of red, blue, and green is printed by the thick film printing method on the insides of the cells formed by the barrier ribs and is dried at 100°–150° C., then calcined at 500°–600° C., whereby the rear substrate on which the discharge cells are formed is provided.

An evaporation film of a transparent conductive substance, such as ITO (indium tin oxide), is formed on the other glass substrate (front substrate glass plate) and a large number of electrode patterns parallel with each other are formed so that two electrodes parallel with a cell row are provided for each cell. Next, to improve the conductivity of the electrodes, a bus electrode is formed in each electrode part of the pattern. A predetermined pattern of dielectric paste is printed by the thick film printing method on the side on which the electrodes are formed, and is dried at 100°–150° C., then calcined at 500°–600° C. Further, an MgO film is formed on the obtained dielectric film surface by an EB (electron beam) evaporation method, whereby the front substrate on which the transparent electrodes are formed is provided.

Next, the side of the front substrate on which the MgO film is formed and the side of the rear substrate on which the cells are formed are made opposite to each other for aligning the front substrate and the rear substrate, and the edges of both the substrates are covered with glass and heated at about 450° C. to seal between both the substrates. Air in the gap surrounded by both the substrates and the seal is then exhausted through an exhaust pipe and discharge gas is put into the gap in place of the exhausted gas. Last, the exhaust pipe is baked (tipped off or sealed off) and the discharge gas is sealed in. Preparation of the gas discharge color display panel is now complete.

Although the barrier ribs are formed on the rear substrate in the description, they may be formed on the front substrate or both front and rear substrates, depending on the display panel design. The electrodes and MgO film may be formed by the thick film printing method.

In any case, such a conventional display panel manufacturing method has the merit that it is possible to manufacture display panels comparatively easily because the barrier ribs, electrodes, fluorescent layer, etc., are formed by the thick printing method.

SUMMARY OF THE INVENTION

As described above, since auxiliary discharge and main discharge are executed in the same discharge space within the gas discharge color display panel in the related art, light emission caused by auxiliary discharge also occurs where main discharge does not occur, and sufficient contrast cannot be provided. If sufficient contrast is not provided, high-speed time-sharing control must be performed by a complicated driving method to represent sufficient gradation for full coloration. It is therefore a first object of the invention to provide a gas discharge display panel capable of high-contrast display and a manufacturing method therefor.

To provide sufficient discharge space, the barrier rib film needs to be made thick, for example 160–200 $\mu$m thick, but one thick film printing step does not provide the film thickness. For this reason, in the conventional manufacturing method, paste printing and drying are repeated more than once to provide the necessary film thickness. However, in doing so, the manufacturing process is prolonged and alignment needs to be executed for each printing step, lowering the display panel yield. It is therefore a second object of the invention to provide an accurate gas discharge display panel having sufficient discharge space and a manufacturing method therefor providing a good yield.

Generally, soda glass plates having a distortion point of about 450° C. are used as gas discharge color display panel substrates. The glass plates used are previously heat-treated at the highest temperature of heat treatment temperatures in the manufacturing process to remove distortion occurring during glass manufacture and to reduce deformation during calcination.

However, even if heat treatment is applied to the soda glass plate before use, calcination shrinkage of paste and thermal distortion caused by the thermal expansion factor difference between different materials occur during calcination in the manufacturing process, deforming the soda glass plate. Such glass plate distortion and deformation will lower positional accuracy when substrates are assembled. Although glass plates having a high distortion point may be used, they are very expensive and not appropriate for gas discharge color display panels.

It is therefore a third object of the invention to provide a gas discharge display panel having good positional accuracy at assembly and a manufacturing method therefor.

To accomplish the first object, in the invention, auxiliary discharge space and main discharge space in cells are separated by bulkheads formed on a bulkhead substrate. That is, according to the invention, there are provided a gas discharge display panel comprising a front substrate having main discharge electrodes and a rear substrate having auxiliary discharge electrodes, the substrates being parallel with and opposed to each other, and between the front and rear substrates, barrier ribs for partitioning a gap between the front and rear substrates, a fluorescent layer, and discharge space separation bulkheads for separating the space between the front and rear substrates into main discharge space and auxiliary discharge space, wherein each of the discharge space separation bulkheads has a priming path which is a through hole formed for making the main discharge space and the auxiliary discharge space communicate with each other, and a manufacturing method therefor.

Since light emission caused by auxiliary discharge can be blocked from the substrate front, the display panel of the invention can provide good color contrast between a cell where main discharge occurs and a cell where auxiliary discharge occurs, but main discharge does not occur.

To accomplish the second object, in the invention, at least a part of a barrier rib is formed as a unit, namely, a bulkhead substrate. Since the film formation step need not be repeated more than once to provide the barrier rib thickness, positional accuracy and the manufacturing yield can be improved. To manufacture the bulkhead substrate, predetermined positions on a single side or both sides of a glass or ceramic plate are shaved by, for example, a sandblasting or etching method to form a predetermined shape.

To accomplish the third object, in the invention, a gel resulting from hydrolyzing organometallic compound (alkoxide gel or gel) is heated to form a dielectric layer and a protective layer, and electrodes are formed by sputtering method, vacuum evaporation coating method or plating. In doing so, the display panel can be manufactured without executing thermal treatment exceeding the soda glass distortion point (about 450° C.), so that thermal distortion of the glass plates can be decreased.

In the invention, cells used as pixels are separated from each other by barrier ribs forming discharge cells and each cell is formed with a bulkhead for shielding light caused by auxiliary discharge, making up the display panel. Preferably, the bulkheads are parallel with the front and rear substrates.

The display panel of the invention applies a voltage to auxiliary discharge electrodes formed on the rear substrate, thereby causing auxiliary discharge to occur. Charged particles and excited atoms generated by the auxiliary discharge enter main discharge space through the priming path, facilitating discharge in the main discharge space. That is, in the invention, charged particles and excited atoms having a pilot light effect are supplied to the main discharge space via the priming path, thereby lowering and stabilizing the starting voltage of main discharge.

When the charged particles and excited atoms are supplied to the main discharge space, if an alternating voltage is applied between two parallel electrodes formed on the front substrate, discharge occurs in the main discharge space, generating ultraviolet rays which cause the phosphor to emit light. The observer observes light emission of the phosphor through the front substrate as display. In the invention, the auxiliary discharge space and main discharge space are separated from each other and the auxiliary discharge space is not formed with a fluorescent layer. Therefore, auxiliary discharge does not cause the phosphor to emit light and gas discharge light caused by auxiliary discharge is shielded by the bulkhead, so that only light emission caused by main discharge is observed from the outside of the front substrate. Therefore, the invention can provide sufficient contrast for a displayed image.

In the invention, since main discharge occurs between closely located electrodes formed on the front substrate, a drive voltage can be made lower by making the interval of electrodes narrow. Lowering the drive voltage produces the effects of not only reducing power consumption, but also increasing the life of the display panel because of reduction in damaging protect film by sputtering caused by discharge.

In the invention, a voltage is applied between two auxiliary discharge electrodes formed on the rear substrate to cause auxiliary discharge to occur. In doing so, the auxiliary discharge starting voltage can be reduced and the drive voltage can be lowered because the distance between the electrodes causing auxiliary discharge to occur is short compared with the related art in which voltage is applied with a large discharge space between. To reduce the auxiliary discharge starting voltage and stabilize auxiliary discharge, it is effective to coat auxiliary discharge electrodes with a dielectric for providing a memory function, and further to coat the dielectric with material such as MgO, CaO, or SrO for enhancing the secondary electron emission capability to the auxiliary discharge space.

Preferably, to protect the dielectric layer, a protective film such as an MgO, CaO, or SrO film is formed on the sides of the front substrate and the rear substrate facing the discharge space. The protective film has a small sputtering rate so that the damage from sputtering with discharge is reduced, thereby increasing the life of the display panel. Preferably, a transparent material such as an MgO film is used for the protective film on the front substrate side.

In the invention, a voltage is applied between two strip electrodes (auxiliary discharge electrodes) separated by a dielectric in the rear substrate to cause auxiliary discharge to occur.

As the composition of the auxiliary discharge electrodes, for example, electrodes 9 and 10 shown in FIG. 1A are placed parallel with the outside-exposed face of the front and rear of transparent substrate material 4*a* of the front substrate, which is called "main surface of front substrate" in the specification, and are separated up and down by dielectric 7*b* in the rear substrate 2 (assuming that the front substrate side is up and that the rear substrate side is down), and the line provided by projecting the line made by another electrode perpendicularly to the plane containing one electrode (A) and parallel with the surface of substrate material 4*b* is made orthogonal to the line made by electrode A (this state is called "orthogonal via dielectric" in the specification).

That is, a plurality of strip address electrodes formed on a first plane parallel with the main surface of the front substrate and a plurality of strip trigger electrodes formed on a second plane parallel with, and different from, the first plane can be used as the auxiliary discharge electrodes in the display panel of the invention. In this case, the address electrodes and the trigger electrodes are separated via the dielectric, the extension direction of the address electrodes is orthogonal to that of the trigger electrodes, and a voltage is applied between any of the address electrodes and any of the trigger electrodes, thereby causing auxiliary discharge to occur. The first and second planes may be curved surfaces such as cylindrical faces like parts of a cylinder, or flat surfaces.

If two electrodes separated up and down and having their extension directions crossed are used as the auxiliary discharge electrodes, a cell in which auxiliary discharge is caused to occur can be easily specified.

To use the address and trigger electrodes as the auxiliary discharge electrodes as described above, cross sections provided by projecting the address electrodes, the priming paths, and the trigger electrodes perpendicularly to any plane perpendicular to a lamination direction of the gas discharge display panel preferably overlap each other, at least partially. In doing so, a voltage applied for moving charged particles, etc., generated by auxiliary discharge to main discharge space can be lowered.

As shown in FIG. 23B, two strip electrodes 9*a* and 9*b* formed in a rear substrate 2 and placed parallel with each other on the same plane parallel with the surface of a glass plate 4*b* on the rear substrate 2, may be used as the auxiliary discharge electrodes.

That is, a plurality of strip electrodes formed on a first plane parallel with the main surface of the front substrate may be used as the auxiliary discharge electrodes. In this case, the extension directions of the auxiliary discharge electrodes and the main discharge electrodes are made substantially orthogonal to each other and a voltage is applied between two adjacent electrodes of the auxiliary discharge electrodes, thereby causing auxiliary discharge to occur.

In doing so, the electric field leaked to the auxiliary discharge space is larger than that when the two electrodes separated up and down in the rear substrate described above are used, and thus sufficient auxiliary discharge can be easily caused to occur at a low voltage, whereby the drive voltage can be more lowered even further.

To use a pair of electrodes parallel with each other on the same plane as the auxiliary discharge electrodes, the line provided by projecting the line made by the auxiliary discharge electrodes perpendicularly to the plane parallel with the front substrate surface and containing main discharge electrodes is preferably made substantially orthogonal to the main discharge electrodes. In doing so, a cell in which main discharge is caused to occur can be easily specified.

Preferably, the shortest one of lines drawn between one of the main discharge electrodes and one of the auxiliary discharge electrodes (when two lines of the same length exist, at least one of them) passes through a priming path. That is, cross sections provided by projecting the main discharge electrodes, the priming paths, and the auxiliary discharge electrodes perpendicularly to any plane parallel with a lamination direction of the gas discharge display panel preferably overlap each other, at least partially. In doing so, the path passing through the priming path between the main and auxiliary discharge electrodes (charged particle move path) can be shortened and the voltage required to provide an electric field for emitting charged particles of a sufficient amount to cause main discharge to occur from auxiliary discharge space to the main discharge space (namely, a drive voltage such as address voltage applied to an address electrode) can be lowered. The lamination direction refers to the vertical direction when it is assumed that the front substrate is the top and that the rear substrate is the bottom; if the front substrate material is a flat plate, normally the lamination direction becomes the normal direction of one face of the front and rear of the substrate material.

As shown in FIG. 29B, one of the address electrodes 9*a* and 9*b* may be shared with an adjacent cell row. In doing so, it is preferable because the composition of the electrodes can be simplified.

In the invention, at least a part of a barrier rib for partitioning space into cells, is manufactured as a component, namely, a bulkhead substrate. The bulkhead substrate, front substrate, and rear substrate are assembled into a display panel. This eliminates the need for repeating printing using a thick-film printing method, etc., more than once to form a thick ceramic paste for the bulkheads and barrier rib thickness, so that positional accuracy and the manufacturing yield can be improved. Preferably, the bulkhead substrate comprises a barrier rib on the front substrate side, discharge space separation bulkheads, and a barrier rib on the rear substrate side, but may comprise only some of them, for example, the barrier rib on the front substrate side and discharge space separation bulkheads.

As described above, light emission of phosphors in the gas discharge color display panel of the invention is applied to the outside through the front substrate. Thus, the front substrate needs to transmit emitted light efficiently and it is not preferred to form a light transmission shield on the front substrate. Then, a transparent dielectric layer needs to be formed on the front substrate so as to facilitate transmission of light emitted by discharge.

Transparent electrodes of ITO, etc., are used for electrodes formed on the front substrate. Since the ITO electrodes have high wiring resistance, bus electrodes of metal conductors having low wiring resistance need to be used together with the ITO electrodes. Since bus electrode resistance is remarkably low compared with the resistance of the transparent electrode, a voltage drop caused by the transparent electrodes can be almost canceled out by providing bus electrodes. Therefore, in doing so, the voltage applied to the main discharge electrodes for causing main discharge to occur can be lowered.

However, since the metal film does not provide a sufficient light transmission capability, the bus electrodes are preferably made sufficiently small so as not to block light emission from cells or are located at positions not hindering light of phosphors from being emitted to the outside through the front substrate. Then, as shown in FIG. 23A, it is particularly desired to dispose the bus electrodes 6 above the priming path 3*e* (assuming that the front substrate 1 is the top and the rear substrate 2 is the bottom). Since the fluorescent layer 14 does not exist at the same position of the priming path 3*e*, blocking phosphor light by the bus electrodes 9 can be minimized and leakage of light emitted by gas discharge of auxiliary discharge to the outside of the front substrate via the priming path 3*e* can be shielded.

Preferably, the fluorescent layer is formed on barrier rib side faces on the front substrate side and the front substrate sides of discharge space separation bulkheads surrounding the main discharge space. In doing so, the fluorescent layer area can be widened, improving light emission efficiency caused by discharge. The barrier rib on the front substrate side may be shaped such that a display cell row, which means a row of display cells placed along the same direction parallel with the main surface of the front substrate, shares a main discharge space. In doing so, the fluorescent layer formation face can be widened. A display cell row may also share an auxiliary discharge space.

If light emitted by a phosphor passes through the barrier rib between cells and the bulkhead formed between the front and rear substrates and parallel therewith, and leaks to an adjacent cell, colors will be mixed. Thus, it is desired that the barrier rib and discharge space separation bulkheads used with the gas discharge color display panel of the invention are opaque. For example, opaque glass or ceramic plates are processed to form them.

Preferably, for the dielectric layer and the protective film (containing the MgO layer), an organometallic gel is heated to form a dielectric and an MgO layer. Preferably, the metal layer (containing the electrodes) is formed by a process not requiring application of heat at high temperature, such as sputtering method, vacuum evaporation coating method or plating method. In doing so, the gas discharge color display panel can be manufactured without applying heat exceeding the distortion point of a soda glass plate, so that the glass plates used for the display panel are not distorted, resulting in a high-accuracy display panel.

If the address electrodes and bus electrodes on the front and rear substrates are formed by an electroless plating method, sputtering method or vacuum evaporation coating method, they can be formed at low temperature and wiring resistance can also be reduced to one third of that when they are formed by a thick film printing method, which is effective for high-speed discharge drive.

The dielectric layer formed on the front substrate is transparent inorganic glass or ceramic, but the glass must not be distorted during manufacturing. In the conventional gas discharge color display panel manufacturing method, dielectric paste is calcined at 500°–600° C., but these temperatures exceed the distortion point of the soda glass material used for the front and rear substrates, and glass distortion caused by the calcination cannot be eliminated. Therefore, in the invention, an organometallic gel is heated to form the dielectric layer and the protective film. The gel has molecule-level ceramics dispersed, so inorganic material can be obtained by removing a solvent such as water or alcohol. However, preferably, sufficient heat treatment is executed to sufficiently remove absorbed water or alcohol so as not to generate gas during discharging and to provide a uniform and strong dielectric layer. However, the gel, which is molecule-level ceramics, has a low calcination temperature and can be heat-treated sufficiently at a temperature not exceeding 450° C., the soda glass material distortion point.

To provide the uniform and strong dielectric layer, heat treatment at at least 50° C. or higher is preferably executed. If the heat treatment temperature is low, a solvent such as water or alcohol can be removed, but it may be impossible to sufficiently remove hydroxyl, etc., absorbed on the surface of the formed dielectric. When the panel is assembled and vacuum exhaust is executed and further sealed gas is introduced, water vapor or alcohol may be released and discharge may be adversely affected. If the heat treatment temperature approaches 450° C., the soda glass material distortion point, glass becomes prone to deformation even if the distortion point is not exceeded. Moreover, a large-area glass plate used for the gas discharge color display panel is also prone to deformation particularly due to its tare weight, and it is necessary to keep the heat treatment temperature as low as possible. In this case, the gel heating temperature in the invention preferably ranges from 100° C. to 400° C.

As described above, use of an organometallic gel is desired for formation of not only the dielectric layer on the front substrate, but also the MgO film on the front substrate and the dielectric layer and MgO film on the rear substrate, because the surface of a film formed with the gel is far smoother compared with that of a film provided by sintering a glass paste and contains crystal of small and uniform particle diameters. Hitherto, MgO films have been formed by an electron beam evaporation method. Considerably large-scaled and expensive facilities are required to manufacture large scale gas discharge color display panels using this method. The MgO film formed by the thick film printing method does not have uniform crystalline particle diameters and does not provide sufficient characteristics. The organometallic gel used in the invention, which has molecule-level ceramics dispersed, can provide uniform MgO crystalline particle diameters.

The organometallic gel used in the invention is provided by, for example, hydrolyzing an alkoxide solution of metal of Si, Ti, Al, Zr, etc., such as a water or alcohol solution, at room temperature or close to room temperature. As the hydrolysis develops, a polycondensation reaction develops and the reaction solution becomes a sol. When the reaction furthermore develops, the gel used in the invention is produced.

The organometallic compound used here is represented by the general expression M(OR)n. M represents a metal (including semi-metal) atom, such as Si, Ti, Al, or Zr. R represents an organic group, preferably an alkyl group having the number of carbon atoms 1–5. n is a positive integer determined by the valency of M, normally 1–4. The organometallic compound and its hydrolysis product are changed to metal oxide by heat treatment.

The organometallic compounds that can be used in the invention include tetra(n-butyl) silicate:$Si(OC_4H_9)_4$, tri(sec-butoxy) aluminum: $Al(OC_4H_9)_3$, tetra(n-propyl) titanate:$Ti(OC_3H_7)_4$, tetra(n-butyl) zirconate:$Zr(OC_4H_9)_4$, trimethyl borate:$B(OCH_3)_3$, etc., for example.

For example, metallic chloride is used as a synthetic material of organometallic compound and is previously purified using a normal purification method such as distillation or recrystallization, whereby highly pure organometallic compound can be easily provided. The organometallic compounds can be produced for most metals and are normally liquid at room temperature. Therefore, different types of organometallic compounds are mixed and hydrolyzed, whereby a material gel of glass or ceramics having a desired composition can be easily prepared. Table 1 shown in FIG. 42 lists composition examples of dielectrics that can be provided from alkoxide gels.

A color filter disposed on the front substrate would improve color purity and be able to provide an image of a good picture quality. Preferably, the color filter is provided with a black matrix. It may be disposed on the outside of the front substrate, namely, on the side where the dielectric layer is not formed, for example.

However, the invention enables the color filter to be located between the glass plate and dielectric of the front substrate. Since a display panel manufacturing method using a low-temperature process is also provided, even if the color filter containing an organic substance is sandwiched between the glass plate and dielectric of the front substrate, the organic substance is not decomposed by heating in a post process. In doing so, the color filter is placed near the discharge space, widening the viewing angle.

Although Cu and Cr are used a materials of the bus electrodes and the auxiliary discharge electrodes, metal such as Al, Ti, Ni, W, Mo, or alloys thereof or a Cr/Cu/Cr laminated film, etc., can also be used. A sputtering method, electron beam evaporation method, plating method, resistance heating evaporation method, thick-film printing method, etc., can be used as the forming method of the electrodes. Transparent conductive material such as tin oxide or ITO, is used for the transparent electrodes for main discharge. A sputtering method, electron beam evaporation method, chemical vapor phase reaction method, sol-gel method, etc., can be used as the forming method of the transparent electrodes.

In addition to the method using the organometallic gel described above, a method such as the sputtering method, chemical vapor phase reaction method, or thick film printing method can also be used to form the dielectric layer.

Preferably, a material having a low sputtering rate and a high secondary electron emission capability is used as the protective layer material. MgO, CaO, or SrO, or mixtures thereof can be used.

A sandblasting method, an etching method, etc., can be used as the forming method of the bulkheads 13 and barrier rib 3*a* for partitioning the discharge space and the priming paths 3*e* of through holes made in the bulkheads 13 making the main discharge space 3*d* and the auxiliary discharge space 3*c* communicate with each other. The methods, which have good dimension accuracy, are appropriate for the invention. A thick-film printing technique, and a lift-off method in which a glass material and ceramic material are embedded after a film pattern is formed, are also useful to form the barrier rib 12 on the rear substrate side. Mixed gas of He and Xe, mixed gas of Ne and Xe, etc., can be used as a discharge gas with which the discharge space is filled.

BRIEF DESCRIPTION OF THE DRAWINGS

In the accompanying drawings:

FIG. 42 is a table 1 showing composition examples of dielectric films formed from organometallic compound;

FIG. 43 is a table 2 showing given intervals and thicknesses of barrier ribs 11 and 12; and FIGS. 44A and 44B are a table 3 showing sizes of discharge space and locations of priming paths.

DESCRIPTION OF THE PREFERRED EMBODIMENTS

Referring now to the accompanying drawings, there are shown preferred embodiments of the invention.

Embodiment 1

Figure 1A:
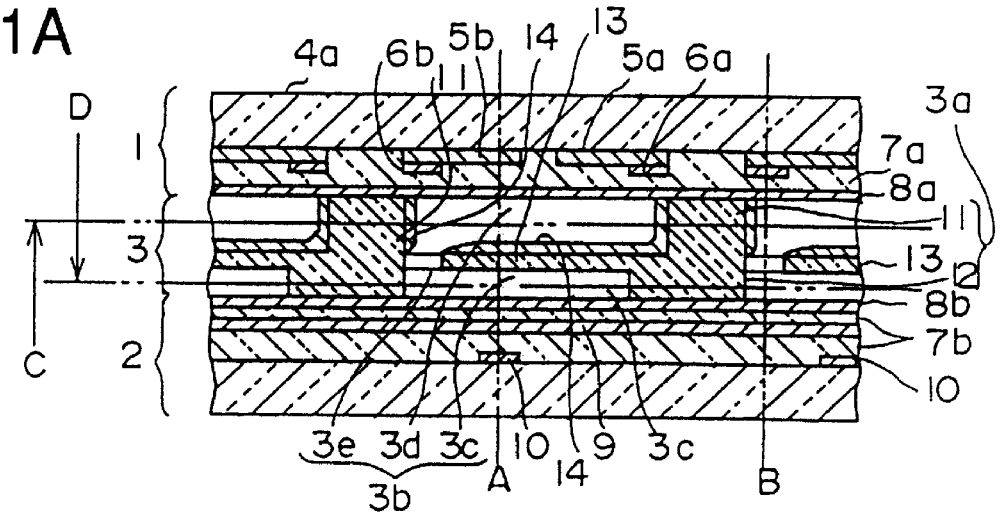
FIGS. 1A–1C are partially enlarged sectional views showing the structure of a gas discharge color display panel of a first embodiment.
Figure 1B:
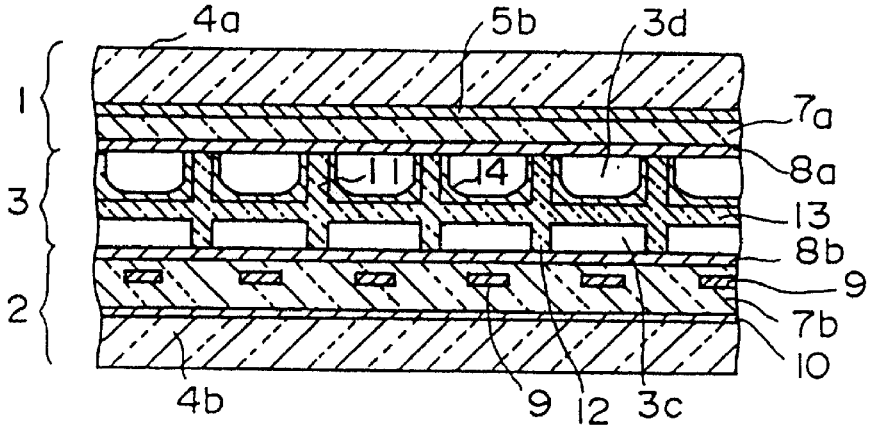
Figure 1C:
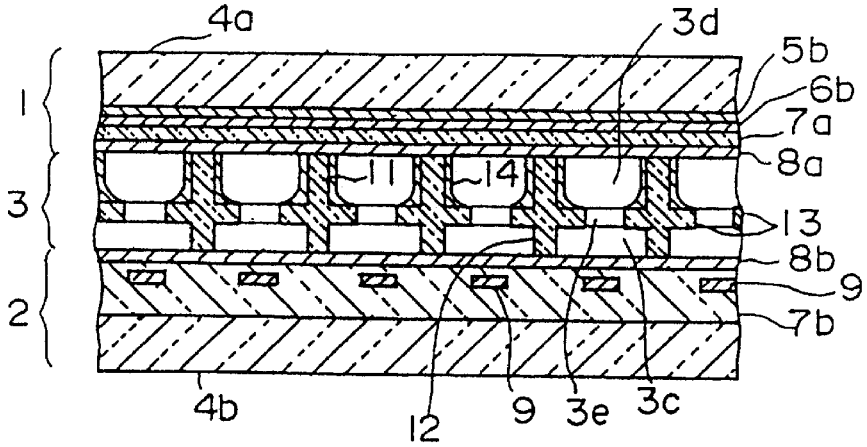

FIGS. 1A–1C, 9A and 9B are sectional views of a gas discharge color display panel manufactured according to a first embodiment of the invention. As shown in FIGS. 1A–1C, the gas discharge color display panel of the embodiment comprises a front substrate 1, a rear substrate 2, and a bulkhead substrate 3 for partitioning the gap therebetween into cells to be made into pixels. Mixed gas of He and Xe (Ne gas containing Xe of 5 vol %) is sealed in the gap 3*b* between the front substrate 1 and the rear substrate 2.

The front substrate 1 comprises a soda glass plate 4*a*, pairs of ITO electrodes 5*a* and 5*b* common to all cells of a cell row in a direction perpendicular to the paper face of FIGS. 1A–1C, bus electrodes 6*a* and 6*b* formed on the surfaces of the ITO electrodes 5*a* and 5*b*, a dielectric layer 7*a* formed on the surface of the soda glass plate 4*a* so as to cover the ITO electrodes 5*a* and 5*b* and the bus electrodes 6*a* and 6*b*, and an MgO film 8*a* formed on the surface of the dielectric layer 7*a*. Electrode patterns formed by the ITO electrodes 5*a* and 5*b* and the bus electrodes 6*a* and 6*b* are formed as a large number of parallel, linear patterns so as to provide two electrodes parallel with each cell of a cell row in one direction, among cells arranged like a matrix.

The ITO electrodes 5*a* and 5*b* are transparent electrodes, but have a high wiring resistance value. If only the ITO electrodes are used, the drive speed of main discharge is slow. Then, in the display panel of the embodiment, the bus electrodes 6*a* and 6*b* made of metal parallel with the line formed by the ITO electrodes 5*a* and 5*b* are formed on the surfaces of the ITO electrodes 5*a* and 5*b*, lowering the electrode wiring resistance value on the front substrate 1. However, the bus electrodes 6*a* and 6*b*, which are opaque, are preferably made as narrow as possible for reducing the shielding amount of light emitted from phosphor 14 by the bus electrodes 6*a* and 6*b*.

In the embodiment, the transparent electrodes 5*a* and 5*b* formed on the front substrate 1 are extended in the discharge cell row direction. However, when the bus electrodes 6*a* and 6*b* are provided as in the embodiment, the transparent electrodes 5*a* and 5*b* need not be extended along the discharge cell row and may be formed as separate electrodes for each discharge cell and connected by the bus electrodes. If the resistance value of the transparent electrode material constituting the transparent electrodes formed on the front substrate 1 is sufficiently low for practical use, the transparent electrodes may also be extended in a discharge cell arrangement direction for use as bus lines such as signal lines. However, in these cases, the effect of shielding light of auxiliary discharge by the bus electrodes 6*a* an 6*b* cannot be produced.

The rear substrate 2 comprises a soda glass plate 4*b*, address electrodes 9 formed on the surface of the soda glass plate 4*b*, a dielectric layer 7*b* formed on the surface of the first address electrode 9, trigger electrodes 10 embedded in the dielectric layer 7*b*, and an MgO film 8*b* formed so as to cover the surface of the dielectric layer 7*b* and the surface of the trigger electrodes 10 exposed from the dielectric layer 7*b*. The address electrodes 9 are patterned as a large number of linear patterns parallel with the substrate surface and parallel with each other. The trigger electrodes 10 are patterned as a large number of linear patterns parallel with each other and parallel with the substrate surface, and orthogonal to the line made by the address electrodes 9.

The MgO films 8*a* and 8*b* formed on the front substrate 1 and the rear substrate 2 serve as protective films for the dielectric layers 7*a* and 7*b*. They are useful for, because they have low sputtering rate and show an excellent resistance to sputtering, preventing dielectric layers from damage by sputtering with discharge and for increasing the life of the display panel. The MgO films 8*a* and 8*b*, which are transparent, easily transmit light emitted from the phosphor 14 and are suitable for use as the display panel.

FIG. 1A is a sectional view of the display panel when it is cut away on a plane parallel with the address electrodes 9 (namely, perpendicular to the trigger electrodes 10) and perpendicular to the surfaces of the substrates 1 and 2. FIG. 1B is a sectional view taken on line A of FIG. 1A; the cut-away face is a plane perpendicular to the address electrodes 9 (namely, parallel with the trigger electrodes 10) and perpendicular to the surfaces of the substrates 1 and 2. FIG. 1C is a sectional view taken on line B of FIG. 1A; the cut-away face is a plane perpendicular to the address electrodes 9 (namely, parallel with the trigger electrodes 10) and perpendicular to the surfaces of the substrates 1 and 2.

The bulkhead substrate 3 comprises a barrier rib 3*a* connected to the MgO firm 8*a* of the front substrate 1 and the MgO film 8*b* of the rear substrate 2, bulkheads 13 connected to the barrier rib 3*a* and parallel with the front and rear substrates, and a fluorescent layer 14 formed on the front substrate side of the barrier rib 3*a* and the bulkheads 13. The fluorescent layer 14 is a coating consisting of phosphors each emitting light of green, blue, or red by radiation. In the embodiment, the fluorescent layer 14 is applied over a wide area, providing good light emission efficiency of main discharge. The color which each of the phosphors emit is defined for each cell so that the color scheme of the entire substrate becomes a predetermined pattern.

The barrier rib 3*a* consists of a barrier rib 11 on the front substrate side and a barrier rib 12 on the rear substrate side. The barrier ribs 11 and 12 are formed integrally with the bulkheads 13 by processing a glass or ceramic plate using a sandblasting or etching method. Preferably, the barrier rib 11 and the bulkheads 13 are made opaque white or colored for shielding light to prevent light emitted in a display cell from leaking into its adjacent display cells and mixing colors.

Figure 9A:
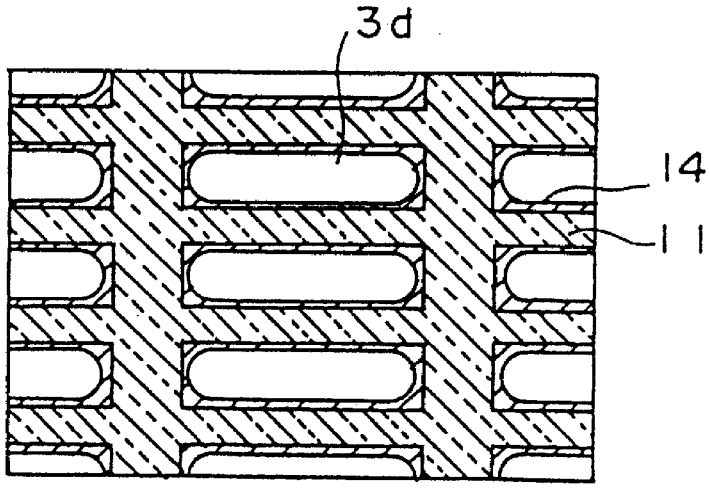
FIGS. 9A and 9B are partially enlarged sectional views showing the structure of a barrier rib of the gas discharge color display panel of the first embodiment.
Figure 9B:
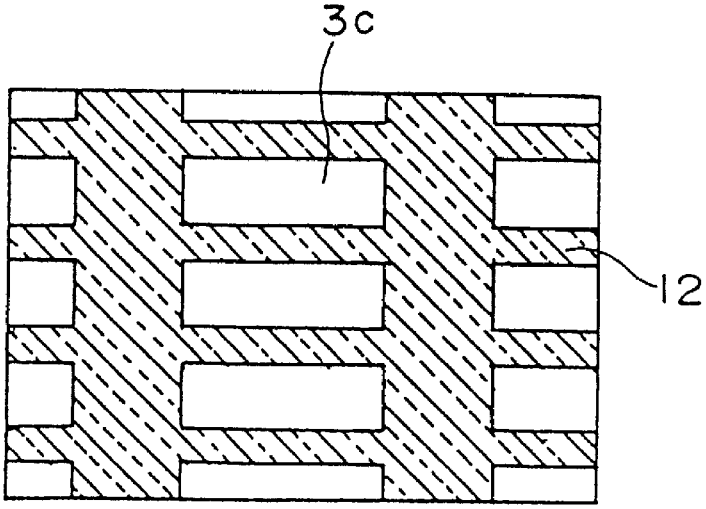

The barrier rib 3*a* is shaped like a lattice to partition the gap between the substrates 1 and 2 into cells. FIG. 9A is a sectional view of the display panel on a plane taken on line C in FIG. 1A. FIG. 9B is a sectional view of the display panel on a plane taken on line D in FIG. 1A.

The cells formed by the front substrate 1, the rear substrate 2, and the bulkhead substrate 3 are separated from adjacent cells by the barrier rib 3*a*. The bulkhead 13 parallel with the faces of the substrates 1 and 2 is formed in each cell. In the embodiment, the bulkheads 13 are placed horizontally to the glass plates 4*a* and 4*b*, but need not necessarily be horizontal to the glass plates 4*a* and 4*b*, unless they interfere with the movement of charged particles, etc.

Of space 3*b* in each cell, space 3*c* between the bulkhead 13 and the rear substrate 2 is used as space for auxiliary discharge and space 3*d* between the bulkhead 13 and the front substrate 1 is used as space for main discharge. The space 3*c* for auxiliary discharge and the space 3*d* for main discharge are communicated with each other by a priming path 3*e*. A discharge gas is sealed in the cell.

With the gas discharge color display panel according to the embodiment, one of the address electrodes 9 and one of the trigger electrodes 10 formed on the rear substrate 2 are selected and an alternating voltage is applied between the electrodes, whereby auxiliary discharge occurs in the auxiliary discharge space 3*c* of the cell at the intersection of the electrodes via the dielectric layer 7*b*. That is, the cell in which auxiliary discharge occurs can be selected by selecting the address electrode 9 and the trigger electrode 10 to which voltage is to be applied. The auxiliary discharge occurs between an electric charge induced to the surface of the MgO layer 8*b* via the dielectric layer 7*b* when the voltage is applied to the address electrode 9, and an electric charge induced on the surface of the MgO layer 8*b* via the dielectric layer 7*b* when the voltage is applied to the trigger electrode 10.

When alternating voltage is applied to the two bus electrodes 5*a* and 5*b*, passing through the given display cell, in a condition in which the auxiliary discharge thus occurs, the charge pattern of the electrodes is induced on the surface of the MgO layer 8*a* via the dielectric layer 7*a* and the effect of the auxiliary discharge ripples to the main discharge space 3*d* via the priming path 3*e*, causing main discharge to occur between different charges on the surface of the MgO layer 8*a*. That is, the main discharge occurs between an electric charge induced on the surface of the MgO layer 8*a* via the dielectric layer 7*a* when voltage is applied to the ITO electrode 5*a* formed with the bus electrode 6*a*, and an electric charge induced on the surface of the MgO layer 8*a* via the dielectric layer 7*a* when voltage is applied to the ITO electrode 5*b* formed with the bus electrode 6*b*. The main discharge does not occur in any cell in which no auxiliary discharge occurs.

When the main discharge occurs, gas mixed with Ne-Xe gas in the discharge space is excited, generating radiation (ultraviolet rays), which excite the phosphor 14 and thus generate visible light. The visible light is generated in each desired cell by selecting the electrodes to which voltage is applied, and is passed to the outside through the front substrate 1, whereby an image is formed on the display panel.

Thus, in the embodiment, the cells are separated by the barrier rib 3*a* and the space between the front substrate 1 and the rear substrate 2 is also partitioned by the bulkheads 13, thereby shielding auxiliary discharge from the phosphors 14 so that radiations generated by auxiliary discharge do not impinge on the phosphors 14. Thus, in the display panel of the embodiment, if auxiliary discharge is generated by applying voltage to the address electrode 9 and the trigger electrode 10 on the rear substrate 2, light emission caused by the auxiliary discharge is blocked by the bulkhead 13 and only main discharge causes the phosphor 14 to emit light. Therefore, in a cell in which only the auxiliary discharge occurs and the main discharge does not occur (namely, a cell where voltage is applied to the address electrode 9 and the trigger electrode 10, but not to the bus electrode 6*a* or 6*b*), the phosphor 14 does not emit light, and only light emission caused by the main discharge can be observed from the side of the front substrate 1, providing sufficient contrast.

Next, a method of manufacturing the gas discharge display panel of the embodiment will be discussed with reference to FIG. 10 (*a*)–(*p*), an illustration schematically showing the manufacturing method of the display panel of the embodiment.

The following explanation shows only one example of material and size of substrate, condition for manufacturing, and manufacturing device in the present invention. So, the invention is not limited by these terms.

A. Manufacturing of front substrate (1) Formation of electrodes for main discharge First, the front substrate 1 is manufactured. Soda glass plate 4*a* about 85 cm wide, about 70 cm deep, and about 2.8 mm thick having ITO film 5*c* formed on one face of the front and rear (FIG. 10 (*a*)) is provided. A photosensitive resin composite is applied to the surface of the ITO film 5*c* in a dust proof room at room temperature of 15°–25° C. and humidity 60%. The resulting photosensitive resin composite coating is exposed via a predetermined pattern mask in an exposure of 200–250 mJ/cm$^2$ with a 3-kW (output 8 kw) extra-high pressure mercury vapor lamp and spray-developed for 105 seconds under the conditions of development solution temperature 25° C. and pressure 1.2 kg/cm$^2$ using a sodium carbonate water solution of 0.2%–0.5%, then neutralized with a dilute acid of 0.1%, washed in water, and dried, forming a resist film of a predetermined pattern. Next, the exposed part of the ITO film 5*c* is etched in an etching liquid, and the resist film is then stripped in a stripping liquid, whereby the ITO film 5*c* is patterned and ITO electrodes 5*a* and 5*b* are formed at predetermined positions (FIG. 10 (*b*)).

Figure 10:
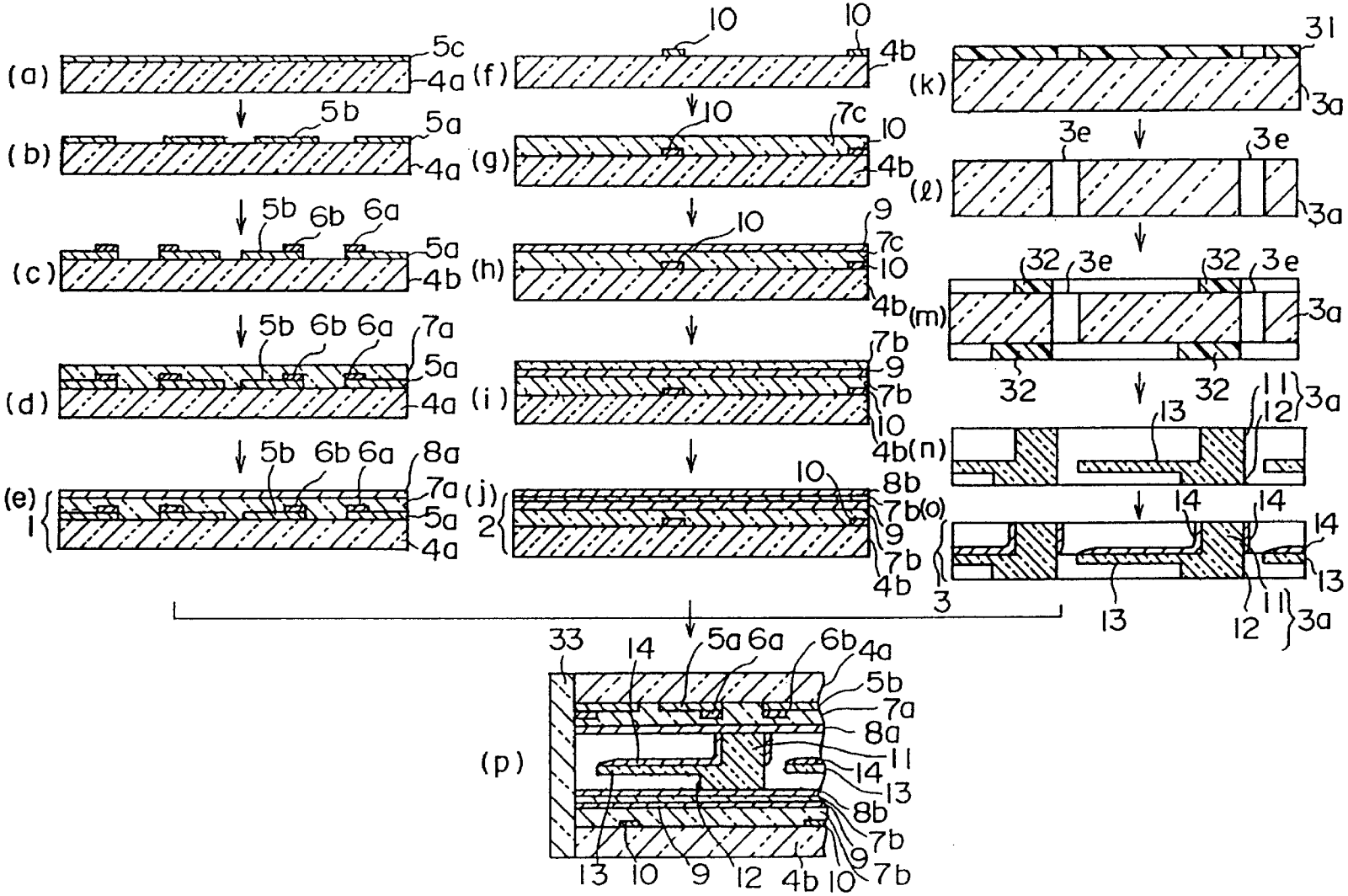
FIG. 10 is an illustration showing- a manufacturing method of the gas discharge color display panel of the first embodiment.

An electrode pattern of conductor paste is formed on the ITO electrodes 5*a* and 5*b* by a thick-film printing method, dried for 5–10 minutes at a temperature of 100°–150° C., and calcined for 5–10 minutes at a temperature of 550°–580° C., forming bus electrodes 6*a* and 6*b* each 0.08 mm wide and 0.03 mm thick (FIG. 10 (*c*)). The electrode material may be a metal having good conductivity. Here, silver is used.

(2) Formation of dielectric layer

Next, glass paste is applied to the surfaces of the ITO electrodes 5*a* and 5*b*, the bus electrodes 6*a* and 6*b*, and the glass plate 4*a*, dried for 5–10 minutes at a temperature of 100°–150° C., and calcined for 5–10 minutes at a temperature of 550°–550° C., forming a transparent dielectric layer 7*a* of 0.02 mm thick (FIG. 10(*d*)). Preferably, the film thickness of the dielectric layer 7*a* is 0.01–0.03 mm.

(3) Formation of protective film

Paste consisting essentially of MgO is applied to the surface of the dielectric layer 7*a* and dried for 5–10 minutes at a temperature of 100°–150° C., then heat-treated for 15–40 minutes at a temperature of 300°–350° C., forming an MgO film 8*a* 0.004 mm thick (FIG. 10 (*e*)). Preferably, the MgO film 8*a* is made 0.002–0.005 mm thick. During formation of the dielectric layer and the MgO film, the paste film may be formed by any method of blade, spinner, spray, roll, dip, printing, etc. The front substrate 1 is thus provided by executing the steps (1)–(3).

B. Manufacturing of rear substrate (4) Formation of trigger electrodes

Next, the rear substrate 2 is manufactured. First, soda glass plate 4*b* about 90 cm wide, about 65 cm deep, and about 2.8 mm thick is provided. A conductor paste layer of a predetermined pattern is formed on the soda glass plate 4*b* by a thick film printing method, dried for 5–10 minutes at a temperature of 100°–150° C., and calcined for 5–10 minutes at a temperature of 550°–580° C., forming trigger electrodes 10 each 0.12 mm wide and 0.03 mm thick (FIG. 10 (*f*)). The electrode material may be metal having good conductivity. Here, silver is used.

(5) Formation of dielectric layer

Glass paste is applied to the surfaces of the trigger electrodes 10 and the glass plate 4*b*, dried for 5–10 minutes at a temperature of 100°–150° C., and calcined for 5–10 minutes at a temperature of 500°–550° C., forming a part 7*c* of a transparent dielectric layer 7*b* 0.01–0.03 mm (in the embodiment, 0.02 mm) thick (FIG. 10 (*g*)).

(6) Formation of address electrodes and dielectric layer

As in step (4) above, address electrodes 9 each 0.12 mm wide and 0.03 mm thick are formed on the surface of the dielectric layer (FIG. 10 (*h*)). Further, glass paste is applied to the surfaces of the address electrodes 9 and the dielectric layer formed in step (5) above, dried for 5–10 minutes at a temperature of 100°–150° C., and calcined for 5–10 minutes at a temperature of 500°–550° C., forming the remainder of the transparent dielectric layer 7*b* 0.01 mm thick (FIG. 10 (*i*)), whereby the dielectric layer 7*b* having the address electrodes 9 formed therein is formed.

(7) Formation of protective film

Paste consisting essentially of MgO is applied to the surface of the dielectric layer 7*b* and dried for 5–10 minutes at a temperature of 100°–150° C., then heat-treated for 15–40 minutes at a temperature of 300°–350° C., forming an MgO film 8*b* 0.002–0.005 mm (in the embodiment, 0.004 mm) thick (FIG. 10 (*j*)). The rear substrate 2 is thus provided by executing the steps (4)–(7). A tip tube (not shown) for exhaust and gas introduction after the panel is assembled is attached to the rear substrate.

C. Manufacturing of bulkhead substrate (8) Formation of resist film

Next, the bulkhead substrate 3 is manufactured. First, a ceramic plate 30 (or borosilicate glass plate) consisting essentially of alumina about 85 cm wide, about 65 cm deep, and about 0.5 mm thick is provided. A photosensitive resin composite is applied to one face of the front and rear of the ceramic plate 30. The resulting photosensitive resin composite coating is exposed to an exposure of 200–250 mJ/cm$^2$ using a 3-kW (output 8 kw) extra-high pressure mercury vapor lamp via a predetermined pattern mask for preparing discharge priming paths between the front and rear substrates in cells. Next, it is spray-developed for 105 seconds under the conditions of a development solution temperature 25° C. and a pressure 1.2 kg/cm$^2$ using a sodium carbonate water solution of 0.2%–0.5%, then neutralized with a dilute acid of about 0.1%, washed in water, and dried, forming a resist film 31 of a predetermined pattern (FIG. 10 (*k*)).

(9) Formation of priming paths

Next, through holes are made in the ceramic plate 30, at a portion not covered with the resist film 31, using a sandblasting method to form discharge priming paths 3*e* each between a space 3*d* on the side of the front substrate 1 and a space 3*c* on the side of the rear substrate 2, and the resist film 31 is stripped using a stripping liquid (FIG. 10 (*l*)). The priming path 3*e* is a through hole whose bottom is 0.1 mm×0.15 mm.

(10) Formation of resist film

A photosensitive resin composite is applied to both faces of the ceramic plate 30 comprising the priming paths 3*e*, and is exposed to an exposure of 200–250 mJ/cm$^2$ using a 3-kW (output 8 kw) extra-high pressure mercury vapor lamp via a predetermined pattern mask for forming cells. Next, it is spray-developed for 105 seconds under the conditions of a development solution temperature 25° C. and a pressure 1.2 kg/cm$^2$ using a sodium carbonate water solution of 0.2%–0.5%, then neutralized with a dilute acid of about 0.1%, washed in water, and dried, forming a resist film 32 of a predetermined pattern (FIG. 10 (m)).

(11) Formation of barrier rib and bulkheads

Next, the ceramic plate 30 of the portion not covered with to form a main discharge space 3*d* and an auxiliary discharge space 3*c* in cells, and the resist film 32 is stripped using a stripping liquid, whereby a barrier rib comprising a barrier rib 11 on the front substrate side and a barrier rib 12 on the rear substrate side in one piece, and bulkheads 13 for separating main discharge and auxiliary discharge from each other are formed, namely, a part comprising the barrier rib 3*a* and the bulkheads 13 is formed (FIG. 10 (*n*)).

(12) Formation of fluorescent layer

Further, green, blue, and red phosphors are applied to the front substrate side of the part comprising the barrier rib 3*a* and the bulkheads 13 by a spray method via predetermined green, blue, and red pattern masks, then dried for 5–60 minutes at a temperature of 150°–300° C., forming a fluorescent layer 14 (FIG. 10 (*o*)). If color display is not required, a fluorescent layer of a only single color can be formed in all cells.

The bulkhead substrate 3 as a part having the barrier rib 3*a*, the bulkheads 13, and the fluorescent layer 14 are provided by executing the steps (8)–(12).

D. Assembly

(13) Assembly of substrates 1–3

The substrates 1–3 thus provided are aligned and a sealing member 33 (frit glass) is applied to the edges of the substrates 1–3 with a dispenser and fixed by heat treatment at 300°–400° C., whereby the display panel can be assembled accurately (FIG. 10 (*p*)).

(14) Injection of gas

Lastly, air is released from the cells via the tip tube (not shown) to produce a vacuum and He-5% Xe mixed gas is introduced until the pressure in the cells becomes 300–500 Torr, then the tip tube is heated and tipped off by local heat application, providing a gas discharge color display panel.

E. Result

In the gas discharge display panel manufactured by executing the steps (1)–(14), the gap between the front substrate 1 and the rear substrate 2 is partitioned into cells by the barrier rib 3*a* and each cell is divided into the main discharge space 3*d* and the auxiliary discharge space 3*c* by the bulkheads 13 for shielding auxiliary discharge, with the main discharge space 3*d* and the auxiliary discharge space 3*c* being communicated with each other by the priming path 3*e*.

In the display panel, an alternating voltage is applied to the two electrodes 9 and 10 crossing at each cell position formed on the rear substrate 2, thereby generating auxiliary discharge in the auxiliary discharge space 3*c* in the cell. The effect of the auxiliary discharge ripples through the priming path 3*e*, facilitating discharge in the main discharge space 3*d*. In this state, if an alternating voltage is applied between the two parallel electrodes 5*a* and 5*b* (and/or 6*a* and 6*b*) formed on the front substrate 1, main discharge occurs. Ultraviolet rays produced by the main discharge cause the phosphor 14 to emit light. Since the light is applied to the outside through the glass plate 4 and the transparent electrodes 5*a* and 5*b* on the front substrate 1, red, green, or blue color is observed at the cell from the outside. In the display panel of the embodiment, light emission caused by auxiliary discharge is shielded by the bulkheads 13 and only light emission caused by main discharge is observed, so that sufficient contrast (100:1 or more) can be provided between the cell in which main discharge occurs and the cell in which no main discharge occurs.

Although the embodiment uses silver as the material of the bus electrodes 6*a* and 6*b* and the auxiliary discharge electrodes 9 and 10, Cr/Cu/Cr laminated film, Cu, Al, Ti, Ni, W, or Mo, an alloy thereof or laminated films thereof may also be used. Although the bus electrodes 6*a* and 6*b* and the auxiliary discharge electrodes 9 and 10 are made by a thick-film printing method, the forming method for the material is not limited; a sputtering method, vacuum evaporation coating method (electron beam evaporation method, resistance heating evaporation method) plating method (electroless plating, electroplating), etc., can be selected appropriately. The material of which the transparent electrodes 5*a* and 5*b* are made is not limited to ITO either, and it may be a transparent material having sufficient conductivity such as stannous oxide. The forming method of the material is not limited, either. The sputtering method, vacuum evaporation coating method (resistance heating evaporation method), electron beam evaporation method, chemical vapor phase reaction method, sol-gel method, etc., may be selected appropriately.

The forming method of the dielectric layer 8 is not similarly limited, and the sputtering method, chemical vapor phase reaction method, sol-gel method, thick-film printing method, etc., may be selected appropriately. Although the embodiment uses MgO as the protective layer, a material having a sputtering rate and a high secondary electron emission capability may be used; CaO, SrO, or their mixture may be used instead of MgO.

Although the embodiment uses the sandblasting method for forming the bulkhead substrate 3, any other method may be used. However, the sandblasting method and the etching method, which have good position accuracy, are more appropriate for the invention than a method of forming and sintering ceramic slurry. Particularly in formation of the barrier rib 12, a lift-off method in which a glass or ceramic material is embedded after a film pattern is formed, and a thick film printing technique, are also effective formation methods.

Further, the embodiment uses mixed gas of He and Xe as discharge gas, but the discharge gas is not thus limited and any gas for generating radiations required for discharge to cause phosphors to emit light, such as a mixed gas of Ne and Xe, can be used.

Although the embodiment uses the soda glass plates 4*a* and 4*b* as the substrate material of the substrates 1 and 2, other substrate materials may be used. However, a transparent material is used as the substrate material of the front substrate 1.

Given intervals and thicknesses of barrier ribs 11 and 12 in the present and following embodiments are listed in Table 2 shown in FIG. 43.

Further, size of discharge space and location of priming path of the present and following embodiments are listed in Table 3 shown in FIGS. 44A and 44B.

Embodiment 2

A manufacturing method of a gas discharge color display panel according to a second embodiment of the invention is the same as that according to the first embodiment of the invention except for the form of the mask 32 of the ceramic plate 30 in step (10), namely, the position where the ceramic plate 30 is shaved in step (11) and the resulting form of the bulkhead substrate 3.

Figure 2A:
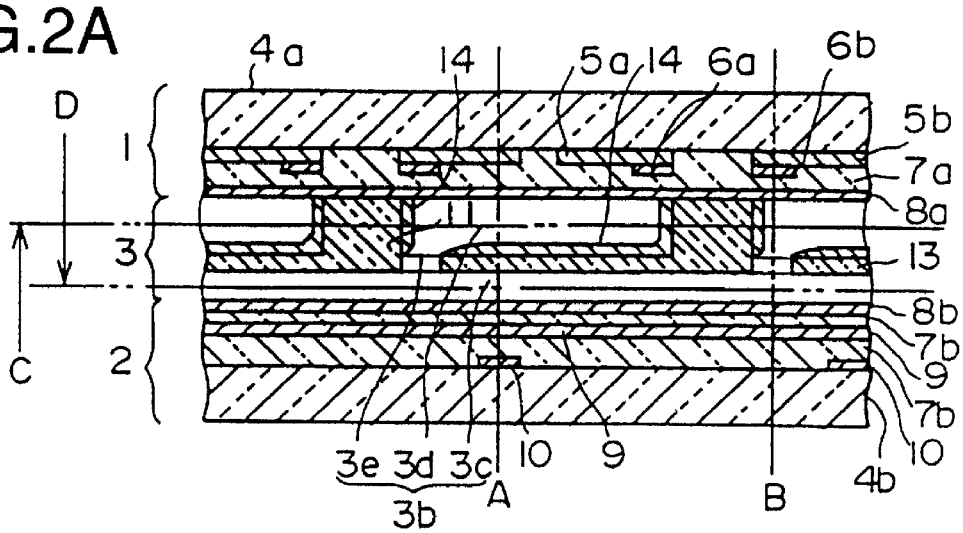
FIGS. 2A–2C are partially enlarged sectional views showing the structure of a gas discharge color display panel of a second embodiment.
Figure 2B:
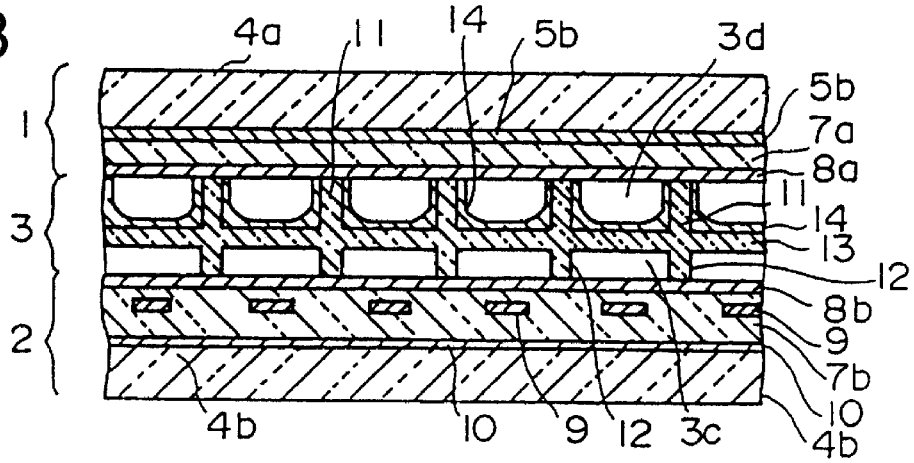
Figure 2C:
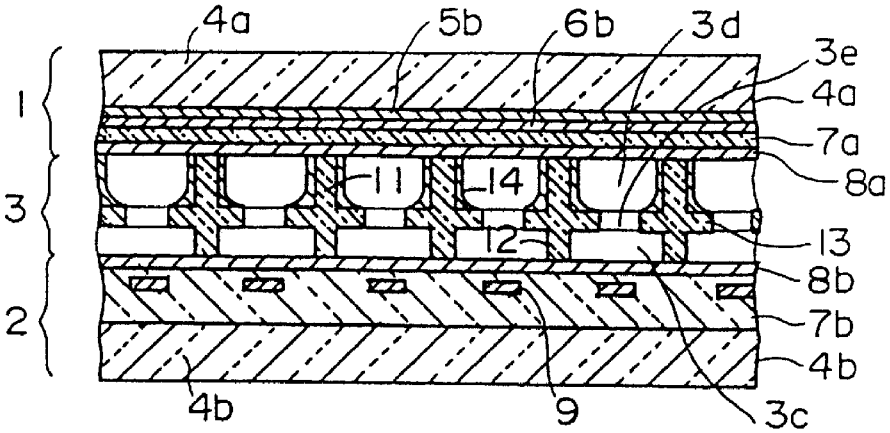
Figure 11A:
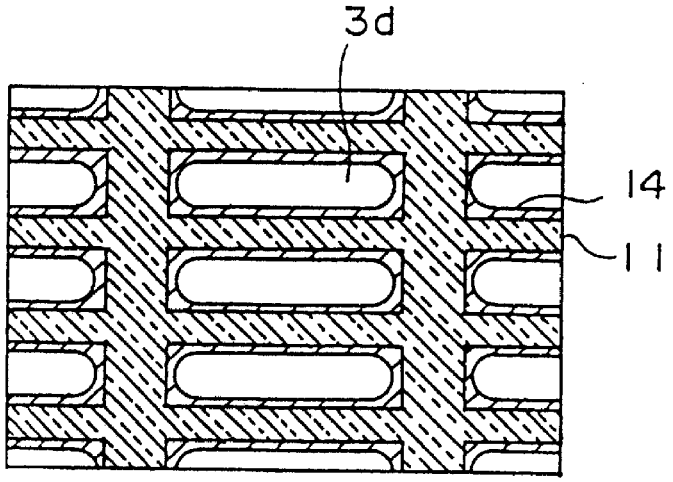
FIGS. 11A and 11B are partially enlarged sectional views showing the structure of a barrier rib of the gas discharge color display panel of the second embodiment.

FIGS. 2A–2C, 11A and 11B are sectional views of the display panel manufactured according to the second embodiment of the invention. FIG. 2A is a sectional view of the display panel when a part thereof is cut away on a plane parallel with address electrodes 9 and perpendicular to the surfaces of substrates 1 and 2. FIG. 2B is a sectional view taken on line A of FIG. 2A; the cut-away face is a plane perpendicular to the address electrodes 9 (namely, parallel with trigger electrodes 10) and perpendicular to the surfaces of the substrates 1 and 2. FIG. 2C is a sectional view taken on line B of FIG. 2A; the cut-away face is a plane perpendicular to the address electrodes 9 (namely, parallel with the trigger electrodes 10) and perpendicular to the surfaces of the substrates 1 and 2. FIG. 11A is a sectional view of the display panel on a plane taken on line C in FIG. 2A. FIG. 11 B is a sectional view of the display panel on a plane taken on line D in FIG. 2A.

Figure 11B:
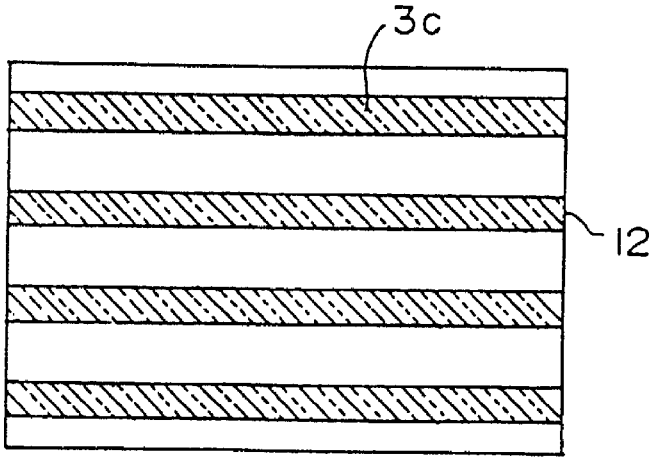

In the first embodiment, the barrier rib on the rear substrate side is shaped like a lattice as shown in FIG. 9B; on a bulkhead substrate 3 of the display panel of the second embodiment, barrier ribs 12 on the rear substrate side are formed like stripes parallel with the address electrodes 9 as shown in FIG. 11B. Like the first embodiment, the second embodiment also provides a display panel having good color contrast.

Embodiment 3

A manufacturing method of a gas discharge color display panel according to a third embodiment of the invention is the same as that according to the first embodiment of the invention except for the form of the mask 32 of the ceramic plate 30 in step (10), namely, the position where the ceramic plate 30 is shaved in step (11) and the resulting form of the bulkhead substrate 3.

Figure 3A:
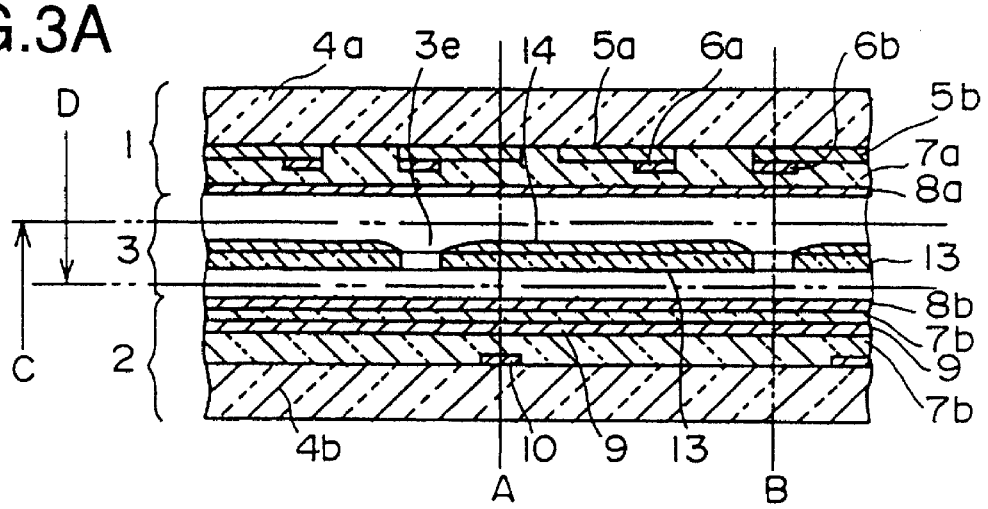
FIGS. 3A–3C are partially enlarged sectional views showing the structure of a gas discharge color display panel of a third embodiment.
Figure 3B:
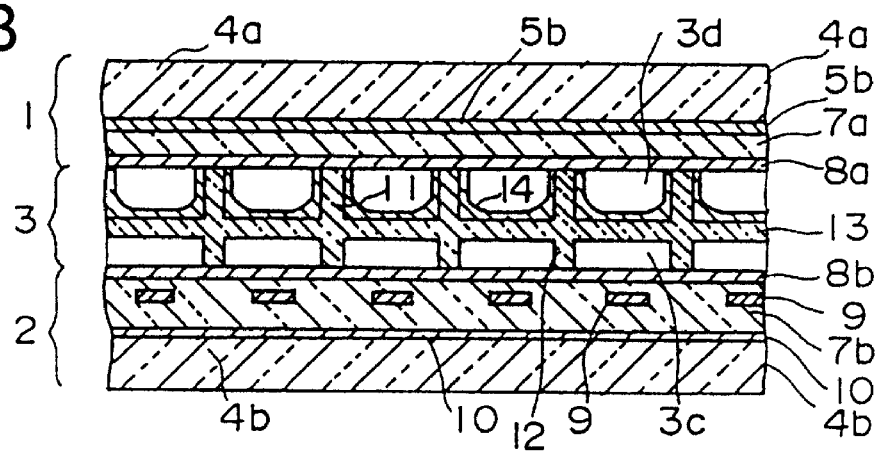
Figure 3C:
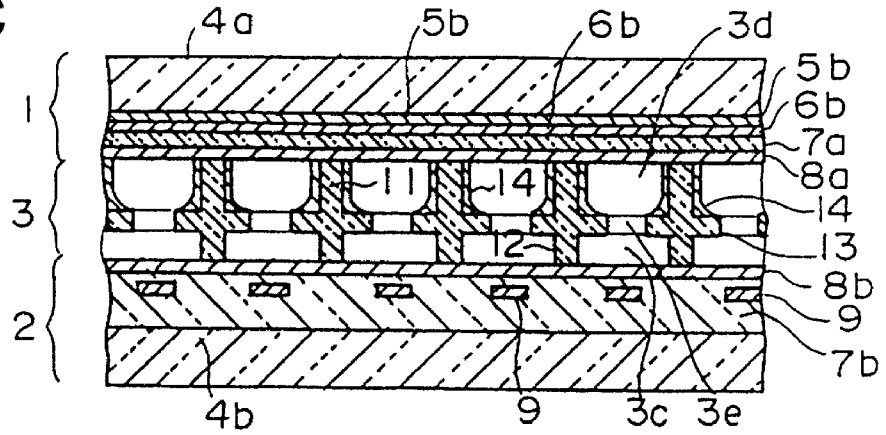
Figure 12A:
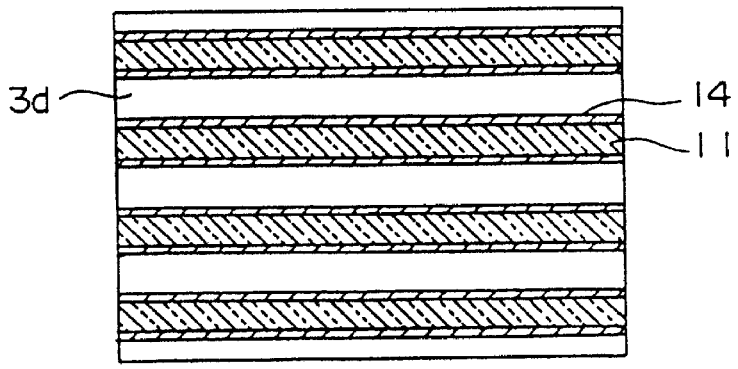
FIGS. 12A and 12B are partially enlarged sectional views showing the structure of a barrier rib of the gas discharge color display panel of the third embodiment.
Figure 12B:
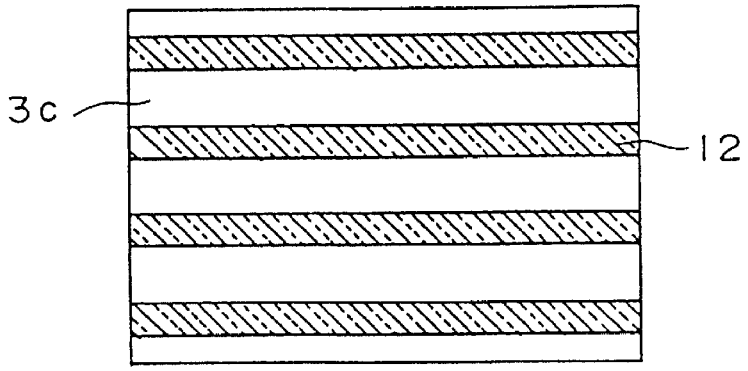

FIGS. 3A–3C, 12A and 12B are sectional views of the display panel manufactured according to the third embodiment of the invention. FIG. 3A is a sectional view of the display panel when a part thereof is cut away on a plane parallel with address electrodes 9 and perpendicular to the surfaces of substrates 1 and 2. FIG. 3B is a sectional view taken on line A of FIG. 3A; the cut-away face is a plane perpendicular to the address electrodes 9 (namely, parallel with trigger electrodes 10) and perpendicular to the surfaces of the substrates 1 and 2. FIG. 3C is a sectional view taken on line B of FIG. 3A; the cut-away face is a plane perpendicular to the address electrodes 9 (namely, parallel with the trigger electrodes 10) and perpendicular to the surfaces of the substrates 1 and 2. FIG. 12A is a sectional view of the display panel on a plane taken on line C in FIG. 3A. FIG. 12B is a sectional view of the display panel on a plane taken on line D in FIG. 3A.

In the first embodiment, both the barrier rib 11 on the front substrate side and the barrier rib 12 on the rear substrate side are shaped like a lattice as shown in FIGS. 9A and 9B; on a bulkhead substrate 3 of the display panel of the third embodiment, both barrier ribs 11 on the front substrate side and barrier ribs 12 on the rear substrate side are formed like stripes parallel with the address electrodes 9 as shown in FIGS. 12A and 12B. Like the first embodiment, the third embodiment also provides a display panel having good color contrast.

Embodiment 4

Although the barrier rib 11 on the front substrate side and the barrier rib 12 on the rear substrate side are both formed in steps (10) and (11) in the first embodiment, they are formed separately in a fourth embodiment of the invention. A manufacturing method of a gas discharge color display panel according to the fourth embodiment of the invention differs from that according to the first embodiment of the invention in the forming method of the barrier rib 3*a*. The actual form of the barrier rib 3*a* is the same in the first and fourth embodiments.

Figure 4A:
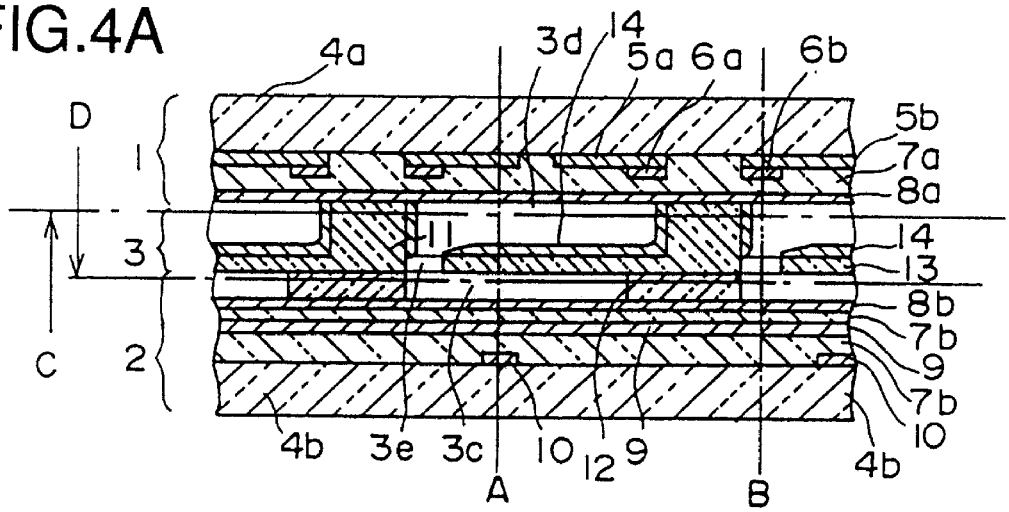
FIGS. 4A–4C are partially enlarged sectional views showing the structure of a gas discharge color display panel of a fourth embodiment.
Figure 4B:
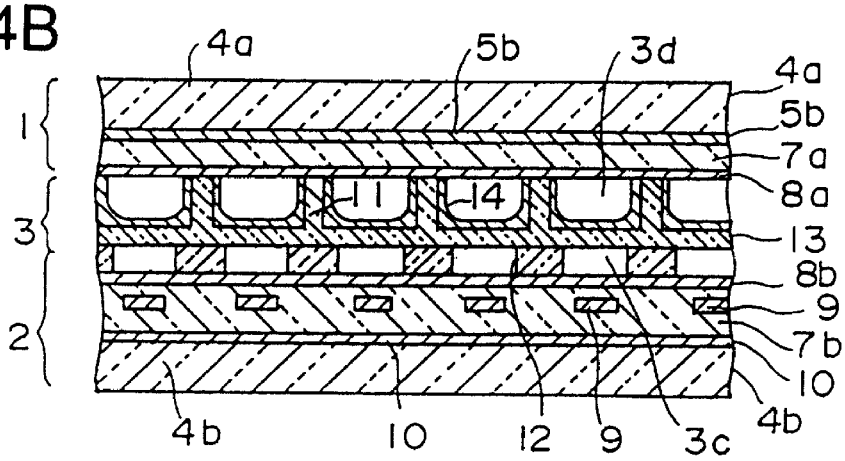
Figure 4C:
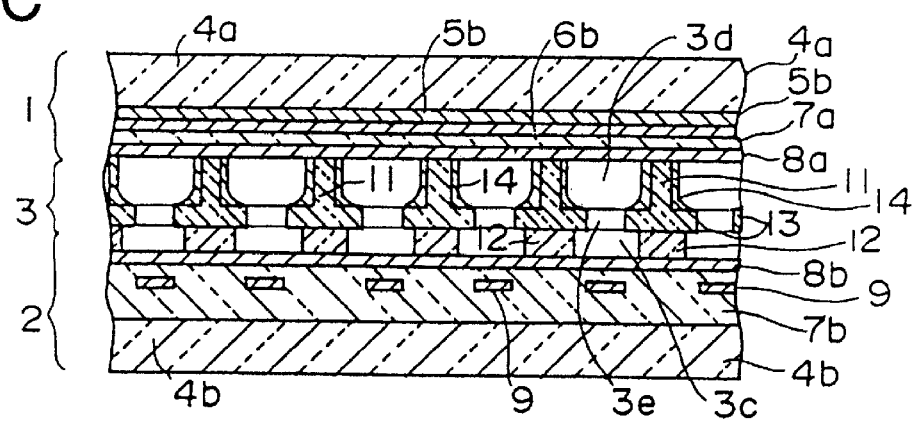
Figure 13A:
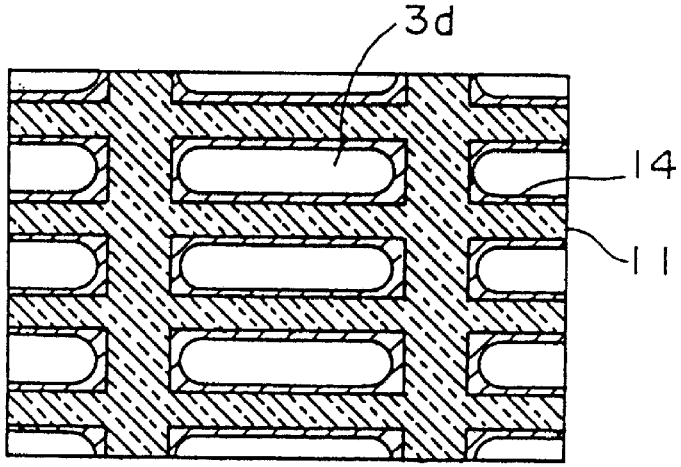
FIGS. 13A and 13B are partially enlarged sectional views showing the structure of a barrier rib of the gas discharge color display panel of the fourth embodiment.
Figure 13B:
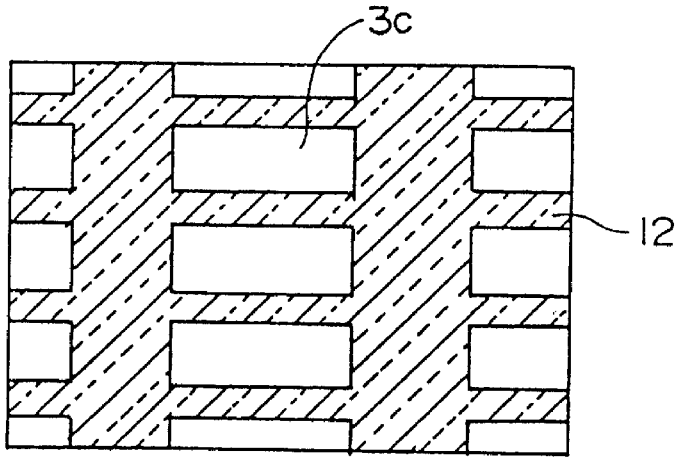

FIGS. 4A–4C, 13A and 13B are sectional views of the display panel manufactured according to the fourth embodiment of the invention. FIG. 4A is a sectional view of the display panel when a part thereof is cut away on a plane parallel with address electrodes 9 and perpendicular to the surfaces of substrates 1 and 2. FIG. 4B is a sectional view taken on line A of FIG. 4A; the cut-away face is a plane perpendicular to the address electrodes 9 (namely, parallel with trigger electrodes 10) and perpendicular to the surfaces of the substrates 1 and 2. FIG. 4C is a sectional view taken on line B of FIG. 4A; the cut-away face is a plane perpendicular to the address electrodes 9 (namely, parallel with the trigger electrodes 10) and perpendicular to the surfaces of the substrates 1 and 2. FIG. 13A is a sectional view of the display panel on a plane taken on line C in FIG. 4A. FIG. 13B is a sectional view of the display panel on a plane taken on line D in FIG. 4A.

Next, the forming method of the barrier rib 3*a* in the fourth embodiment will be discussed with reference to FIG. 14.

Figure 14:
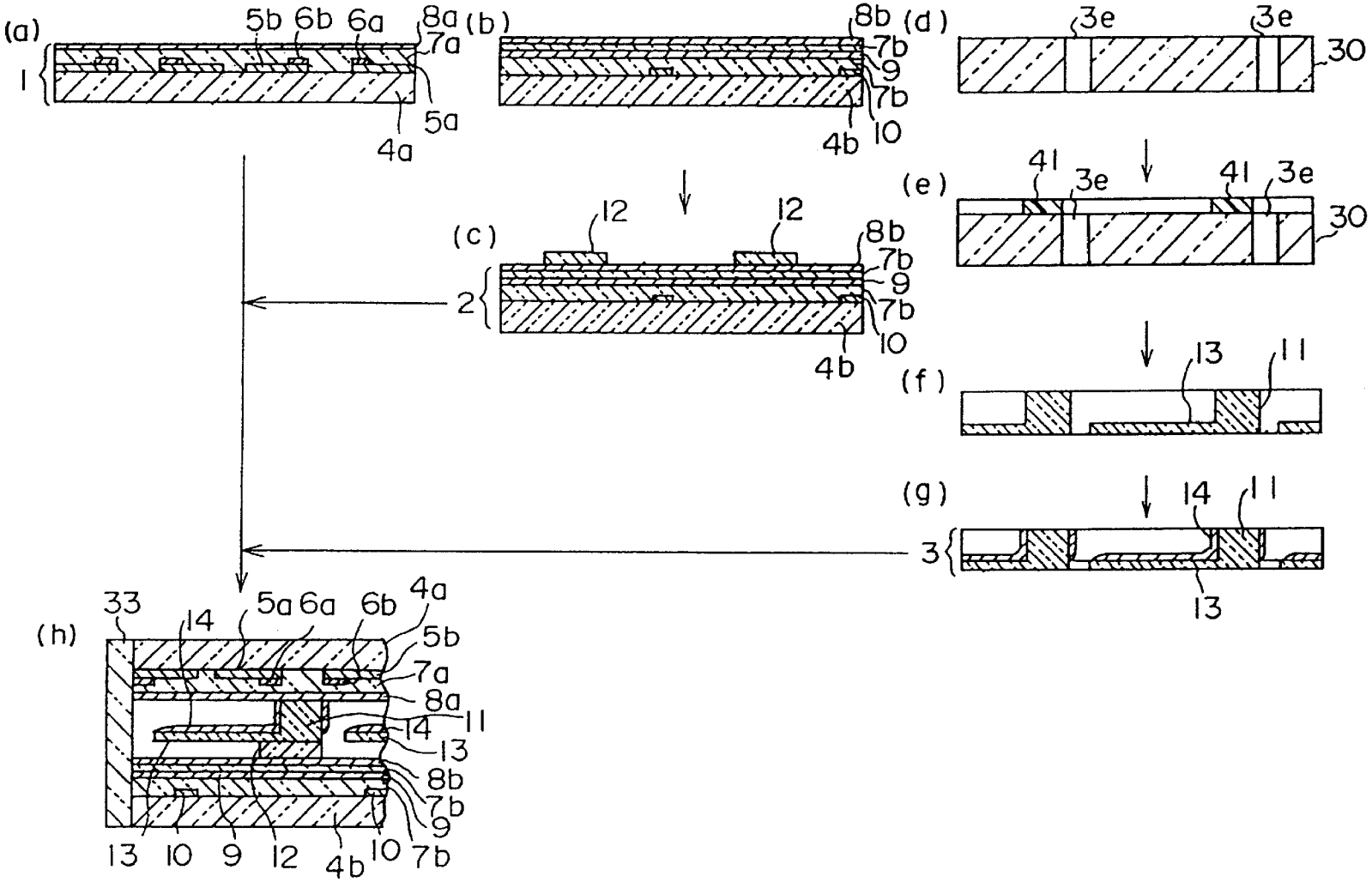
FIG. 14 is an illustration showing a manufacturing method of the gas discharge color display panel of the fourth embodiment.

A glass paste film of a predetermined pattern is formed by a thick film printing method on the surface of an MgO film 8*b* on the rear substrate 2 manufactured as in the first embodiment (FIG. 14 (*b*)) and dried for 5–10 minutes at a temperature of 100°–150° C., then calcined for 5–10 minutes at a temperature of 500°–550° C., forming barrier ribs 12 on the rear substrate side each 0.1 mm thick (FIG. 14 (*c*)). Preferably, the barrier rib 12 on the rear substrate side is made 0.02–0.1 mm thick.

Through holes of priming paths 3*e* are made in a ceramic plate 30 of 0.4 mm thick as in the first embodiment, as shown in FIG. 14 (*d*), then a resist film 41 of a pattern for a barrier rib 11 on the front substrate side is formed only on one face of the front and rear of the ceramic plate 30 as in the first embodiment (FIG. 14 (*e*)). The portion of the ceramic plate 30 not covered with the resist film 41 is shaved by a sandblasting method, to form main discharge space 3*d* and bulkheads 13 (FIG. 14 (*f*)), and phosphors are then applied to predetermined positions to form a fluorescent layer 14 as in the first embodiment (FIG. 14 (*g*)).

Lastly, a front substrate 1 manufactured as in the first embodiment (FIG. 14 (*a*)), the bulkhead substrate 3 on which the barrier ribs 12 on the rear substrate side are not formed (FIG. 14 (*g*)), and the rear substrate 2 on which the barrier ribs 12 on the rear substrate side are formed (FIG. 14 (*c*)) are aligned and laminated on top of each other in order, and the surroundings thereof are sealed as in the first embodiment (FIG. 14 (*h*)). He-5% Xe gas is then injected and a tip tube is tipped off, providing a gas discharge color display panel.

Like the first embodiment, the fourth embodiment also provides a display panel having good color contrast.

Embodiment 5

Although the barrier rib 11 on the front substrate side and the barrier rib 12 on the rear substrate side are both formed in the second embodiment as in steps (10) and (11) in the first embodiment, they are formed separately in a fifth embodiment of the invention. A manufacturing method of a gas discharge color display panel according to the fifth embodiment of the invention differs from that according to the second embodiment of the invention only in the forming method of the barrier rib 3*a*; the actual form of the barrier rib 3*a* is the same in the second and fifth embodiments.

Figure 5A:
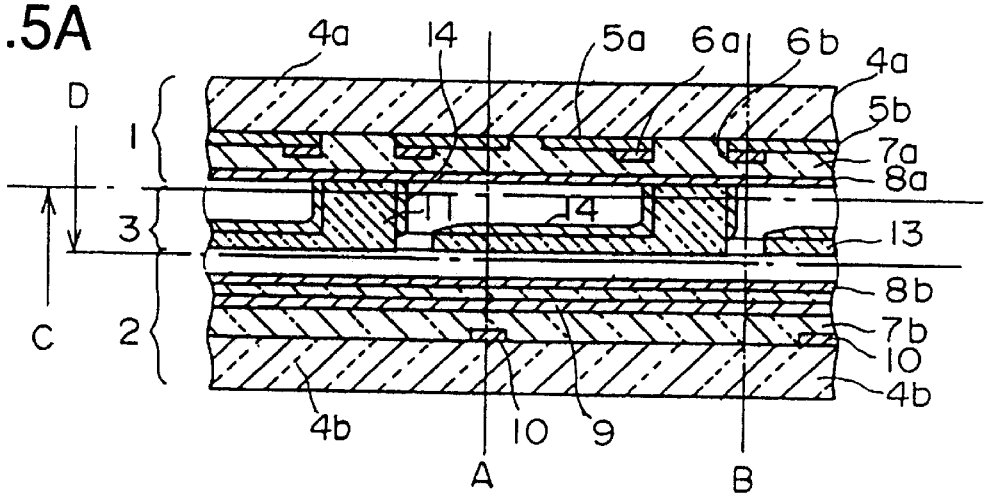
FIGS. 5A–5C are partially enlarged sectional views showing the structure of a gas discharge color display panel of a fifth embodiment.
Figure 5B:
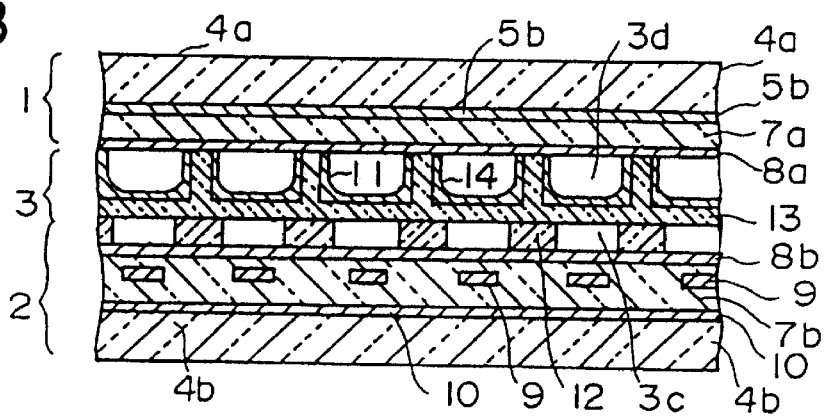
Figure 5C:
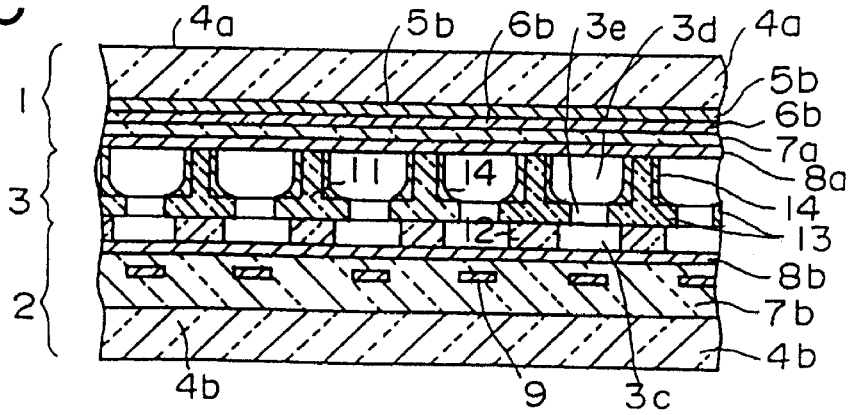
Figure 15A:
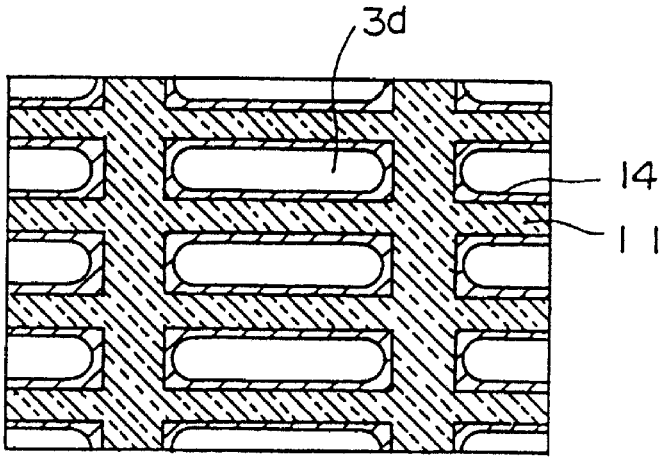
FIGS. 15A and 15B are partially enlarged sectional views showing the structure of a barrier rib of the gas discharge color display panel of the fifth embodiment.
Figure 15B:
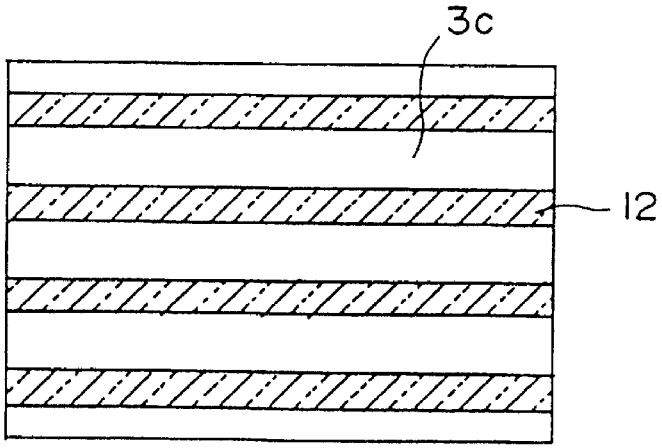

FIGS. 5A–5C, 15A and 15B are sectional views of the display panel manufactured according to the fifth embodiment of the invention. FIG. 5A is a sectional view of the display panel when a part thereof is cut away on a plane parallel with address electrodes 9 and perpendicular to the surfaces of substrates 1 and 2. FIG. 5B is a sectional view taken on line A of FIG. 5A; the cut-away face is a plane perpendicular to the address electrodes 9 (namely, parallel with trigger electrodes 10) and perpendicular to the surfaces of the substrates 1 and 2. FIG. 5C is a sectional view taken on line B of FIG. 5A; the cut-away face is a plane perpendicular to the address electrodes 9 (namely, parallel with the trigger electrodes 10) and perpendicular to the surfaces of the substrates 1 and 2. FIG. 15A is a sectional view of the display panel on a plane taken on line C in FIG. 5A. FIG. 15B is a sectional view of the display panel on a plane taken on line D in FIG. 5A.

Barrier ribs 12 on the rear substrate side of a bulkhead substrate 3 of the display panel of the fifth embodiment are formed like stripes parallel with the address electrodes 9, as in the second embodiment, as shown in FIG. 15B. A forming method of the barrier rib 3*a* in the fifth embodiment is the same as that in the second embodiment, except for the form of a glass paste film printed on the MgO film surface on the rear substrate.

Like the second embodiment, the fifth embodiment also provides a display panel having good color contrast.

Embodiment 6

Although the barrier rib 11 on the front substrate side and the barrier rib 12 on the rear substrate side are both formed in the third embodiment as in steps (10) and (11) in the first embodiment, they are formed separately in a sixth embodiment of the invention. A manufacturing method of a gas discharge color display panel according to the sixth embodiment of the invention differs from that according to the third embodiment of the invention only in the forming method of the barrier rib 3*a*; the actual form of barrier rib 3*a* is the same in the third and sixth embodiments.

Figure 6A:
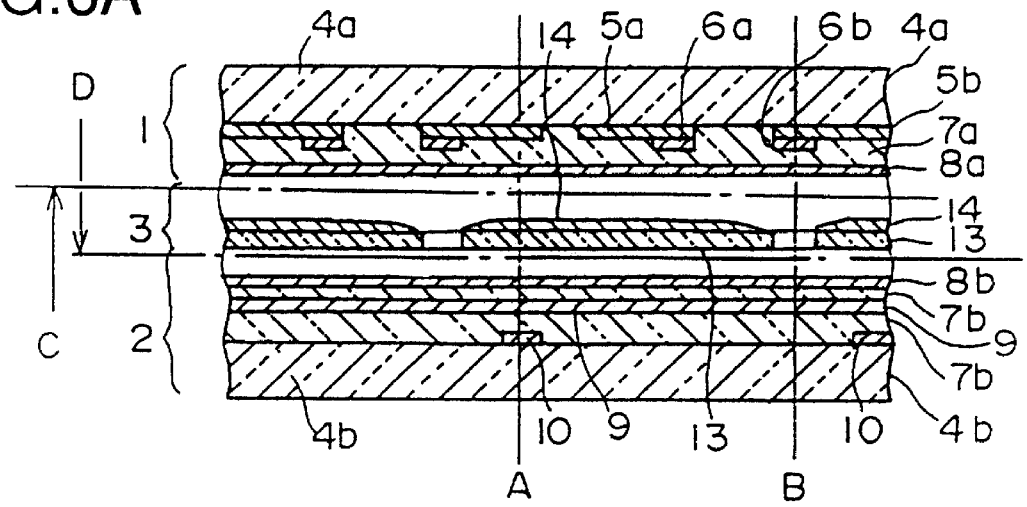
FIGS. 6A–6C are partially enlarged sectional views showing the structure of a gas discharge color display panel of a sixth embodiment.
Figure 6B:
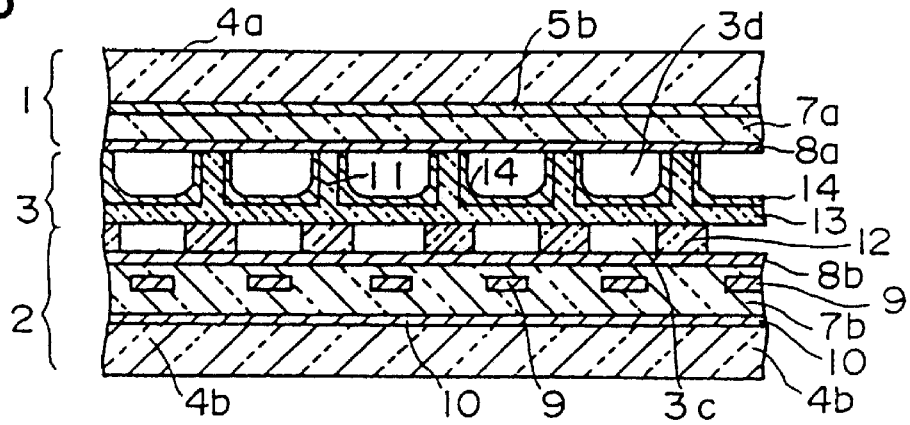
Figure 6C:
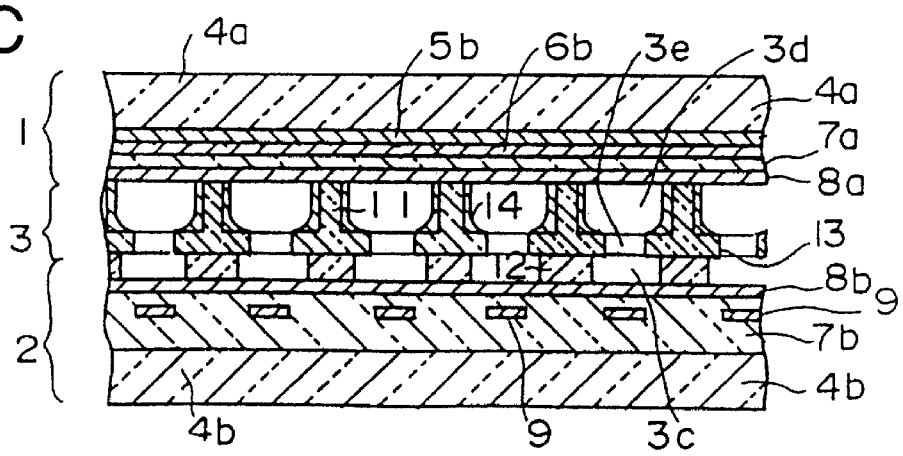
Figure 16A:
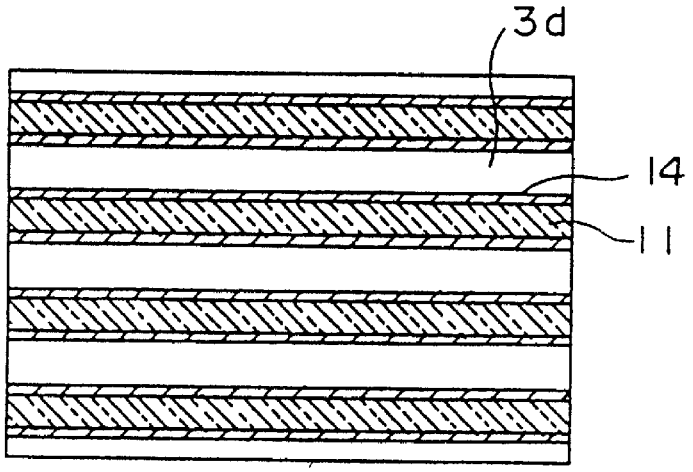
FIGS. 16A and 16B are partially enlarged sectional views showing the structure of a barrier rib of the gas discharge color display panel of the sixth embodiment.
Figure 16B:
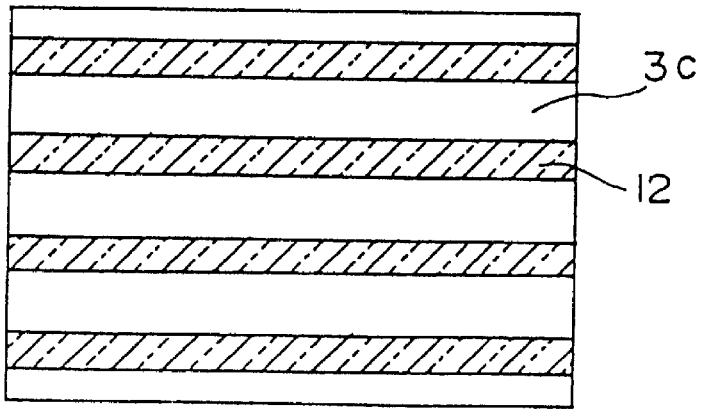

FIGS. 6A–6C, 16A and 16B are sectional views of the display panel manufactured according to the sixth embodiment of the invention. FIG. 6A is a sectional view of the display panel when a part thereof is cut away on a plane parallel with address electrodes 9 and perpendicular to the surfaces of substrates 1 and 2. FIG. 6B is a sectional view taken on line A of FIG. 6A; the cut-away face is a plane perpendicular to the address electrodes 9 (namely, parallel with trigger electrodes 10) and perpendicular to the surfaces of the substrates 1 and 2. FIG. 6C is a sectional view taken on line B of FIG. 6A; the cut-away face is a plane perpendicular to the address electrodes 9 (namely, parallel with the trigger electrodes 10) and perpendicular to the surfaces of the substrates 1 and 2. FIG. 16A is a sectional view of the display panel on a plane taken on line C in FIG. 6A. FIG. 16B is a sectional view of the display panel on a plane taken on line D in FIG. 6A.

On a bulkhead substrate 3 of the display panel of the sixth embodiment, as in the third embodiment, both barrier ribs 11 on the front substrate side and barrier ribs 12 on the rear substrate side are formed like stripes parallel with the address electrodes 9 as shown in FIGS. 16A and 16B. A forming method of barrier rib 3*a* in the sixth embodiment is the same as that in the fourth embodiment except for the form of the glass paste film printed on the MgO film surface on the rear substrate, or the form of the mask 32 of the ceramic plate 30. Like the third embodiment, the sixth embodiment also provides a display panel having good color contrast.

Embodiment 7

Figure 7A:
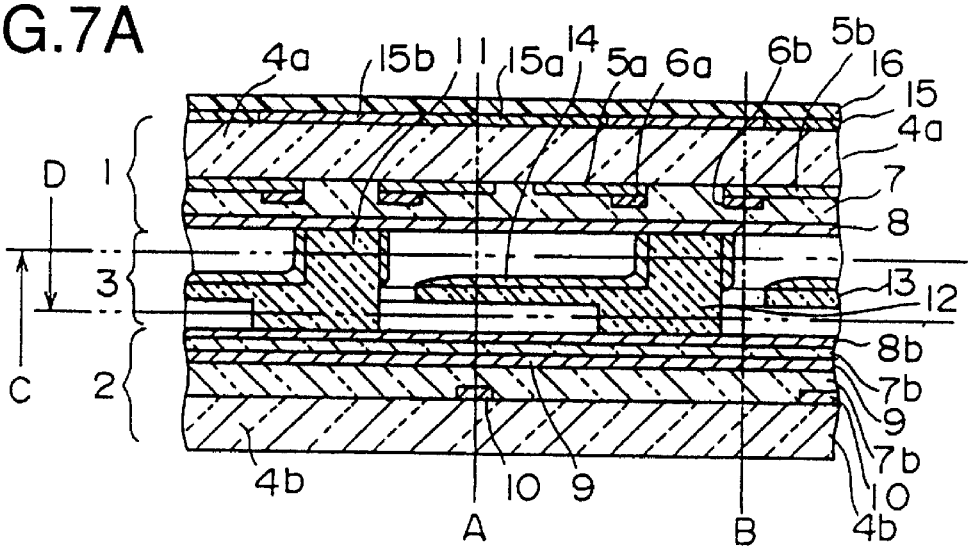
FIGS. 7A–7C are partially enlarged sectional views showing the structure of a gas discharge color display panel of a seventh embodiment.
Figure 7B:
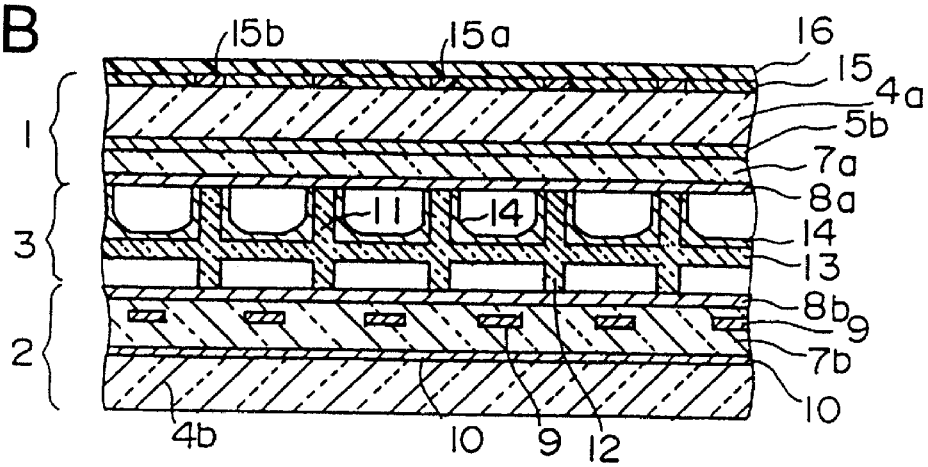
Figure 7C:
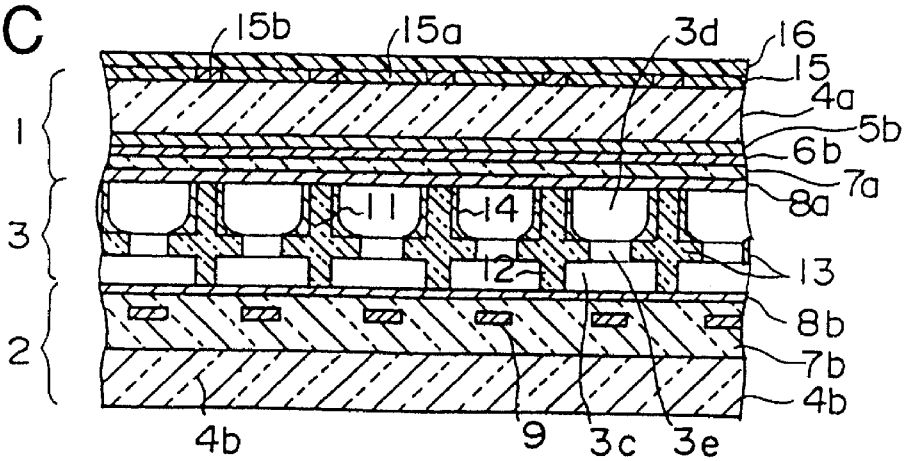

A gas discharge color display panel of a seventh embodiment of the invention has a similar structure to that of the first embodiment, as shown in FIGS. 7A–7C. In addition, it comprises a color filter 15 and a protective film 16 covering the color filter 15 on the front or rear of a glass plate 4*a* of a front substrate 1 where electrodes 5*a* and 5*b* are not formed. The color filter 15 comprises a black matrix 15*b* which is a black lattice-shaped area formed so as to cover bus electrodes 6*a* and 6*b* and a barrier rib 3*a*, and a filter area 15*a* surrounded by the black matrix 15*b* for allowing only light of green, blue, or red to pass through. In the embodiment, the filter area 15*a* is made of a material containing organic pigment.

The first embodiment uses the soda glass plate 4*a* formed with the ITO film 5*c* as a starting material in step (1); instead, the seventh embodiment uses a soda glass plate 4*a* comprising the color filter 15 protected by the protective film 16 on one face of the front and rear and an ITO film 5*c* on the other face. A manufacturing method of the gas discharge display panel in the seventh embodiment is the same as that in the first embodiment except for starting material used in step (1).

Figure 18:
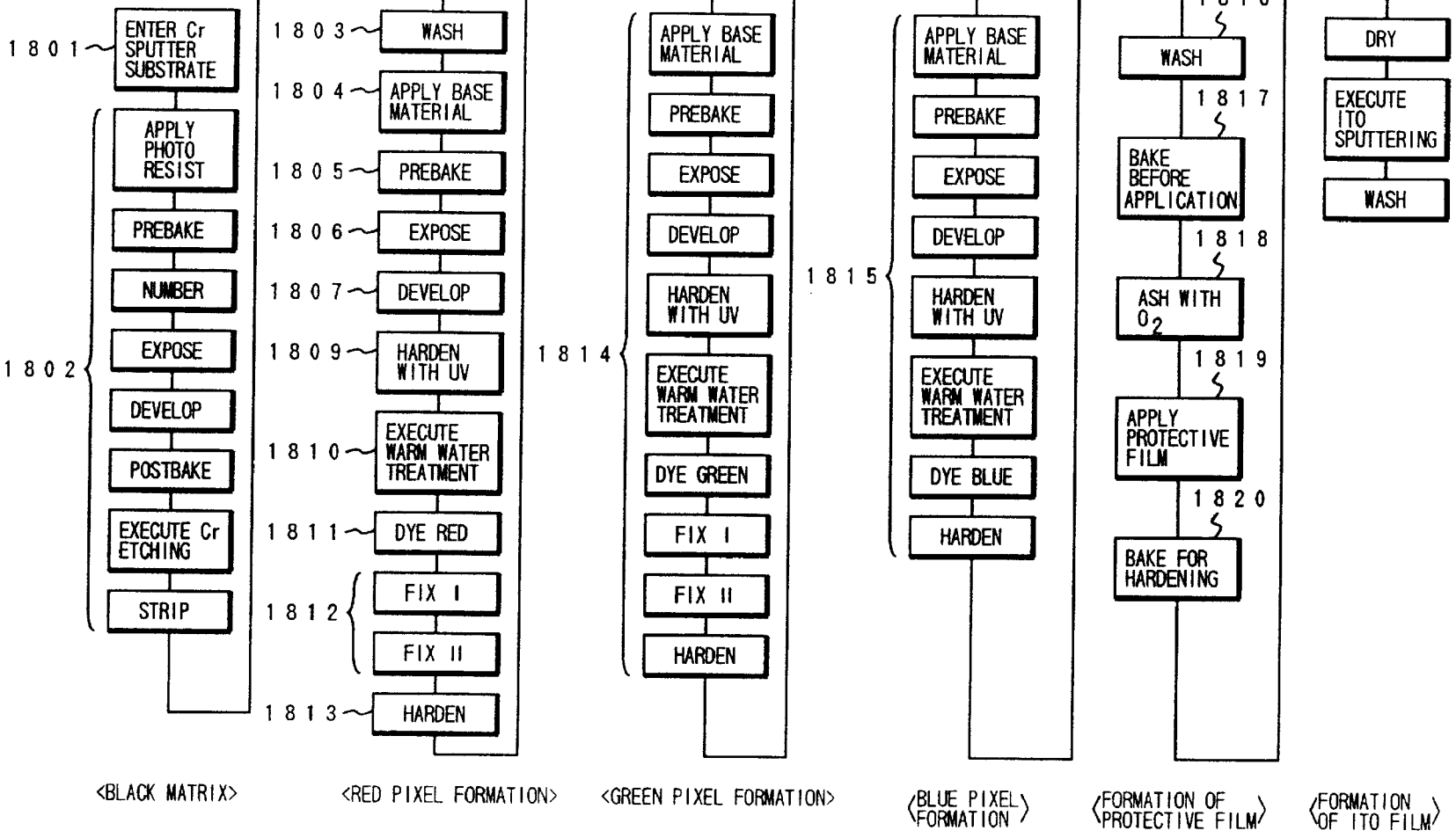
FIG. 18 is an illustration showing a color filter forming process in a seventh embodiment of the invention.

The starting material in step (1) in the seventh embodiment is manufactured as follows: (FIG. 18 shows a manufacturing process.)

First, a soda glass plate 4*a* having a Cr film formed on the surface by sputtering is provided at step 1801 and the Cr film is patterned by a photo lithography method at step 1802, whereby a black matrix 15*b* is formed.

Next, a red filter area 15*a* for red pixels is formed. That is, the glass plate 4*a* formed with the black matrix 15*b* is washed at step 1803, then a photosensitive, dyeable resin precursor composite is applied to the surface at step 1804, and heated and prebaked at step 1805, and only predetermined positions (red pixel formation positions) are exposed at step 1806. Development is then executed at step 1807, namely, ultraviolet rays are applied for hardening the dyeable resin at step 1809, and warm water treatment is carried out at step 1810. The dyeable resin is then dyed with a red azo family dye at step 1811, fixed in a tannic acid, etc., at step 1812, and heated and further hardened at step 1813.

A green filter area 15*a* for green pixels is formed in the steps of 1814, in the same manner as steps 1804–1813, except for the dye used at step 1811. A blue filter area 15*a* for blue pixels is formed at steps 1815 in the same manner as steps 1804–1813 except for the dye used at step 1811 or fixing at step 1812 (fixing is not executed at step 1815). A mixture of phthalocyanine-family and azo-family dyes is used as the dye for forming the green filter area 15*a* and an anthraquinone-family dye is used as the dye for forming the blue filter area 15*a*.

The glass plate 4*a* comprising the color filter 15 provided by executing the steps 1801–1815 is washed at step 1816 and heat-treated at step 1817, and then the surface of the color filter 15 is ashed with an oxygen gas and a hydrolysis-type coating agent consisting essentially of Al, Si, and O (alkoxide) is applied to the ashed surface with a dispenser. It is then heated and hardened at 100°–300° C., forming a protective film 16.

Lastly, an ITO film 5*c* is formed by sputtering on the face of the glass plate 4*a* on which the color filter 15 and the protective film 16 are not formed, and is washed. Manufacturing of the soda glass plate 4*a* comprising the color filter 15 protected by the protective film 16 on one face of the front and rear and the ITO film 5*c* on the other face, a starting material in step (1) in the embodiment, is now complete.

Like the first embodiment, the seventh embodiment also provides a display panel having good color contrast. The gas discharge color display panel of the seventh embodiment, which contains the organic color filter, is capable of excellent display and has better color purity than that of the first embodiment.

Embodiment 8

In an eighth embodiment of the invention, a display panel having a similar structure to that of the display panel in the first embodiment is manufactured. In the eighth embodiment, however, the heating temperature in a display panel manufacturing process is made less than 450° C., which is the distortion point of glass used in the embodiment, by using organometallic gel to form dielectric layers 7*a* and 7*b* and MgO layers 8*a* and 8*b* in order to suppress glass plate distortion. Next, a manufacturing method of the gas discharge color display panel according to the eighth embodiment of the invention will be discussed with reference to FIG. 19.

The following explanation shows only one example of material and size of substrate, condition for manufacturing, and manufacturing device in the present invention. So, the invention is not limited by these terms.

A. Manufacturing of front substrate (8-1) Formation of electrodes for main discharge First, a soda glass plate 4*a* about 85 cm wide, about 70 cm deep, and about 2.8 mm thick, and having an ITO film 5*c* formed on one face of the front and rear is provided and an ITO film is patterned as in step (1) in the first embodiment (FIG. 19 (*a*)).

A photosensitive resin composite is applied to ITO electrodes 5*a* and 5*b* provided by patterning the ITO film and the exposed portion of the glass plate 4*a*. The photosensitive resin composite is exposed via a predetermined pattern mask to an exposure of 200–250 mJ/cm$^2$ with a 3-kW (output 8 kw) extra-high pressure mercury vapor lamp, then spray-developed for 105 seconds under the conditions of development temperature 25 and pressure 1.2 kg/cm$^2$ using a sodium carbonate water solution of 0.2%–0.5%, neutralized with a dilute acid of about 0.1%, washed in water, and dried, thus providing a resist film 191 of a predetermined pattern (FIG. 19 (*b*)).

Next, bus electrodes 6*a* and 6*b* each 0.05 mm wide and 0.003 mm thick are formed by an electroless plating method on the surfaces of the ITO electrodes 5*a* and 5*b* exposed from the resist film 191. The material of the bus electrodes 6*a* and 6*b* may be metal having good conductivity. Here, copper is used. After the plating treatment, the resist film 191 is stripped using a stripping liquid (FIG. 19 (*c*)).

(8-2) Formation of dielectric layer

Figure 19:
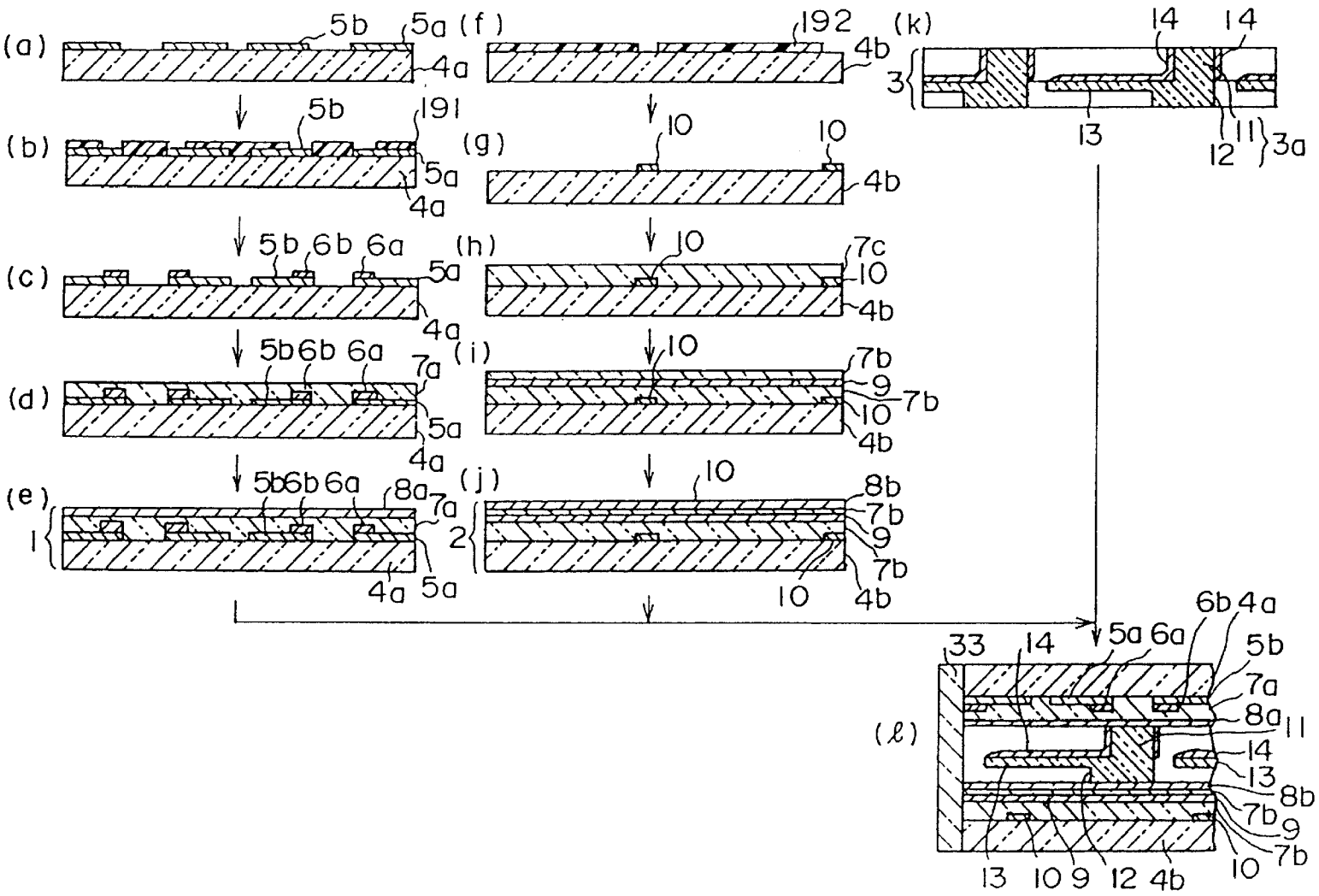
FIG. 19 is an illustration showing a manufacturing method of a gas discharge color display panel of an eighth embodiment.
Figure 20A:
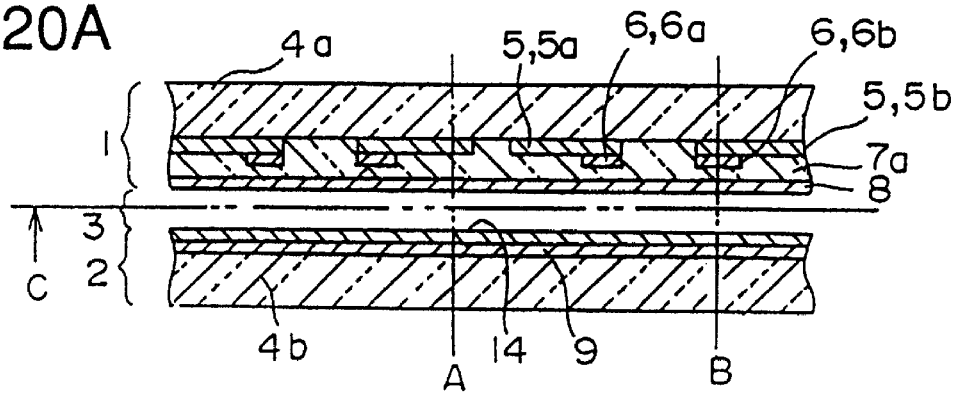
FIGS. 20A–20C are partially enlarged sectional views showing the structure of a gas discharge color display panel in related art.
Figure 20B:
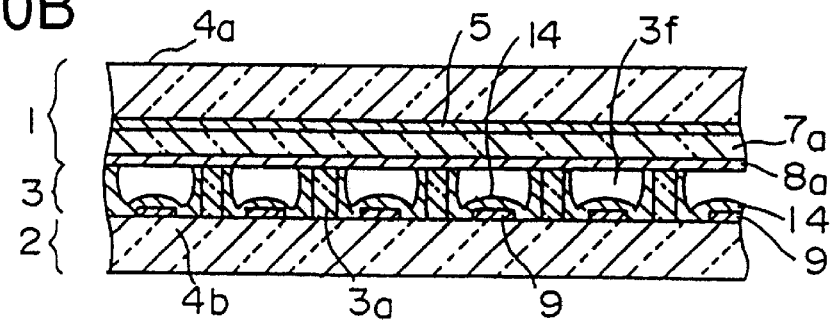
PRIOR ART FIG.20B
Figure 20C:
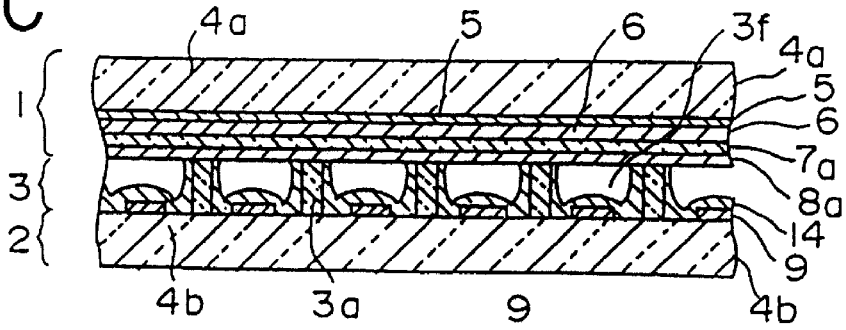
PRIOR ART FIG.20C
Figure 21:
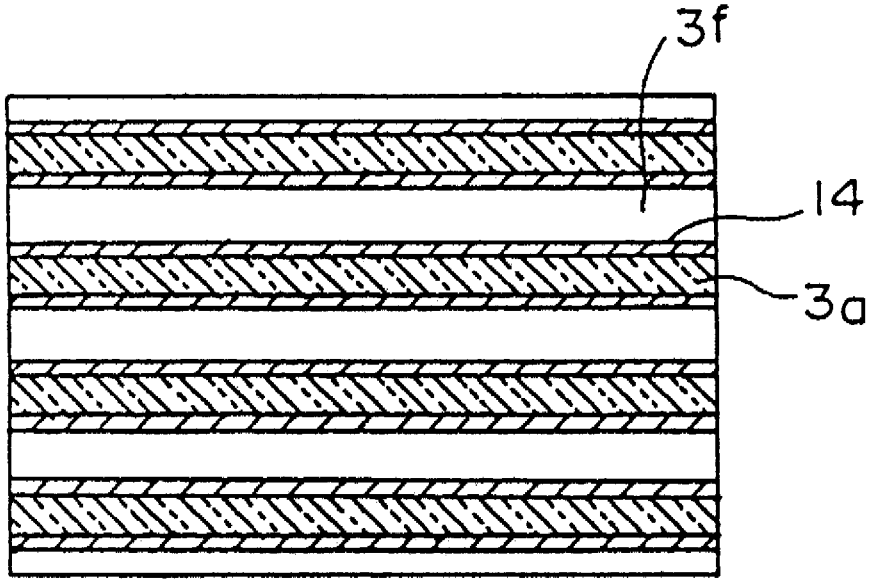
FIG. 21 is a partially enlarged sectional view showing the structure of a barrier rib of the gas discharge color display panel in the related art.
Figure 22:
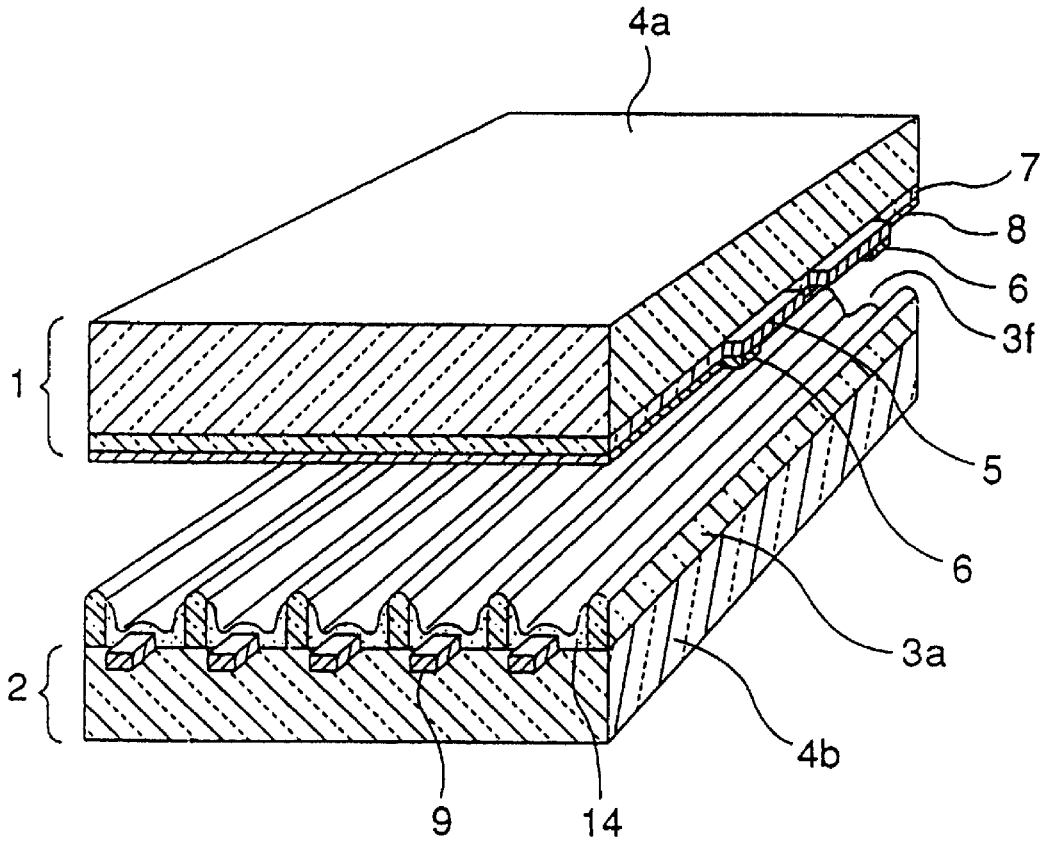
FIG. 22 is a partially perspective view of the gas discharge color display panel in the related art.

A hydrolysis-type coating agent consisting essentially of Al, Si, and O is applied to the surface of the glass plate 4*a* by a blade method so as to cover the electrodes 5*a*, 5*b*, 6*a*, and 6*b* and heat is applied for 5–60 minutes at a temperature of 100°–400° C., thereby forming a dielectric layer 7*a* 0.01–0.03 mm thick (FIG. 19 (*d*)). Upon application of heat for 60 minutes at a temperature of 50°–80° C., water or alcohol gas is detected when a discharged gas analysis in a vacuum is made. Upon application of heat for 15 minutes at a temperature of 420°–500° C., the soda glass plate 4 warps by about 0.15 mm. When heat treatment is executed for 5–60 minutes at a temperature of 100°–400° C. as in the embodiment, there is no discharged gas in the vacuum and the soda glass plate 4 does not warp.

Here, a gel provided by hydrolyzing at room temperature an n-butanol solution containing tri(n-butoxy) aluminum and tetra(n-butyl) silicate at a weight ratio of 37:63 in terms of the oxide is used as the hydrolysis-type coating agent consisting essentially of Al, Si, and O.

(8-3) Formation of protective film

A hydrolysis-type coating agent consisting essentially of Mg and O is applied to the surface of the dielectric layer 7*a* with a spinner, and heat is applied for 5–60 minutes at a temperature of 100°–400° C., as with the formation of the dielectric layer 7*a*, thereby forming an MgO film 8*a* 0.001–0.005 mm thick (FIG. 19 (*e*)). Here, a gel provided by hydrolyzing an n-butanol solution of di(n-butoxy) magnesium at room temperature is used as the hydrolysis-type coating agent consisting essentially of Mg and O. During formation of the dielectric layer 7*a* and the MgO film 8*a*, the coating agent may be applied by a method such as spray, roll, dip, or printing, in addition to use of the spinner.

In the embodiment, the front substrate 1 has been thus prepared without heating to a temperature exceeding the distortion point of the soda glass plate 4*a* (450° C.). The dimensions of the soda glass plate 4*a* do not change even after execution of the manufacturing steps.

B. Manufacturing of rear substrate (8-4) Formation of trigger electrodes

Next, a rear substrate 2 is manufactured. First, a photosensitive resin composite is applied to a soda glass plate 4*b* about 90 cm wide, about 65 cm deep, and about 2.8 mm thick. The photosensitive resin composite film is exposed via a predetermined pattern mask to an exposure of 200–250 mJ/cm$^2$ with a 3-kW (output 8 kw) extra-high pressure mercury vapor lamp and spray-developed for 105 seconds under the conditions of development temperature 25° C. and pressure 1.2 kg/cm$^2$ using a sodium carbonate water solution of 0.2%–0.5%, then neutralized with a dilute acid of about 0.1%, washed in water, and dried, providing a resist film 192 of a predetermined pattern.

Next, trigger electrodes 10 each 0.1 mm wide and 0.005 mm thick are formed by an electroless plating method on the surfaces of the glass plate 4*b* exposed from the resist film 192, and the resist film 192 is stripped using a stripping liquid.

(8-5) Formation of dielectric layer

The same hydrolysis-type coating agent consisting essentially of Al, Si, and O as in step (8-2) is applied to the surface of the glass plate 4*b* by a blade method so as to cover the trigger electrodes 10 and heat is applied for 5–60 minutes at a temperature of 100°–400° C., as with the formation of the dielectric layer 7*a*, forming a part 7*c* of 0.02 mm thick of a dielectric layer 7*b* (FIG. 19 (*h*)).

(8-6) Formation of address electrodes and dielectric layer

Further, address electrodes 9 are formed on the surface of the part of the dielectric layer by a similar method to the formation method of the trigger electrodes 10. A hydrolysis-type coating agent is applied to the surface of the dielectric layer as instep (8-5) so as to cover the address electrodes 9 and heat is applied, forming the reminding 0.01 mm thickness of the dielectric layer 7*b* (FIG. 19 (*i*)).

(8-7) Formation of protective film

Formation of the dielectric layer 7*b* is now complete. Then, an MgO film 8*b* 0.001–0.005 mm thick is formed on the surface of the dielectric layer 7*b* as in step (8-3).

In the embodiment, like the front substrate 1, the rear substrate 2 has been thus prepared without heating to a temperature exceeding the distortion point of the soda glass plate 4 (450° C.). As in the first embodiment, a tip tube (not shown) for exhaust and gas introduction after the panel is assembled is attached to the rear substrate 2.

C. Assembly (8-8) Assembly of substrates 1–3

The front substrate 1 provided in step (8-3), a bulkhead substrate 3 (FIG. 19 (*k*)) manufactured as in the first embodiment, and the rear substrate 2 provided in step (8-7) are aligned and laminated on top of each each other in order. The same hydrolysis-type coating agent consisting essentially of Al, Si, and O as used in step (8-2) is applied to the surroundings of the substrates 1–3 with a dispenser, then hardened by heat treatment at 100°–300° C. for fixing the substrates and sealing gaps among the substrates (FIG. 19 (*l*)). In the embodiment, the glass plates 4*a* and 4*b* are not heated to a temperature exceeding the distortion point, so that the display panel can be assembled accurately with no distortion of the front substrate 1, rear substrate 2, or bulkhead substrate 3.

(8-9) Injection of gas

Further, air between the front substrate 1 and the rear substrate 2 is absorbed via the tip tube located on the rear substrate 2 to produce a vacuum, and then He-5% Xe mixed gas is introduced until the internal pressure reaches 35–70 kPa. Then, the tip tube is heated and tipped off by local heat application, thus manufacturing a gas discharge color display panel similar to that shown in FIGS. 1A–1C. In the embodiment, the adhesion parts are further fixed with resin to improve cohesion of the front substrate 1, rear substrate 2, and bulkhead substrate 3, whereby reliability is improved.

D. Result

Like the first embodiment, the eighth embodiment also provides a display panel having good color contrast. The gas discharge color display panel manufactured in the eighth embodiment has good positional accuracy during assembly because the glass plates 4*a* and 4*b* are not distorted. Therefore, the display panel of the embodiment is highly accurate compared with that of the first embodiment. The eighth embodiment has a similar discharge characteristic to that of the first embodiment.

Figure 17A:
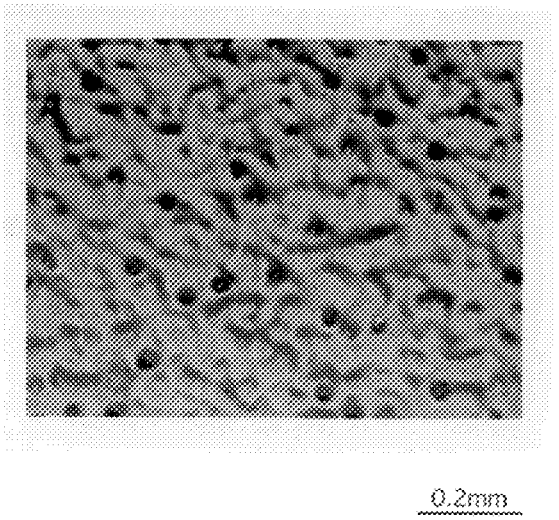
FIGS. 17A and 17B are scanning electron microscope photos of the surfaces of ceramic of dielectric substance.
Figure 17B:
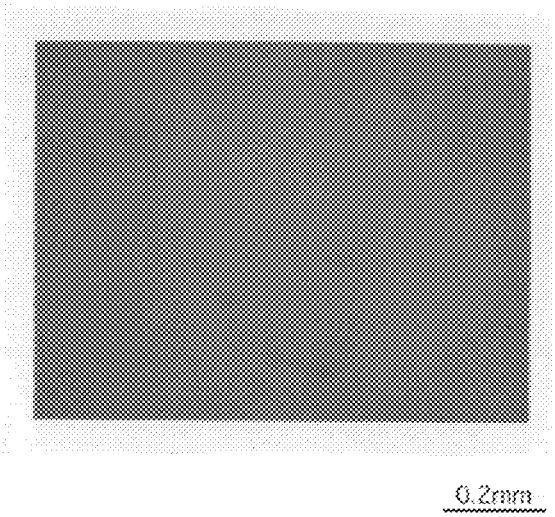

FIG. 17A is a scanning electron microscope photograph of the surface of the dielectric film 7*a* formed using glass paste and FIG. 17B is a scanning electron microscope photo of the surface of the dielectric film 7*a* formed in step (8-2). As can be seen in the photographs, ceramics formed by heating a gel provided by hydrolyzing a metal alkoxide solution provides small and uniform crystal particle diameters of dispersed ceramic particles for producing a smooth surface compared with ceramics formed by heating paste containing fine particles of glass previously sintered. Therefore, formation of dielectric film and/or MgO film using such an alkoxide gel is particularly appropriate for manufacturing a gas discharge color display panel comprising MgO films 8*a* and 8*b* and electrodes 9 formed furthermore on the surfaces of dielectric films 7*a* and 7*b*.

Embodiments 9 and 10

In a ninth embodiment, a display panel having a similar structure to that of the display panel in the second embodiment is manufactured as in the eighth embodiment; a bulkhead substrate 3 is manufactured as in the second embodiment. In a tenth embodiment, a display panel having a similar structure to that of the display panel in the third embodiment is manufactured as in the eighth embodiment; a bulkhead substrate 3 is manufactured as in the third embodiment. The provided display panels are highly accurate, as in the eighth embodiment, and also have good discharge characteristic and color contrast as in the second and third embodiments.

Embodiment 11

Figure 8A:
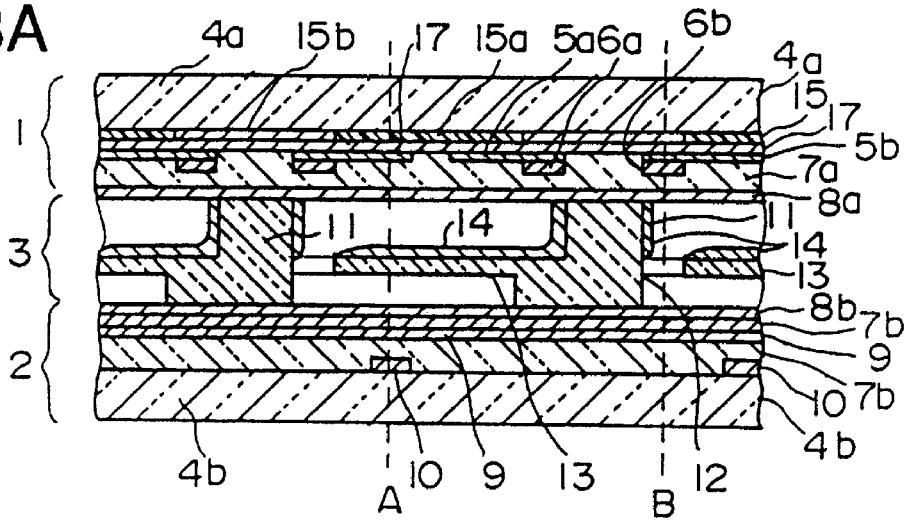
FIGS. 8A–8C are partially enlarged sectional views showing the structure of a gas discharge color display panel of an eleventh embodiment.
Figure 8B:
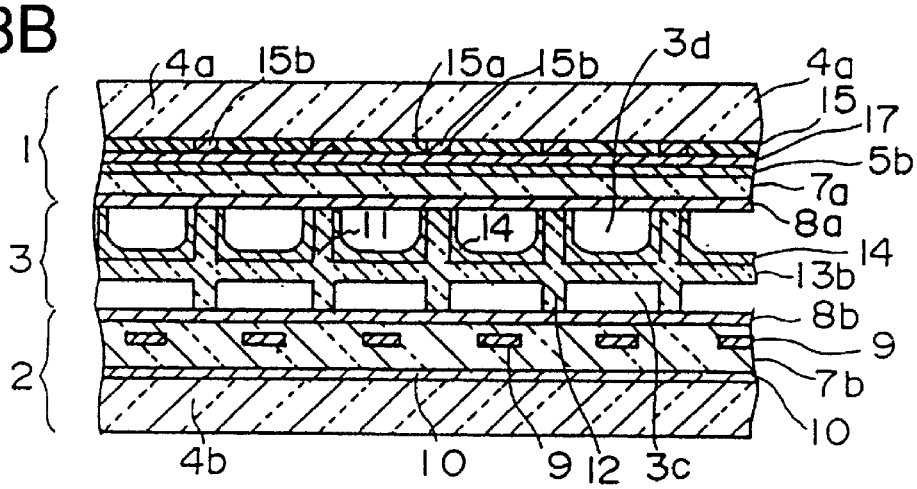
Figure 8C:
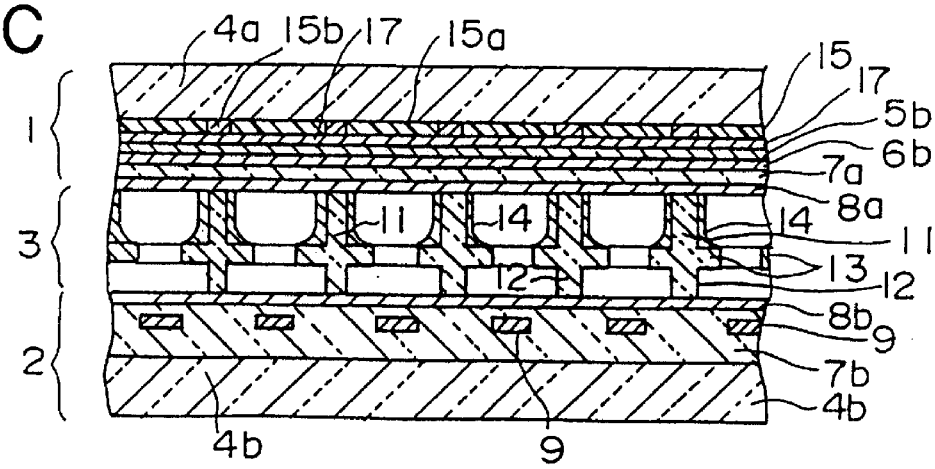

In an eleventh embodiment of the invention, a display panel having the same structure as the display panel of the first embodiment, except that it comprises a color filter 15 and an insulating film 17 between a glass plate 4*a* and ITO electrodes 5*a* and 5*b* on a front substrate 1, is manufactured, as shown in FIG. 8A–8C. The color filter 15 is the same as formed in the seventh embodiment. The insulating film 17, which is made of transparent inorganic material, protects the color filter 15 when an ITO film 5*c* is formed and provides electrical insulation between ITO electrodes 5*a* and 5*b* and a black matrix 15*b* made of Cr.

In the eleventh embodiment, the display panel is manufactured as in the eighth embodiment. The eighth embodiment uses the soda glass plate 4*a* formed with the ITO film 5*c* as the starting material in step (8-1). Instead of this, the eleventh embodiment uses the soda glass plate 4*a* comprising the color filter 15, the insulating film 17, and the ITO film 5*c*, in order, on one face of the front and rear.

The starting material in step (8-1) in the embodiment is manufactured as follows: First, the black matrix made of Cr and a red, green, and blue filter area 15*a* are formed on the surface of the soda glass plate 4*a* as in steps 1801–1815 in the seventh embodiment. Next, a hydrolysis-type coating agent consisting essentially of Al, Si, and O as used in step (8-2) is applied to the surface of the resulting color filter 15 with a spinner and heat is applied for 5–60 minutes at a temperature of 100°–400° C., forming the transparent insulating inorganic film 17 0.01–0.02 mm thick. Lastly, the ITO film 5*c* is formed on the surface of the insulating film 17 by sputtering, providing the glass plate 4*a* comprising the color filter 15, the insulating film 17, and the ITO film 5*c*, being the starting material in step (8-1).

Like the eighth embodiment, the eleventh embodiment also provides a display panel having good color contrast. The gas discharge color display panel of the eleventh embodiment, which contains the organic color filter, is capable of excellent display which has better color purity than that of the eighth embodiment.

The display panel of the eleventh embodiment, which has the color filter 15 formed near the discharge space 3*d*, provides a wider viewing angle than the display panel of the seventh embodiment.

Embodiment 12

In a twelfth embodiment of the invention, a display panel having a similar structure to that of the display panel in the fourth embodiment is manufactured. In the twelfth embodiment, however, the heating temperature in a display panel manufacturing process is made less than 450° C., the distortion point of glass used in the embodiment by using metal alkoxide to form dielectric layers 7*a* and 7*b* and MgO layers 8*a* and 8*b*, in order to suppress glass plate distortion.

The manufacturing method of the display panel according to the embodiment is the same as that according to the eighth embodiment except that a predetermined pattern is printed on the surface of an MgO film 8*b* on a rear substrate 2 manufactured as in the eighth embodiment, using a mixture formed by adding alumina spherical particles and potassium titanate fiber to a gel provided by hydrolyzing, at room temperature, an n-butanol solution containing tri(n-butoxy) aluminum and tetra(n-butyl) silicate at a weight ratio of 37:63 in terms of oxide, and heat is applied for 5–60 minutes at a temperature of 100°–400° C., forming a barrier rib 12 0.1 mm thick on the rear substrate side. In the eighth embodiment a bulkhead substrate 3 is manufactured as in the first embodiment, but in the present embodiment, a bulkhead substrate 3 is manufactured as in the fourth embodiment.

The twelfth embodiment also provides a display panel having good color contrast, like the first embodiment, and good accuracy, like the eighth embodiment.

Embodiments 13 and 14

In a thirteenth embodiment, a display panel having a similar structure to that of the display panel in the fifth embodiment is manufactured as in the twelfth embodiment; a bulkhead substrate 3 is manufactured as in the fifth embodiment. In a fourteenth embodiment, a display panel having a similar structure to that of the display panel in the sixth embodiment is manufactured as in the twelfth embodiment; a bulkhead substrate 3 is manufactured as in the sixth embodiment. The provided display panels are highly accurate as in the eighth embodiment, and also have good discharge characteristics and color contrast as in the second and third embodiments.

Embodiment 15

Figure 23A:
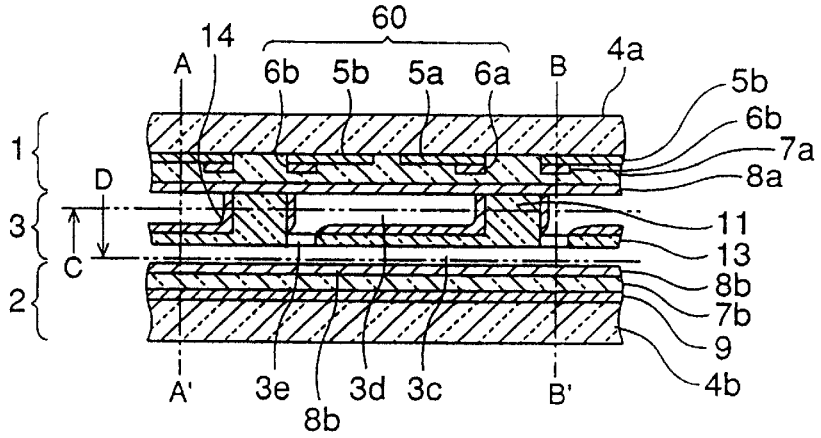
FIGS. 23A–23C are partially enlarged sectional views showing the structure of a gas discharge color display panel of a fifteenth embodiment.
Figure 23B:
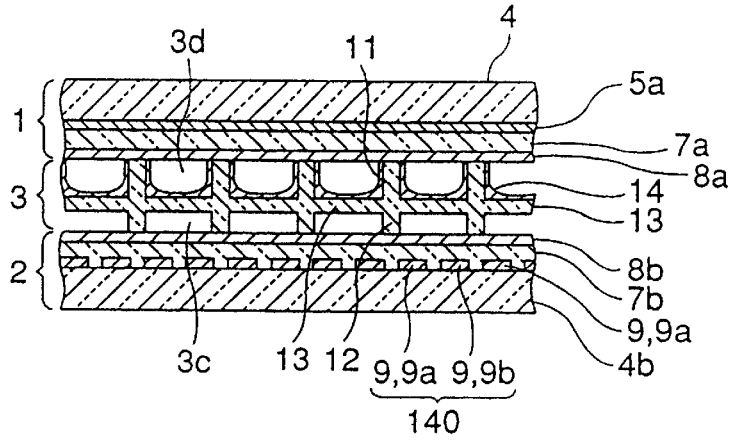
Figure 23C:
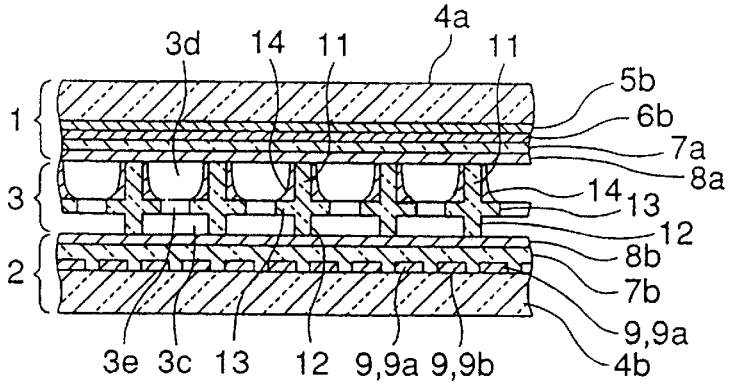

FIGS. 23A–23C, 24A and 24B are sectional views of a display panel manufactured according to a fifteenth embodiment of the invention. FIG. 23A is a sectional view of the display panel when a part thereof is cut away on a plane parallel with address electrodes 9 and perpendicular to the surfaces of substrates 1 and 2. FIG. 23B is a sectional view taken on line A-A' of FIG. 23A; the cut-away face is a plane perpendicular to the address electrodes 9 and the surfaces of the substrates 1 and 2. FIG. 23C is a sectional view taken on line B-B' of FIG. 23A; the cut-away face is a plane perpendicular to the address electrodes 9 and the surfaces of the substrates 1 and 2.

Figure 24A:
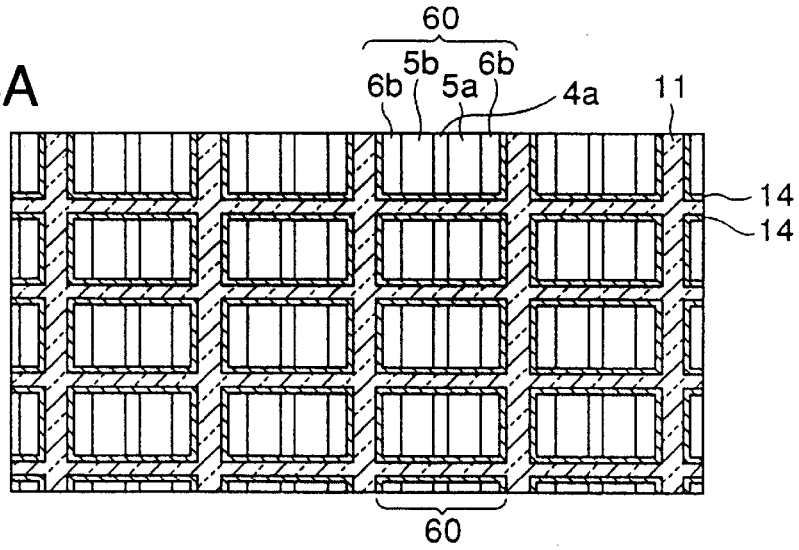
FIGS. 24A and 24B are partially enlarged sectional views showing the placement of a barrier rib and electrodes of the gas discharge color display panel of the fifteenth embodiment.
Figure 24B:
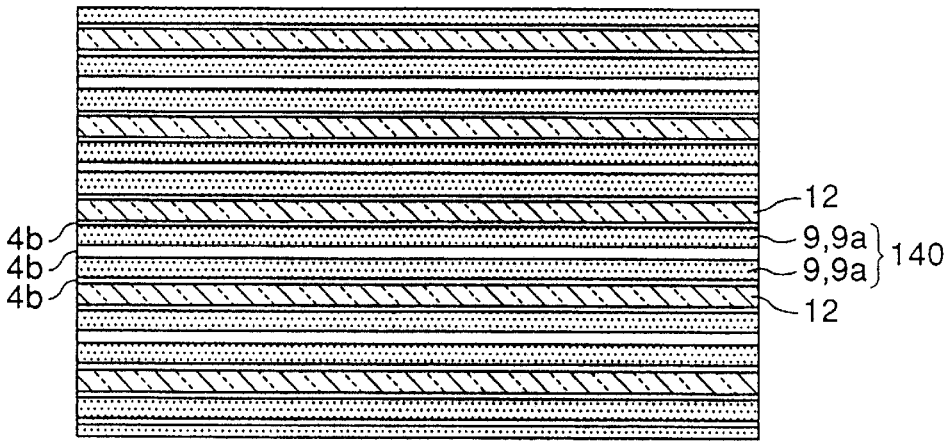

FIG. 24A is a sectional view of the display panel on a plane taken on line C in FIG. 23A. FIG. 24B is a sectional view of the display panel on a plane taken on line D in FIG. 23A. In FIGS. 24A and 24B, protective films 8*a* and 8*b* and dielectric layers 7*a* and 7*b* are not shown and electrodes 5*a*, 5*b*, 6*a*, 6*b*, 9*a*, and 9*b* placed in the depth of the layers 8*a*, 8*b*, 7*a*, and 7*b* and glass plates 4*a* and 4*b* in the depth of the electrodes are shown. The electrodes 9*a* and 9*b* shown in FIG. 24B are not a sectional view, but are hatched for ease of viewing.

Two types of electrodes, separated up and down with the dielectric 7*b* between (address electrode 9 and trigger electrode 10), are formed as auxiliary discharge electrodes in the first to eighth embodiments. In the fifteenth embodiment, however, auxiliary discharge electrode pairs 140 are formed, each consisting of two address electrodes 9 (9*a* and 9*b*) formed on the same plane, and trigger electrodes 1.0 are not formed, as shown in FIG. 23B. In the embodiment, one bus electrode 6*b* of a main discharge electrode pair 60 is formed above a priming path 3*e*, as shown in FIG. 23A.

One example of a manufacturing method of a display panel according to the fifteenth embodiment will be discussed with reference to FIG. 25. Unless otherwise specified, the glass plate size, the film thicknesses of layers, etc., are the same as those in the first embodiment.

A. Manufacturing of front substrate (15-1) Formation of main discharge electrodes First, a transparent conductive film 5*c* such as a stannous tin ($SnO_2$) film or ITO film is formed using a sputtering method or an electron beam evaporation method on a front substrate glass plate 4*a* made of soda glass washed with a neutral detergent, etc., (FIG. 25 (*a*)). Next, the transparent conductive film 5*c* is processed by a known photoetching method to form an electrode pattern of transparent electrodes 5*a* and 5*b* (FIG. 25 (*b*)). The transparent electrode pattern dimensions may be determined conforming to the dimensions of discharge cells to be manufactured.

Next, a Cr/Cu/Cr laminated film comprising a copper film sandwiched between chrome films is formed using the sputtering method or electron beam evaporation method on the whole surface of the glass plate 4*a* on which the transparent electrodes 5*a* and 5*b* are formed. The Cr/Cu/Cr laminated film is processed by the known photoetching method for forming a Cr/Cu/Cr pattern on the surfaces of the transparent electrodes 5*a* and 5*b*, thus providing bus electrodes 6*a* and 6*b* (FIG. 25 (*c*)). The film thickness of the Cu film and the bus electrode pattern dimensions may be determined by the resistance value required for the bus electrodes 6*a* and 6*b*.

(15-2) Formation of dielectric layer and protective film

Figure 25:
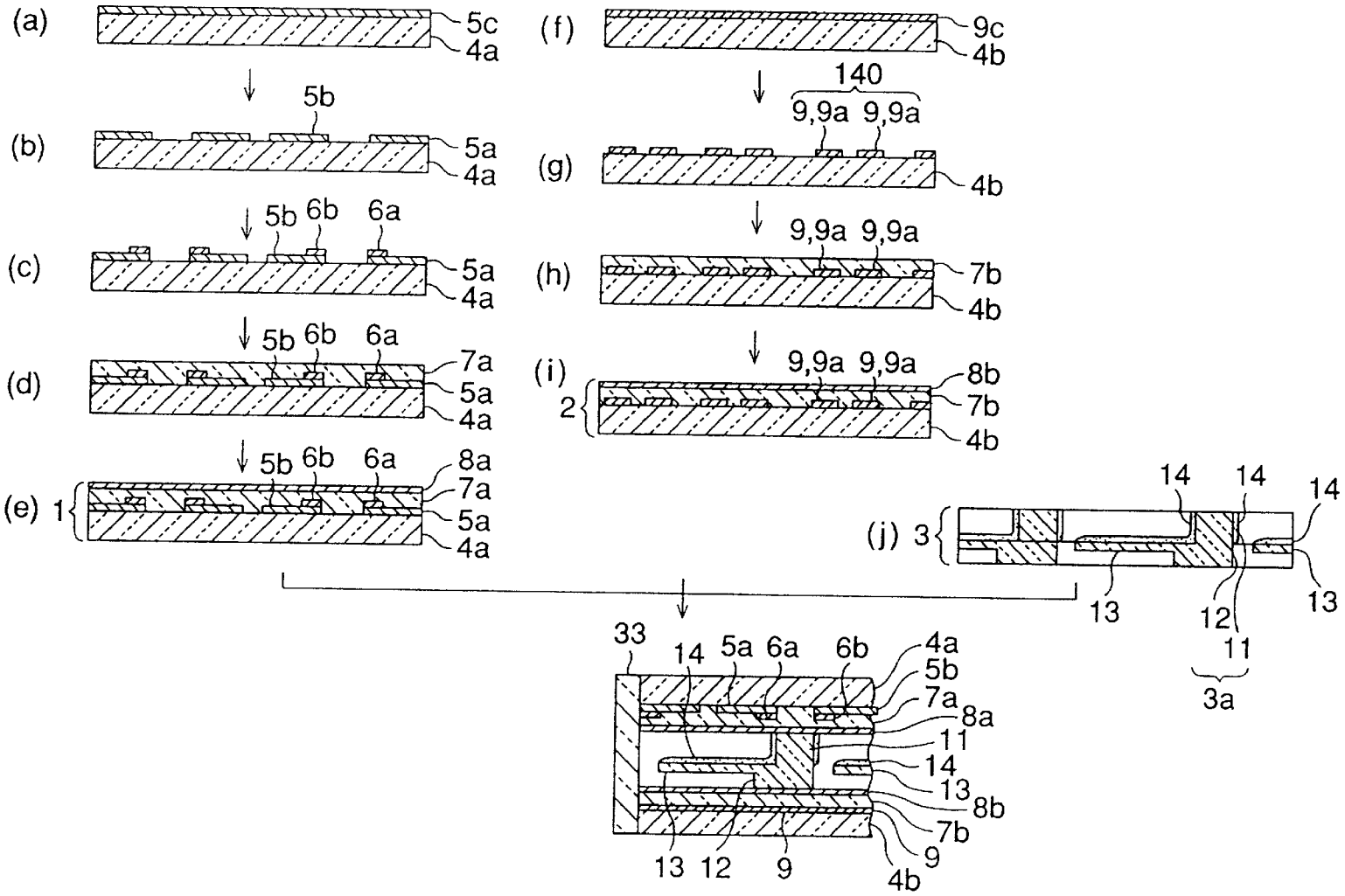
FIG. 25 is an illustration showing a manufacturing method of the gas discharge color display panel of the fifteenth embodiment.

A hydrolysis-type coating agent (organometallic gel) consisting essentially of aluminum, silicon, and oxygen as used in the eighth embodiment, is applied to the surface of the glass plate 4*a* using a blade method or spray method so as to cover the electrodes 5*a*, 5*b*, 6*a*, and 6*b* and heat is applied for 1–60 minutes at a temperature of 100°–400° C., thereby forming a dielectric layer 7*a* of 0.001–0.03 mm thick (FIG. 25 (*d*)). Further, a protective film 8*a* made of MgO is formed on the surface of the dielectric layer 7*a* using the sputtering method or electron beam evaporation method, thereby providing the front substrate 1 (FIG. 25 (*e*)).

B. Manufacturing of rear substrate (15-3) Formation of auxiliary discharge electrodes Next, a manufacturing method of a rear substrate 2 will be discussed. First, a Cr/Cu/Cr laminated film 9*c* comprising a Cu film sandwiched between Cr films is formed using the sputtering method or electron beam evaporation method on a rear substrate glass plate 4*b* made of soda glass washed with a neutral detergent, etc., (FIG. 25 (*f*)). The laminated film 9*c* is processed by the known photoetching method for forming an electrode pattern of auxiliary discharge electrodes 9 (FIG. 25 (*g*)). The film thickness of the Cu film and the auxiliary discharge electrode pattern dimensions may be determined by the resistance value required for the auxiliary discharge electrodes 9.

(15-4) Formation of dielectric layer and protective film

The same hydrolysis-type coating agent as used in the step (15-2) is applied to the surface of the glass plate 4*b* by the blade method or spray method so as to cover the auxiliary discharge electrodes 9, and heat is applied for 1-60 minutes at a temperature of 100°–400° C., thereby forming a dielectric layer 7*b* of 0.001–0.03 mm thick (FIG. 25 (*h*)). Further, a protective film 8*b* made of MgO is formed on the surface of the dielectric layer 7*b* by the sputtering method or electron beam evaporation method (FIG. 25 (*i*)), thereby providing the rear substrate 2. A tip tube (not shown), for exhaust and gas introduction after the panel is assembled, is attached to the rear substrate 2.

C. Assembly (15-5) Assembly of substrates 1–3 and injection of gas

As in steps (8-8) and (8-9) in the eighth embodiment, the front substrate 1 provided in step (15-2), a bulkhead substrate 3 (FIG. 25 (*i*)) manufactured as in the first embodiment, and the rear substrate 2 provided in step (15-3) are assembled and sealed. The inside is depressurized, gas is injected, and the tip tube is tipped off (FIG. 25 (*k*)). A Ne gas containing Xe of 3 volume % is used as the discharge gas injected in the embodiment.

D. Result

The gas discharge display panel has been provided by executing the above steps. Since the gas discharge display panel of the embodiment can be manufactured in a low-temperature process at 400° C. or less as in the eighth embodiment, glass such as inexpensive soda glass can be used as the substrate material although it has a low distortion point. However, if material having a high distortion point is used as the substrate material, the manufacturing process temperature may be set to 400° C. or more. Even if the manufacturing process temperature is set to 400° C. or more, the gas discharge display panel of the embodiment can be manufactured.

Also in the gas discharge display panel provided according to the embodiment, a barrier rib 11 comes in contact with the discharge space side of the front substrate 1 and barrier ribs 12 come in contact with the discharge space side of the rear substrate 2, whereby their discharge spaces are partitioned into discharge cells, each of which is separated by a bulkhead substrate 3. The discharge cells are formed like a matrix having two orthogonal axes by the lattice-shaped barrier rib 11. One axis of the matrix is along the auxiliary discharge electrodes 9 and the other is along the main discharge electrodes 60.

Each discharge cell is separated into a main discharge space 3*d* and an auxiliary discharge space 3*c* by a bulkhead 13 having a priming path 3*e* located between the front substrate 1 and the rear substrate 2. A fluorescent layer 14 is formed on the main discharge space side of the bulkhead 13 and the side face of the barrier rib 11. Light emission of the fluorescent layer 14 leads to display with each discharge cell. The main discharge space 3*d* of each discharge cell is surrounded by the barrier rib 11 and the bulkhead 13. In contrast, the auxiliary discharge spaces 3*c* are formed like stripes by the barrier ribs 12 parallel with the auxiliary discharge electrodes 9 as shown in FIG. 24B. That is, the auxiliary discharge spaces 3*c* of the discharge cells in a discharge cell row along the auxiliary discharge electrodes 9 are continuous, forming one space as a whole.

The front substrate 1 is formed with one of the main discharge electrode pairs 60 for each discharge cell. Each main discharge electrode pair 60 consists of a transparent electrode 5*a* and a bus electrode 6*a*, and a transparent electrode 5*b* and bus electrode 6*b* opposite to the electrodes 5*a* and 6*a*. The main discharge electrodes 5*a*, 5*b*, 6*a*, and 6*b* are strip electrodes provided for each discharge cell row along the main discharge electrodes, perpendicularly to the plane containing the address electrodes 9, perpendicular to the panel surface (namely, perpendicular to the glass plate 4*b* from the glass plate 4*a*).

The auxiliary discharge electrodes 9 disposed on the rear substrate 2 are strip electrodes; two electrodes 9 parallel with each other (9*a* and 9*b*) form an auxiliary discharge electrode pair 140, which is provided for each discharge cell row along the auxiliary discharge electrodes 9.

In the embodiment, as seen in FIGS. 23B, 23C and 24B, the auxiliary discharge electrode pair 140 and the barrier rib 12 do not overlap when viewed perpendicularly from the panel surface.

However, unless a short circuit with the auxiliary discharge electrode 9 corresponding to the adjacent discharge cell is made, a part of the auxiliary discharge electrodes 9 and a part of the barrier rib 12 may overlap, because the auxiliary discharge spaces 3*c* of the discharge cells are separated by the barrier ribs 12 parallel with each other substantially orthogonal to the electrodes on the front substrate 1.

To cause one discharge cell to emit light in the display panel of the embodiment, an alternating voltage is first applied to the auxiliary discharge electrode pair 140 passing below the discharge cell to emit light, to cause auxiliary discharge to occur. Since the effect of the auxiliary discharge on the phosphor 14 is blocked by the bulkhead 13, the phosphor 14 does not emit light. On the other hand, an alternating voltage lower than the discharge starting voltage is applied to the main discharge electrode pair 60 passing just above the discharge cell. In this state, a voltage is applied between one electrode of the main discharge electrode pair 60 on the front substrate 1 passing just above the discharge cell and one auxiliary discharge electrode 9 of the auxiliary discharge electrode pair 140 passing just below the discharge cell, whereby charged particles, etc., generated by the auxiliary discharge spread out into the main discharge space 3*d* through the priming path 3*e*. Then, a barrier charge pattern is formed on the surface of the MgO layer 8*a* via the dielectric layer 7*a* covering the main discharge electrode pair 60, and a barrier charge voltage is superposed on the applied voltage, causing main discharge to occur. That is, the main discharge occurs at the predetermined discharge cell. The main discharge causes Ne gas containing 3% Xe to be excited, generating ultraviolet rays, which cause the phosphor 14 to emit light to the outside via the transparent part of the front substrate 1.

As described above, an alternating voltage is applied to the auxiliary discharge electrode pair passing below the specified discharge cell for causing auxiliary discharge to occur, a voltage is applied between one electrode of the main discharge electrode pair on the front substrate 1 passing above the specified discharge cell and one electrode of the auxiliary discharge electrode pair for specifying the discharge cell, and an alternating voltage is applied to the main discharge electrode pair passing above the specified discharge cell, thereby causing the predetermined discharge cell to emit light.

The phosphor 14, which is provided only on the outer walls of the main discharge space 3*d*, hardly emits light when auxiliary discharge occurs. Light emission caused by gas discharge of auxiliary discharge is shielded by the bulkhead 13. This means that, the embodiment can provide sufficiently high contrast because only light emission caused by main discharge is observed from the side of the front substrate 1.

If the priming path 3*e* is large, it is feared that light caused by gas discharge of auxiliary discharge will be radiated to the outside through the front substrate 1, lowering contrast. In this case, it is effective that bus electrodes 6*a* and 6*b*, made of an opaque material, and the priming path 3*e* are placed so as to overlap each other for the electrodes 6*a* and 6*b* to block light caused by gas discharge of auxiliary discharge, passed through the front substrate 1.

In the conventional gas discharge display panels, voltage is applied between front and rear substrates for main discharge and address discharge or auxiliary discharge. In contrast, in the gas discharge display panel of the embodiment, a voltage is applied between the transparent electrodes formed on the front substrate to cause main discharge to occur, and a voltage is applied between the auxiliary discharge electrodes formed on the rear substrate to cause auxiliary discharge to occur. This structure can shorten the distance between the transparent electrodes and the distance between the auxiliary discharge electrodes, thus a voltage applied for causing main or auxiliary discharge to occur can be lowered. That is, according to the embodiment, since the electrodes located close together on the same substrate are used to cause auxiliary or main discharge to occur, voltages applied for causing auxiliary discharge and main discharge to occur can be lowered, and further the bulkhead is provided to prevent auxiliary discharge from causing light emission, thereby producing the effect of heightening display screen contrast. Therefore, the gas discharge display panel of the embodiment accomplishes high display screen contrast and low drive voltage.

Unlike the first to fourteenth embodiment, the fifteenth embodiment uses two auxiliary discharge electrodes 9 on the same plane as the electrodes for causing auxiliary discharge to occur. Thus, the voltage applied for auxiliary discharge in the embodiment can be made lower than that in the first embodiment.

Embodiment 16

In a sixteenth embodiment of the invention, a gas discharge display panel is manufactured as in the fifteenth embodiment; a bulkhead substrate 3 is manufactured as in the third embodiment.

Figure 26A:
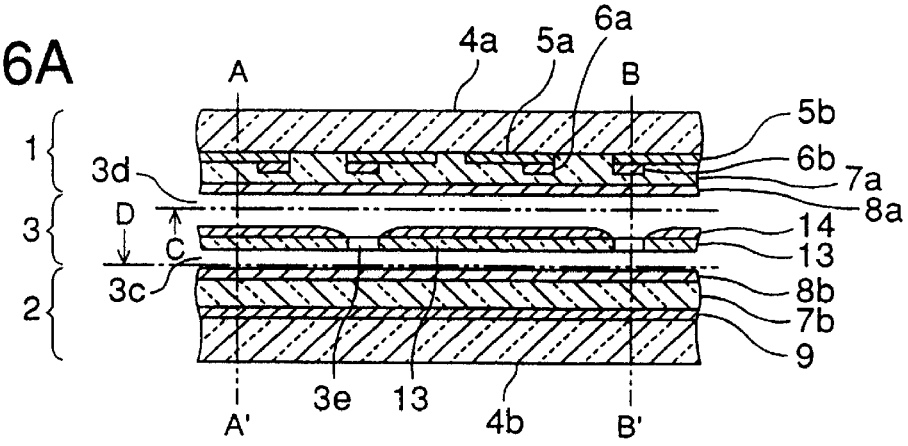
FIGS. 26A–26C are partially enlarged sectional views showing the structure of a gas discharge color display panel of a sixteenth embodiment.
Figure 26B:
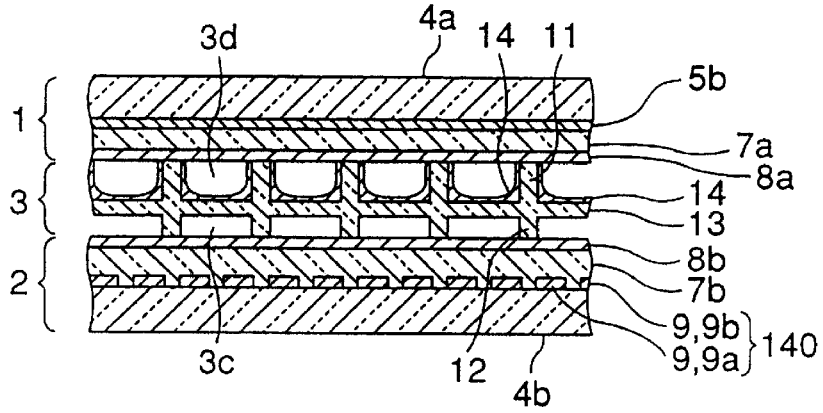
Figure 26C:
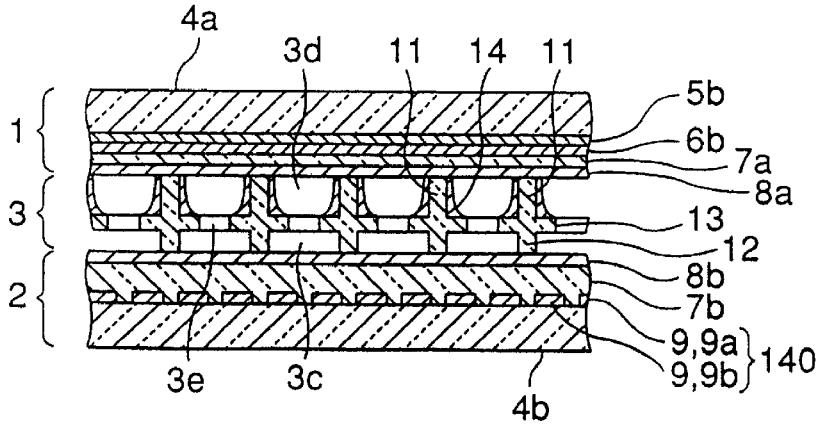

FIGS. 26A–26C, 27A and 27B are sectional views of the gas discharge display panel manufactured in the sixteenth embodiment of the invention. FIG. 26A is a sectional view of the display panel when a part thereof is cut away on a plane parallel with address electrodes 9 and perpendicular to the surfaces of substrates 1 and 2. FIG. 26B is a sectional view taken on line A-A' of FIG. 26A; the cut-away face is a plane perpendicular to the address electrodes 9 and the surfaces of the substrates 1 and 2. FIG. 26C is a sectional view taken on line B-B' of FIG. 26A; the cut-away face is a plane perpendicular to the address electrodes 9 and the surfaces of the substrates 1 and 2.

Figure 27A:
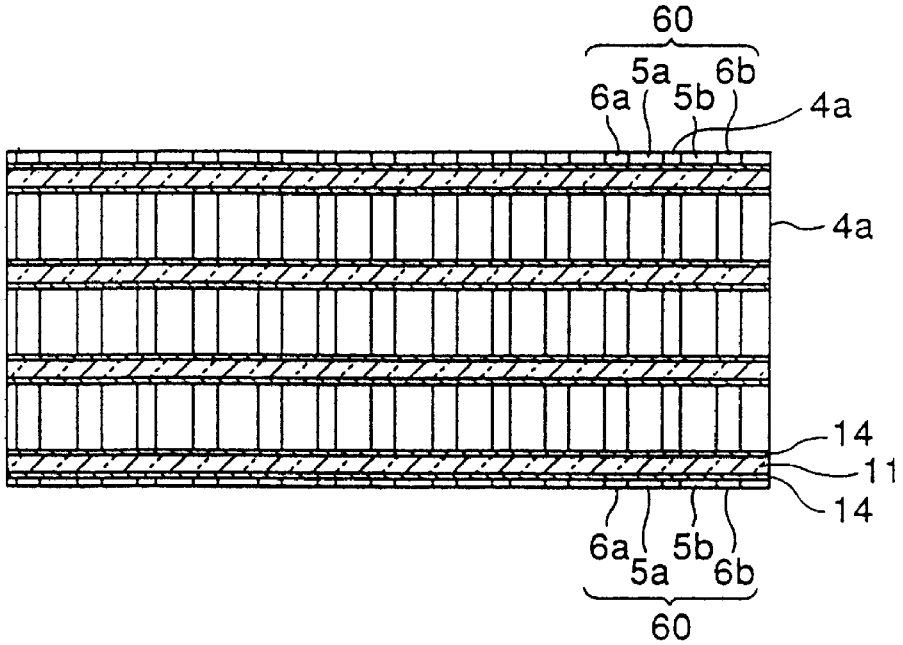
FIGS. 27A and 27B are partially enlarged sectional views showing the placement of a barrier rib and electrodes of the gas discharge color display panel of the sixteenth embodiment.
Figure 27B:
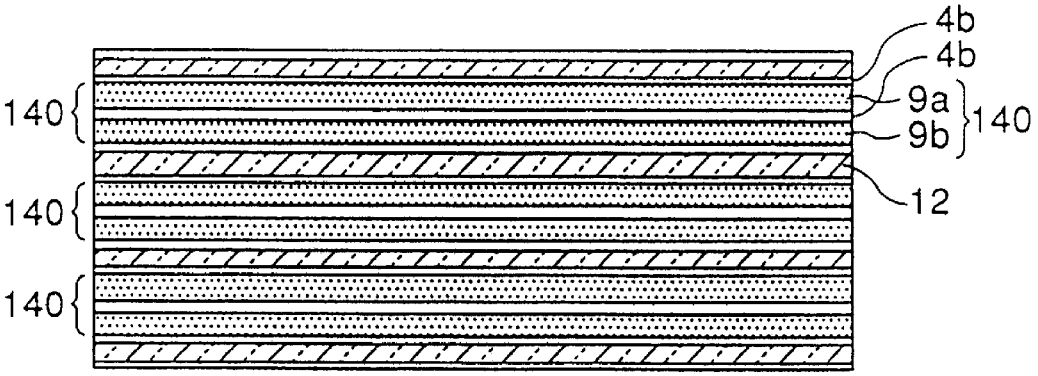

FIG. 27A is a sectional view of the display panel on a plane taken on line C in FIG. 26A. FIG. 27B is a sectional view of the display panel on a plane taken on line D in FIG. 26A. In FIGS. 27A and 27B, protective films 8*a* and 8*b* and dielectric layers 7*a* and 7*b* are not shown and electrodes 5*a*, 5*b*, 6*a*, 6*b*, 9*a*, and 9*b* placed in the depth of the layers 8*a*, 8*b*, 7*a*, and 7*b* and glass plates 4*a* and 4*b* in the depth of the electrodes are shown. The electrodes 9*a* and 9*b* shown in FIG. 27B are not in a sectional view, but are hatched for ease of viewing.

The only display panel structure difference between the fifteenth and sixteenth embodiments is that the barrier rib 11 is shaped like a lattice in the fifteenth embodiment, whereas like the barrier ribs 12, barrier ribs 11 are formed like stripes along the address electrodes 9 in the sixteenth embodiment.

Since a main discharge space 3*d* can be made large and the application area of a phosphor 14 to a plane can be increased, the sixteenth embodiment produces the effects of increasing the brightness and facilitating vacuum exhaust and gas injection after assembly of the gas discharge display panel in addition to the effects of the fifteenth embodiment.

Embodiment 17

In a seventeenth embodiment of invention, a gas discharge display panel is manufactured as in the fifteenth embodiment. However, in manufacturing a bulkhead substrate 3 in the seventeenth embodiment, barrier ribs 11 on the front substrate side are formed like stripes and a barrier rib 12 on the rear substrate side is shaped like a lattice.

Figure 28A:
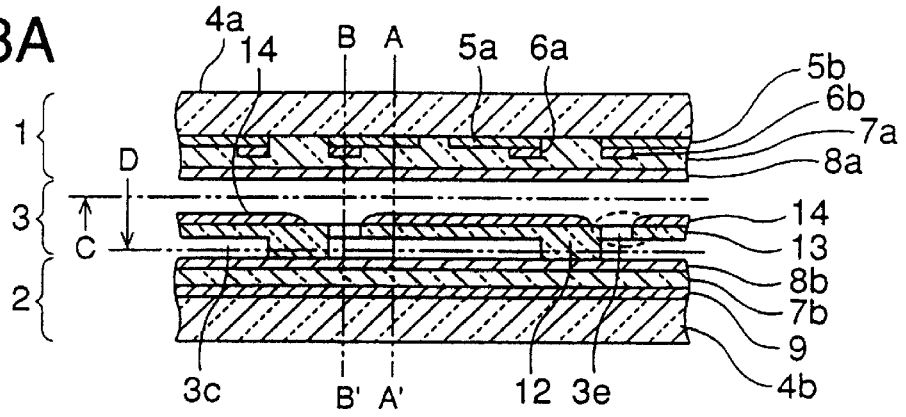
FIGS. 28A–28C are partially enlarged sectional views showing the structure of a gas discharge color display panel of a seventeenth embodiment.
Figure 28B:
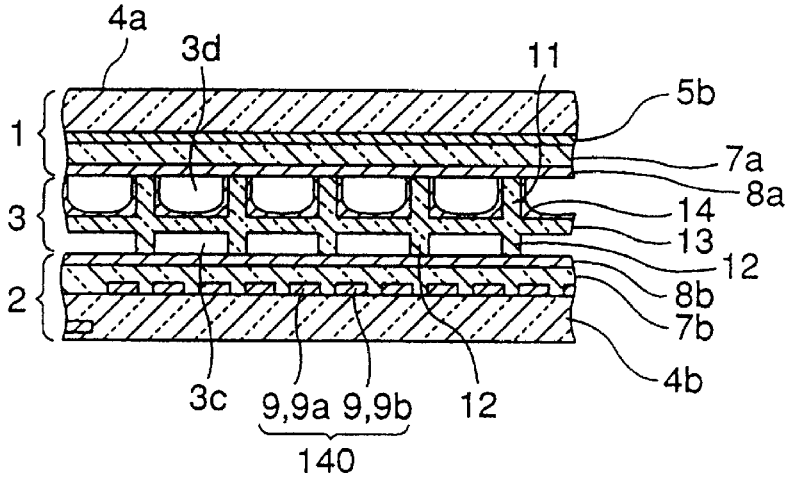
Figure 28C:
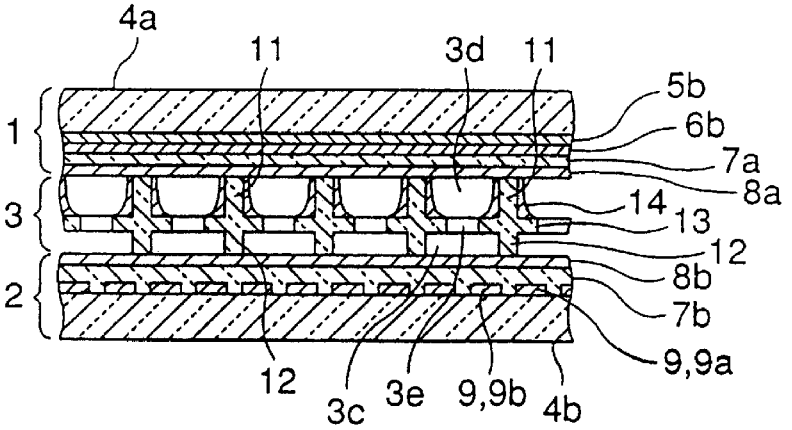

FIGS. 28A–28C, 29A and 29B are sectional views of the gas discharge display panel manufactured in the seventeenth embodiment of the invention. FIG. 28A is a sectional view of the display panel when a part thereof is cut away on a plane parallel with address electrodes 9 and perpendicular to the surfaces of substrates 1 and 2. FIG. 28B is a sectional view taken on line A-A' of FIG. 28A; the cut-away face is a plane perpendicular to the address electrodes 9 and the surfaces of the substrates 1 and 2. FIG. 28C is a sectional view taken on line B-B' of FIG. 28A; the cut-away face is a plane perpendicular to the address electrodes 9 and the surfaces of the substrates 1 and 2.

Figure 29A:
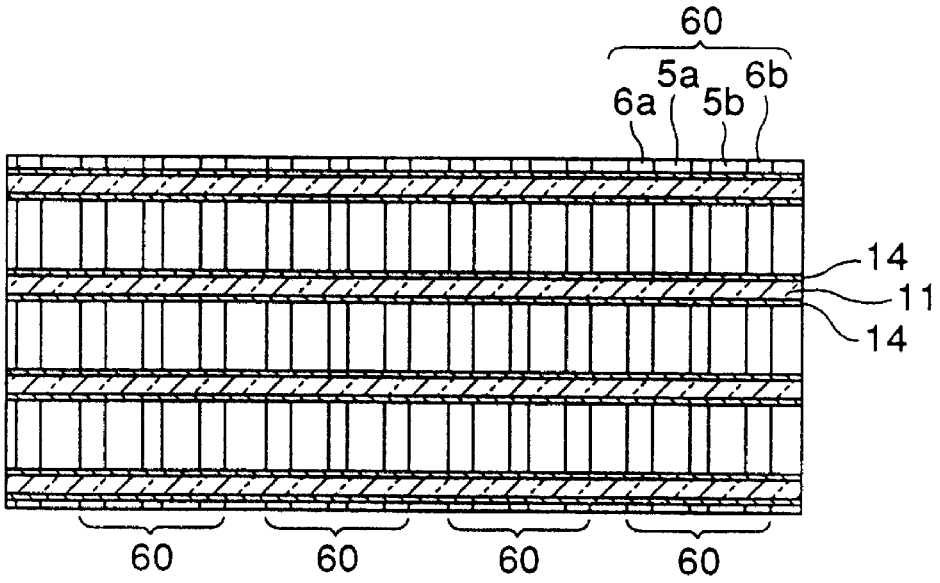
FIGS. 29A and 29B are partially enlarged sectional views showing the placement of a barrier rib and electrodes of the gas discharge color display panel of the seventeenth embodiment.
Figure 29B:
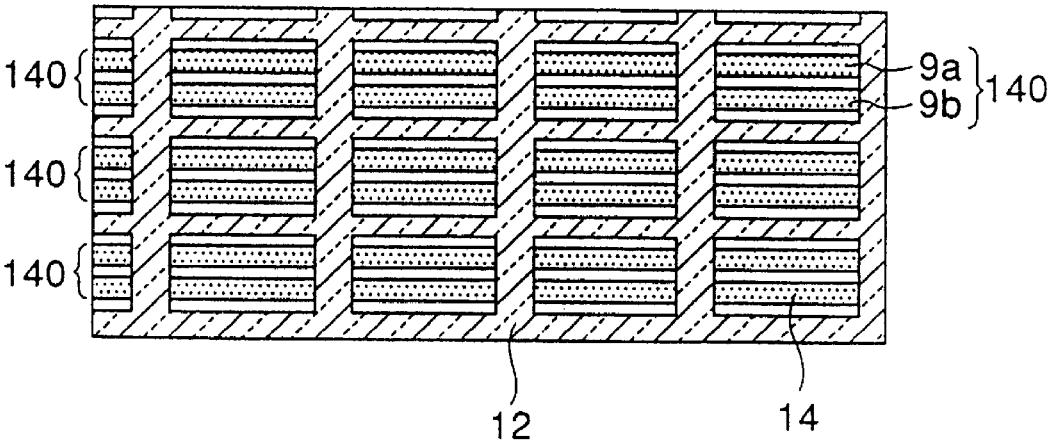

FIG. 29A is a sectional view of the display panel on a plane taken on line C in FIG. 28A. FIG. 29B is a sectional view of the display panel on a plane taken on line D in FIG. 28A. In FIGS. 29A and 29B, protective films 8*a* and 8*b* and dielectric layers 7*a* and 7*b* are not shown and electrodes 5*a*, 5*b*, 6*a*, 6*b*, 9*a*, and 9*b* placed in the depth of the layers 8*a*, 8*b*, 7*a*, and 7*b* and glass plates 4*a* and 4*b* in the depth of the electrodes are shown. The electrodes 9*a* and 9*b* shown in FIG. 29B are not actually in a sectional view, but are hatched for ease of viewing.

As seen in FIGS. 28A, 28B, 29A and 29B, the differences between the seventeenth and fifteenth embodiments are that a main discharge space 3*d* of each discharge cell is defined as a stripe space by a bulkhead 13 separating the discharge cell into the main discharge space 3*d* and an auxiliary discharge space 3*c*, the front substrate 1, and barrier ribs 11 substantially orthogonal to a main discharge electrode pair 60 and that the auxiliary discharge space 3*c* is made separate for each discharge cell by a bulkhead 13 separating the discharge cell into the main discharge space 3*d* and the auxiliary discharge space 3*c*, the rear substrate 2, and the barrier rib 12 surrounding the auxiliary discharge space. The remaining configuration and the manufacturing method of the present embodiment is the same as that of the fifteenth embodiment.

Since a main discharge space 3*d* can be made large and the area overwhich a phosphor 14 can be applied to a plane can be increased, the seventeenth embodiment produces the effect of increasing the brightness. To manufacture the bulkhead substrate defining the discharge space 3*b* as a part, the mechanical strength of the bulkhead substrate can be enhanced compared with the sixteenth embodiment.

Embodiment 18

In an eighteenth embodiment of the invention, a gas discharge display panel is manufactured as in the fifteenth embodiment; however, instead of providing two address electrodes 9 (9*a* and 9*b*) for each cell row, one electrode 9*c* is shared with an adjacent cell row and three electrodes 9*d*, 9*c*, and 9*d* are provided for every two cell rows in the eighteenth embodiment.

Figure 30A:
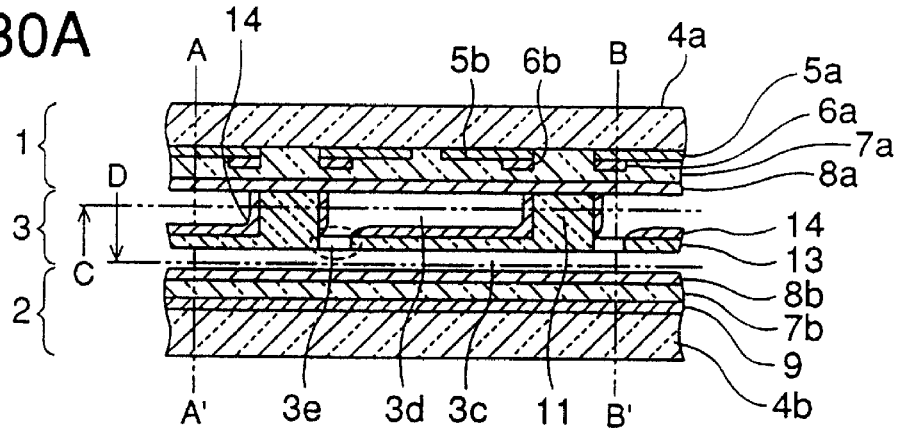
FIGS. 30A–30C are partially enlarged sectional views showing the structure of a gas discharge color display panel of an eighteenth embodiment.
Figure 30B:
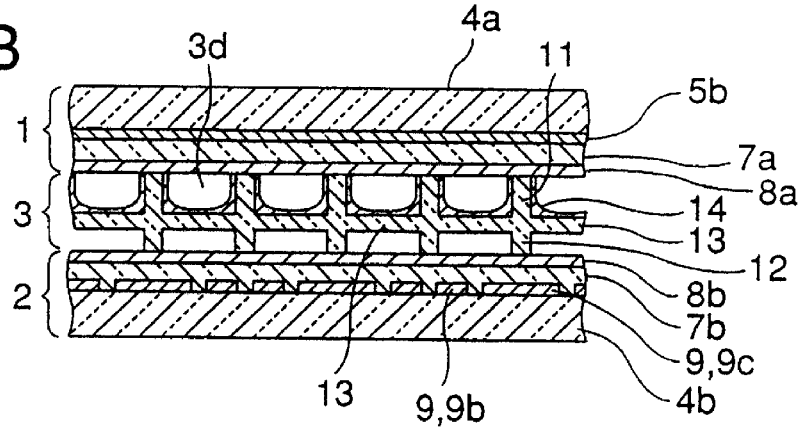
Figure 30C:
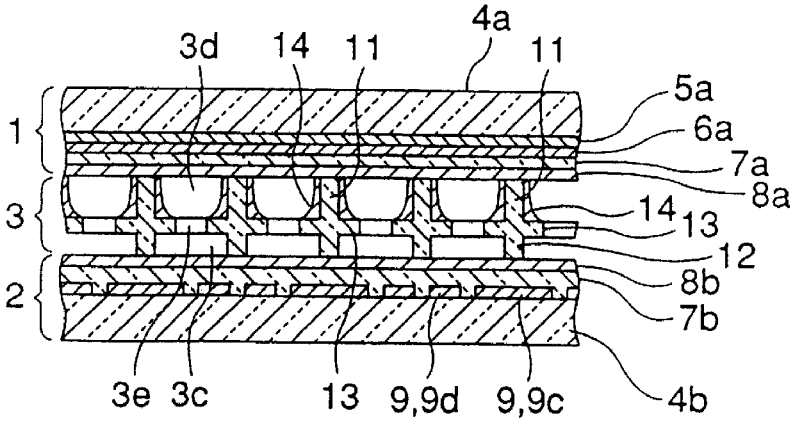

FIGS. 30A–30C, 31A and 31B are sectional views of the gas discharge display panel manufactured in the eighteenth embodiment of the invention. FIG. 30A is a sectional view of the display panel when a part thereof is cut away on a plane parallel with address electrodes 9 and perpendicular to the surfaces of substrates 1 and 2. FIG. 30B is a sectional view taken on line A-A' of FIG. 30A; the cut-away face is a plane perpendicular to the address electrodes 9 and the surfaces of the substrates 1 and 2. FIG. 30C is a sectional view taken on line B-B' of FIG. 30A; the cut-away face is a plane perpendicular to the address electrodes 9 and the surfaces of the substrates 1 and 2.

Figure 31A:
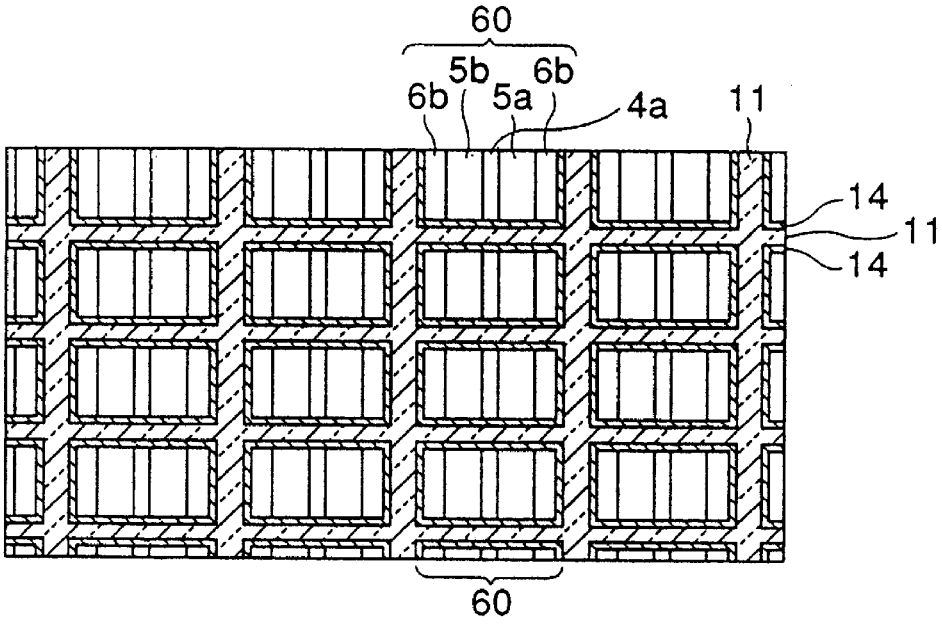
FIGS. 31A and 31B are partially enlarged sectional views showing the placement of a barrier rib and electrodes of the gas discharge color display panel of the eighteenth embodiment.
Figure 31B:
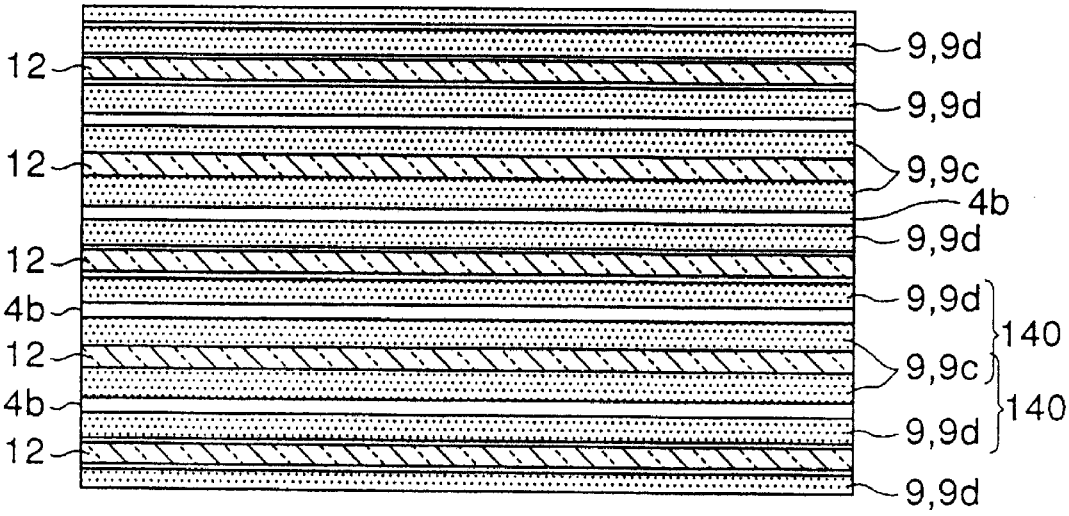

FIG. 31A is a sectional view of the display panel on a plane taken on line C in FIG. 30A. FIG. 31B is a sectional view of the display panel on a plane taken on line D in FIG. 30A. In FIGS. 31A and 31B, protective films 8*a* and 8*b* and dielectric layers 7*a* and 7*b* are not shown and electrodes 5*a*, 5*b*, 6*a*, 6*b*, 9*c*, and 9*d* placed in the depth of the layers 8*a*, 8*b*, 7*a*, and 7*b* and glass plates 4*a* and 4*b* in the depth of the electrodes are shown. The electrodes 9*c* and 9*d* shown in FIG. 31B are not actually in a sectional view, but are hatched for ease of viewing.

As seen in FIGS. 30B, 30C and 31B, the difference between the eighteenth and fifteenth embodiments is that one of two auxiliary discharge electrodes 9 of each discharge cell formed on the rear substrate 2 is shared with an adjacent discharge cell placed in a direction substantially vertical to the auxiliary discharge electrode as a common electrode 9*c*. In this case, two auxiliary discharge electrode 9*d* and one common auxiliary discharge electrode 9*c* are provided for each discharge cell. Each discharge cell is selected between the auxiliary discharge electrode 9*d* and one pair of transparent electrodes 5*a* and 5*b* and bus electrodes 6*a* and 6*b* on the front substrate 1. A barrier rib 12 is located via the dielectric layer 7*b* and the protective layer 8*b* made of MgO on the common electrode 9*c*, so as to separate the auxiliary discharge space 3*c* from the auxiliary discharge space 3*c* in adjacent discharge cell row along the address electrode 9. The remaining configuration and the manufacturing method of the present embodiment is the same as that of the fifteenth embodiment.

In addition to the effects of the fifteenth embodiment, the eighteenth embodiment can also produce the effect of remarkably reducing the number of auxiliary discharge electrodes on the rear substrate 2. For example, if the number of discharge cell rows in a direction along the main discharge electrodes is even, the number of auxiliary discharge electrodes 9 can be reduced to three quarters.

Embodiment 19

In a nineteenth embodiment of the invention, a gas discharge display panel is manufactured as in the eighteenth embodiment; a bulkhead substrate 3 is manufactured as in the third embodiment.

Figure 32A:
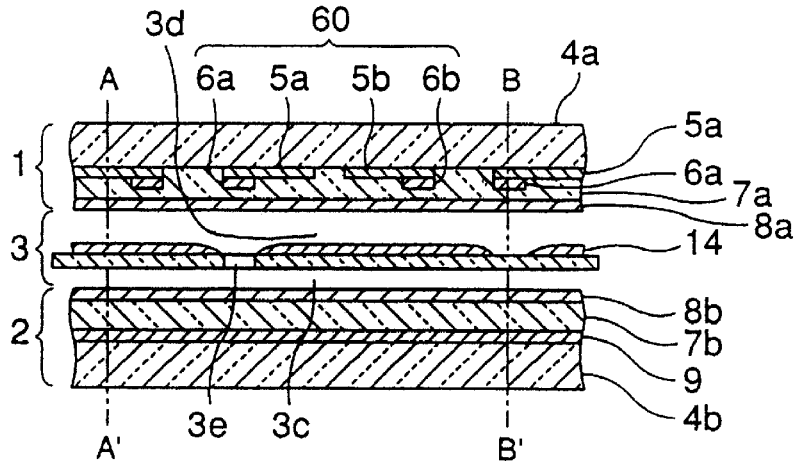
FIGS. 32A–32C are partially enlarged sectional views showing the structure of a gas discharge color display panel of a nineteenth embodiment.
Figure 32B:
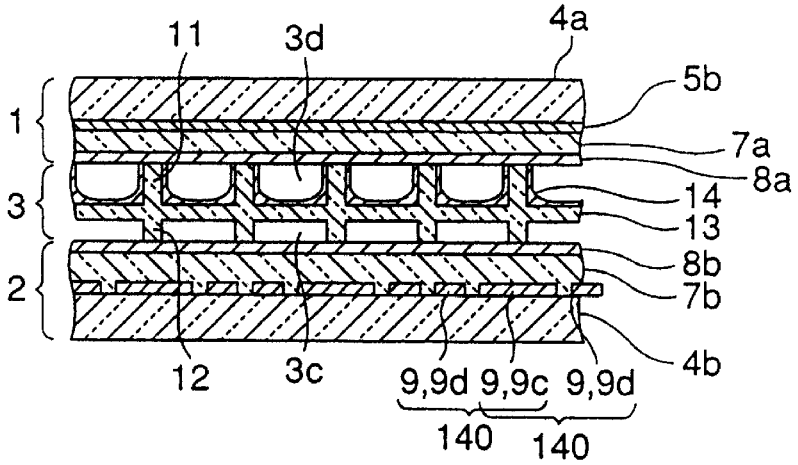
Figure 32C:
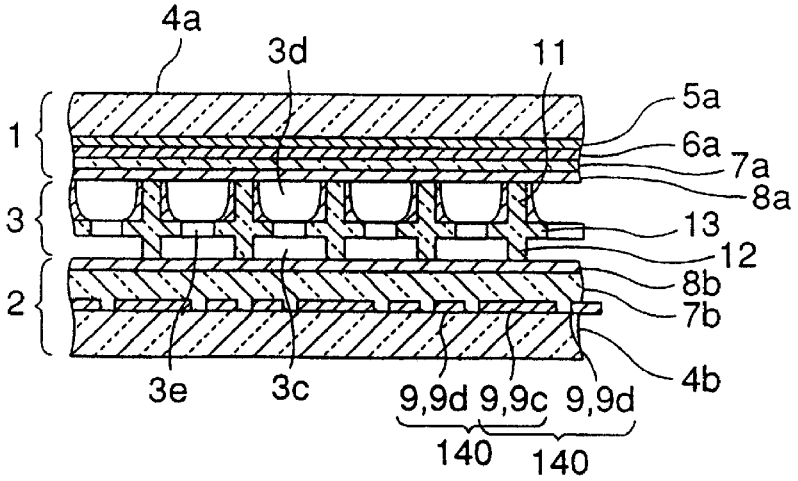

FIGS. 32A–32C are sectional views of the gas discharge display panel manufactured in the nineteenth embodiment of the invention. FIG. 32A is a sectional view of the display panel when a part thereof is cut away on a plane parallel with address electrodes 9 and perpendicular to the surfaces of substrates 1 and 2. FIG. 32B is a sectional view taken on line A-A' of FIG. 32A; the cut-away face is a plane perpendicular to the address electrodes 9 and the surfaces of the substrates 1 and 2. FIG. 32C is a sectional view taken on line B-B' of FIG. 32A; the cut-away face is a plane perpendicular to the address electrodes 9 and the surfaces of the substrates 1 and 2.

Like the eighteenth embodiment, the nineteenth embodiment can produce the effect of remarkably reducing the number of auxiliary discharge electrodes on the rear substrate 2. For example, if the number of discharge cells placed in a direction substantially perpendicular to the auxiliary discharge electrodes is even, the number of auxiliary discharge electrodes can be reduced to three quarters. Like the sixteenth embodiment, the nineteenth embodiment can also produce the effect associated with main discharge space 3*d* widened.

Embodiment 20

In a twentieth embodiment of the invention, a gas discharge display panel is manufactured as in the eighteenth embodiment. However, in manufacturing a bulkhead substrate 3 in the twentieth embodiment, barrier ribs 11 on the front substrate side are formed like stripes and a barrier rib 12 on the rear substrate side is shaped like a lattice.

Figure 33A:
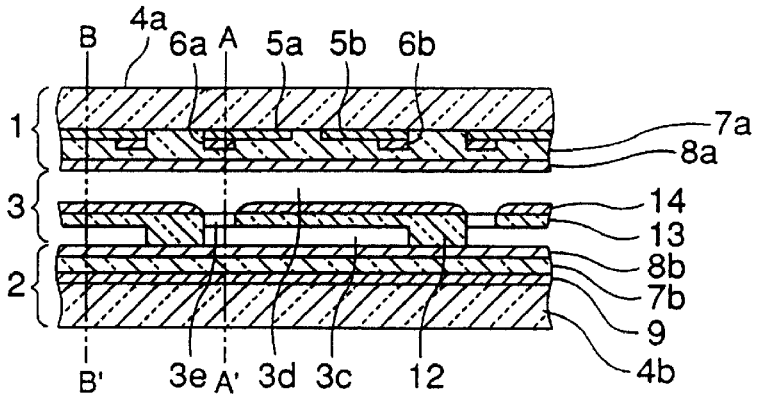
FIGS. 33A–33C are partially enlarged sectional views showing the structure of a gas discharge color display panel of a twentieth embodiment.
Figure 33B:
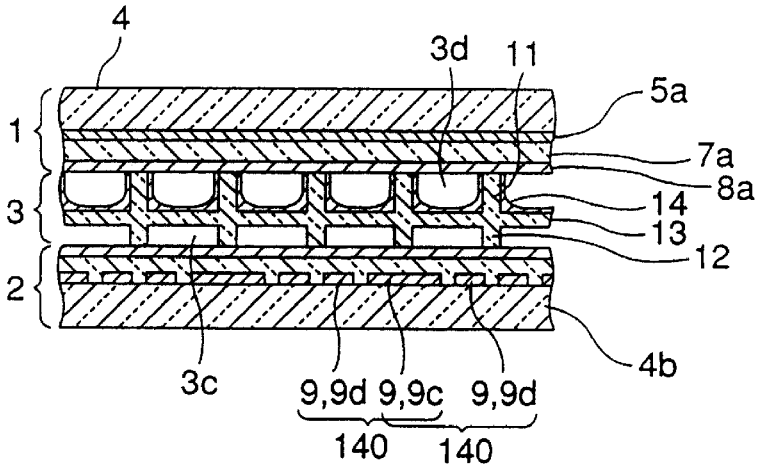
Figure 33C:
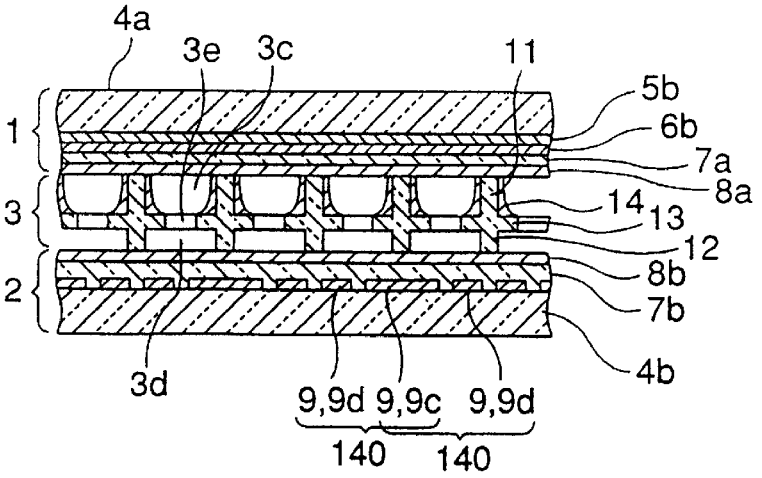

FIGS. 33A–33C are sectional views of the gas discharge display panel manufactured in the twentieth embodiment of the invention. FIG. 33A is a sectional view of the display panel when a part thereof is cut away on a plane parallel with address electrodes 9 and perpendicular to the surfaces of substrates 1 and 2. FIG. 33B is a sectional view taken on line A-A' of FIG. 33A; the cut-away face is a plane perpendicular to the address electrodes 9 and the surfaces of the substrates 1 and 2. FIG. 33C is a sectional view taken on line B-B' of FIG. 33A; the cut-away face is a plane perpendicular to the address electrodes 9 and the surfaces of the substrates 1 and 2.

Like the eighteenth embodiment, the twentieth embodiment can produce the effect of remarkably reducing the number of auxiliary discharge electrodes on the rear substrate 2. Like the seventeenth embodiment, the twentieth embodiment can also produce the effect associated with main discharge space 3*d* widened and enhance the mechanical strength of the bulkhead substrate 3.

Embodiment 21

In a twenty-first embodiment of the invention, a gas discharge display panel is manufactured as in the fifteenth embodiment. However, in manufacturing a bulkhead substrate 3 in the twenty-first embodiment, each through hole used as a priming path 3*e* is formed at in such a position where the position of the priming path 3*e* overlaps the position of one electrode 9 in an auxiliary discharge electrode pair 140 when a display panel resulting from assembling substrates 1–3 is placed horizontally and is viewed vertically from the front thereof. That is, the position of the through hole on a bulkhead 13 is not at the center of the bulkhead 13 and is offset towards to one barrier rib 3*a*. A bus electrode 6*a* is formed at a position above the priming path 3*e* on the bulkhead 13 when viewed vertically from the front of the display panel.

Figure 34A:
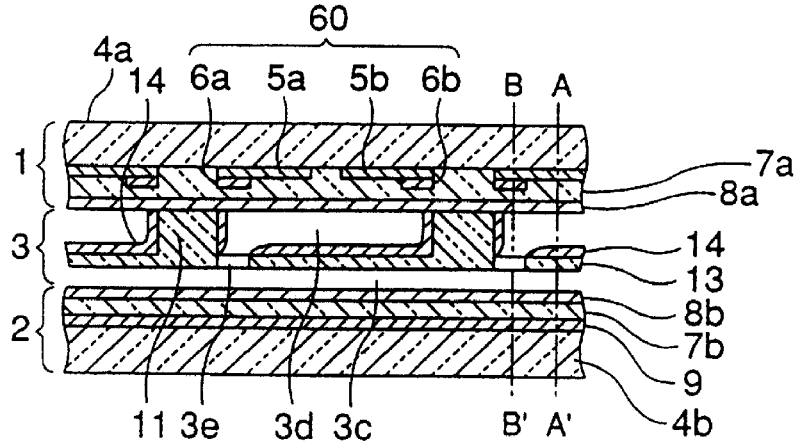
FIGS. 34A–34C are partially enlarged sectional views showing the structure of a gas discharge color display panel of a twenty-first embodiment.
Figure 34B:
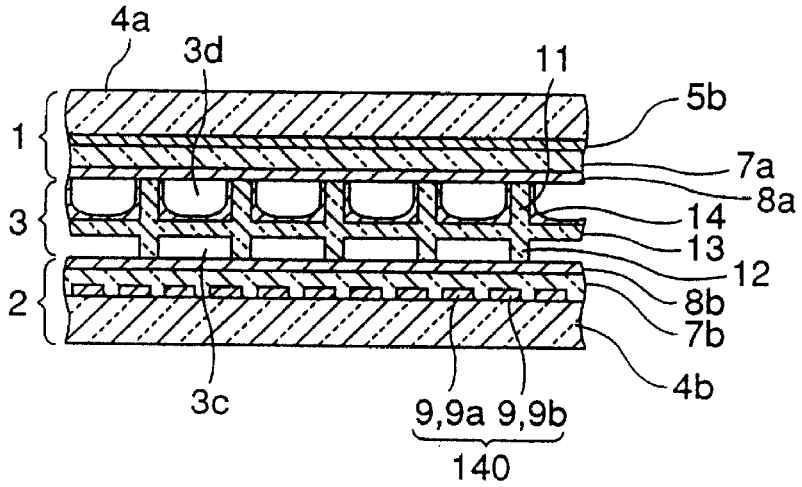
Figure 34C:
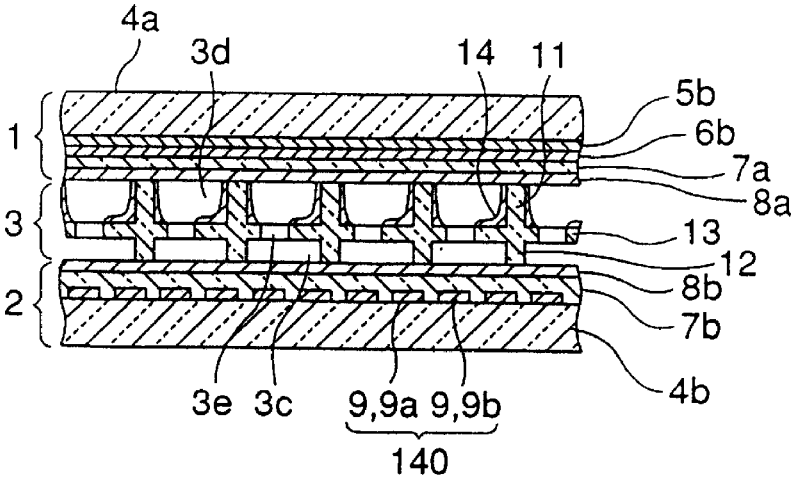

FIGS. 34A–34C are sectional views of the gas discharge display panel manufactured in the twenty-first embodiment of the invention. FIG. 34A is a sectional view of the display panel when a part thereof is cut away on a plane parallel with address electrodes 9 and perpendicular to the surfaces of substrates 1 and 2. FIG. 34B is a sectional view taken on line A-A' of FIG. 34A; the cut-away face is a plane perpendicular to the address electrodes 9 and the surfaces of the substrates 1 and 2. FIG. 34C is a sectional view taken on line B-B' of FIG. 34A; the cut-away face is a plane perpendicular to the address electrodes 9 and the surfaces of the substrates 1 and 2.

In the embodiment, when viewed vertically from the front of the display panel, one electrode 9*a* in the auxiliary discharge electrode pair 140 and one bus electrode 6*a* in a main discharge electrode pair 60 are placed at positions overlapping the priming path 3*e*. Therefore, the bus electrode 6*a* made of an opaque material makes it impossible to see the priming path 3*e* from the side of the front substrate 1 and shields light caused by gas discharge of auxiliary discharge from passing through the front substrate 1. This can also produce the effect of reducing the effect of light caused by gas discharge of auxiliary discharge.

In the embodiment, the path passing through the priming path 3*e* connecting the auxiliary discharge electrode 9*a* and the main discharge bus electrode 6*a* becomes a straight line orthogonal to the bulkhead 13. This makes the distance between the auxiliary discharge electrode 9*a* and the main discharge bus electrode 6*a* shortest. Thus, an electrical field for spreading out charged particles, etc., occurring in the auxiliary discharge space 3*c* over the main discharge space 3*d* becomes the highest in the priming path 3*e*. Therefore, a voltage applied between the auxiliary discharge electrode 9*a* and the main discharge electrode 5*a*, 6*a* for spreading out the charged particles occurring in the auxiliary discharge space 3*c* over the main discharge space 3*d* can be lowered. This means that, the embodiment can lower the drive voltage.

Since the path passing through the priming path 3*e* connecting the auxiliary discharge electrode 9*a* and the main discharge bus electrode 6*a* is short and this electric field becomes high in the embodiment, sufficient charged particles, etc., can be introduced into the main discharge space 3*d*, even if the internal diameter of the priming path 3*e* is made small. Therefore, this embodiment, which can make the internal diameter of the priming path 3*e* small, can increase the amount of phosphor 14 applied to the bulkhead 13, providing high brightness.

In FIGS. 34A–34C, the auxiliary discharge electrode 9*a* formed on the rear substrate 2 and the bus electrode 6*a* are opposed to each other via the priming path 3*e*, but one ITO electrode (5*a* or 5*b*) in the main discharge electrode pair 60 and one address electrode (9*a* or 9*b*) in the auxiliary discharge electrode pair 140 may be opposed to each other via the priming path 3*e*. In this case, however, the effect of the bus electrode 6*a* for shielding light caused by auxiliary discharge is lost.

As described above, the gas discharge display panel of the embodiment executes auxiliary discharge and main discharge in different discharge spaces for enhancing display screen contrast and has the ITO electrode (5*a* or 5*b*) and the address electrode (9*a* or 9*b*) opposed to each other via the priming path 3*e* so that an applied voltage for spreading out auxiliary discharge over the main discharge space can be lowered, thus lowering the drive voltage.

Embodiment 22

In a twenty-second embodiment of the invention, a gas discharge display panel is manufactured as in the twenty-first embodiment. However, in manufacturing a bulkhead substrate 3 in the twenty-second embodiment, a barrier rib 11 on the front substrate side and barrier ribs 12 on the rear substrate side are formed shifting in a direction along main discharge electrodes 5*a* and 5*b* so that their positions do not overlap when viewed vertically from the front of the display panel.

Figure 35A:
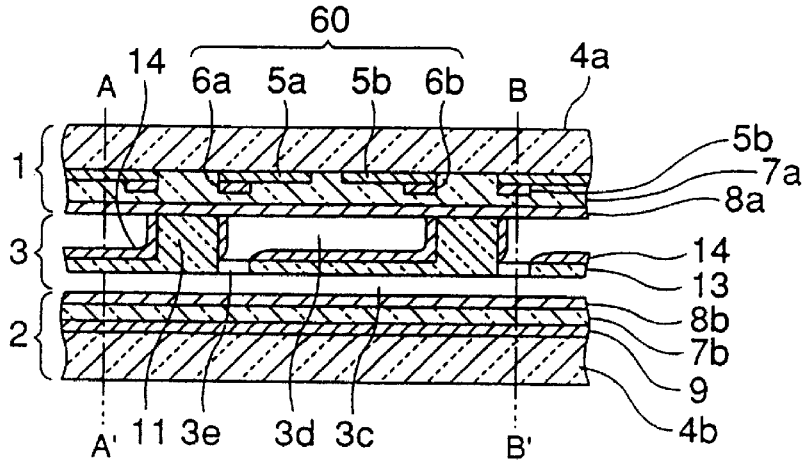
FIGS. 35A–35C are partially enlarged sectional views showing the structure of a gas discharge color display panel of a twenty-second embodiment.
Figure 35B:
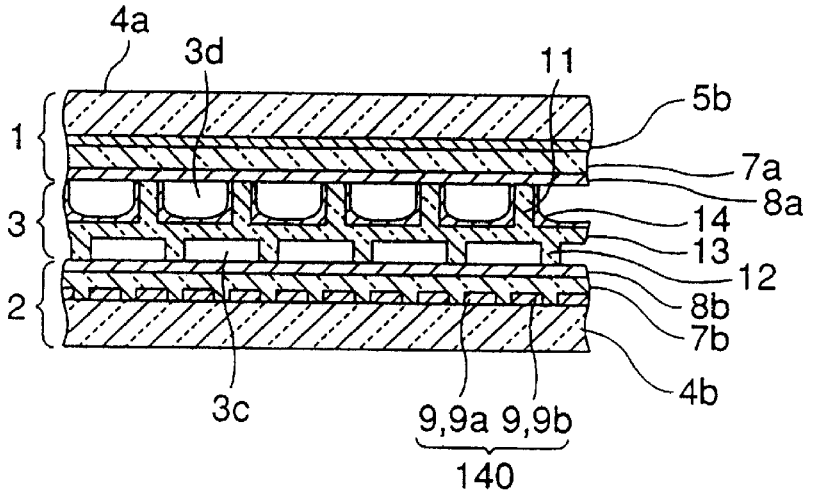
Figure 35C:
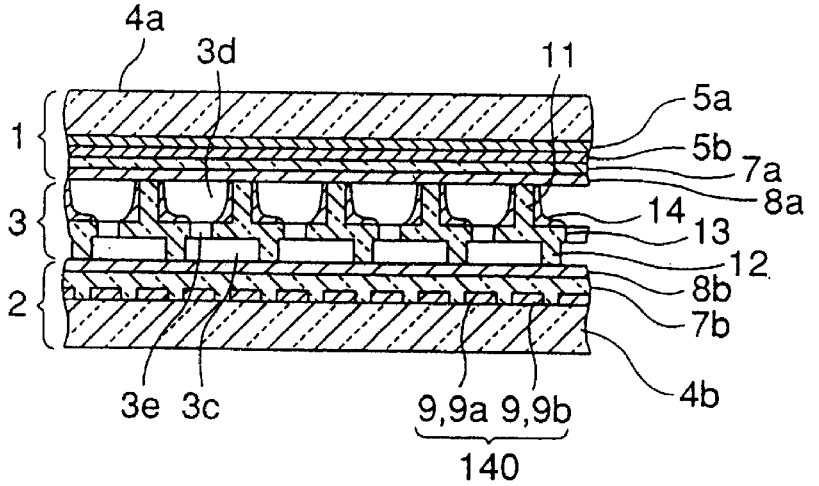

FIGS. 35A–35C are sectional views of the gas discharge display panel manufactured in the twenty-second embodiment of the invention. FIG. 35A is a sectional view of the display panel when a part thereof is cut away on a plane parallel with address electrodes 9 and perpendicular to the surfaces of substrates 1 and 2. FIG. 35B is a sectional view taken on line A-A' of FIG. 35A; the cut-away face is a plane perpendicular to the address electrodes 9 and the surfaces of the substrates 1 and 2. FIG. 35C is a sectional view taken on line B-B' of FIG. 35A; the cut-away face is a plane perpendicular to the address electrodes 9 and the surfaces of the substrates 1 and 2.

As seen in FIGS. 35B and 35C, the difference between the twenty-second and twenty-first embodiments is that auxiliary discharge space 3*c* corresponding to each discharge cell is formed shifting in an auxiliary discharge space arrangement direction from the main discharge space 3*d* (namely, in a direction along the main discharge electrodes) for increasing the area of the auxiliary discharge electrode 9*a* overlapping a priming path 3*e*.

The embodiment facilitates alignment of the main discharge electrode 5*a*, the auxiliary discharge electrode 9*a*, and the priming path 3*e* compared with the twenty-first embodiment. Thus, in addition to the effects of the twenty-first embodiment, the twenty-second embodiment can also produce the effects of a stable manufacturing process compared with the twenty-first embodiment and decrease the size of the priming path 3*e*.

Embodiment 23

In a twenty-third embodiment of the invention, a gas discharge display panel is manufactured as in the twenty-first embodiment. However, instead of providing two auxiliary discharge electrodes 9 (9*a* and 9*b*) for each cell row, one electrode 9*c* is shared with an adjacent cell row and three electrodes 9*d*, 9*c*, and 9*d* are provided for every two cell rows in the twenty-third embodiment as in the eighteenth embodiment.

Figure 36A:
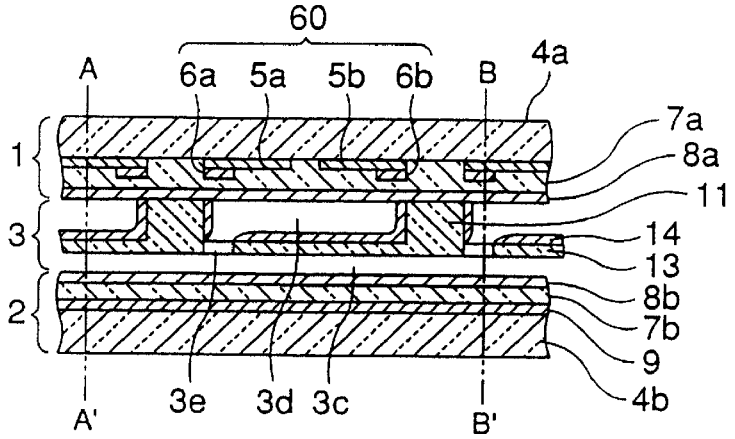
FIGS. 36A–36C are partially enlarged sectional views showing the structure of a gas discharge color display panel of a twenty-third embodiment.
Figure 36B:
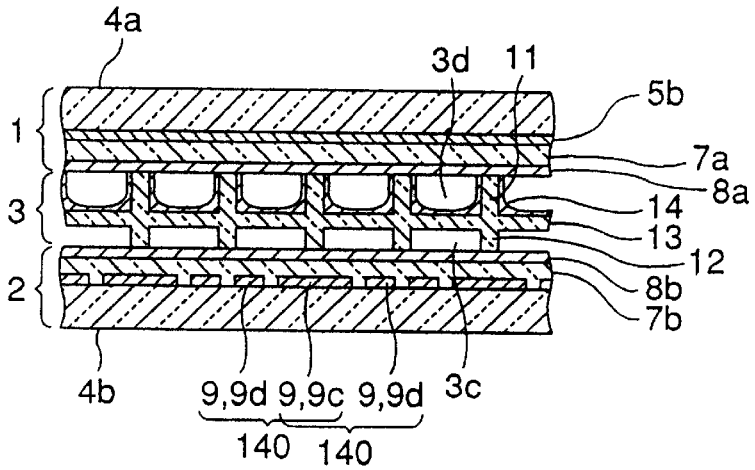
Figure 36C:
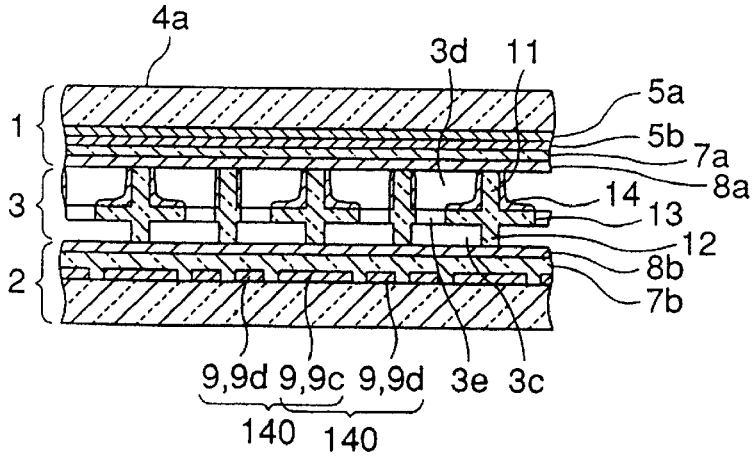

FIGS. 36A–36C are sectional views of the gas discharge display panel manufactured in the twenty-third embodiment of the invention. FIG. 36A is a sectional view of the display panel when a part thereof is cut away on a plane parallel with address electrodes 9 and perpendicular to the surfaces of substrates 1 and 2. FIG. 36B is a sectional view taken on line A-A' of FIG. 36A; the cut-away face is a plane perpendicular to the address electrodes 9 and the surfaces of the substrates 1 and 2. FIG. 36C is a sectional view taken on line B-B' of FIG. 36A; the cut-away face is a plane perpendicular to the address electrodes 9 and the surfaces of the substrates 1 and 2.

As seen in FIGS. 36B and 36C, as in the eighteenth embodiment, one of two auxiliary discharge electrodes 9 of each discharge cell is shared with an adjacent discharge cell placed in a direction substantially vertical to the auxiliary discharge electrode as a common electrode 9*c*. As in the twenty-first embodiment, the path passing through a priming path 3*e* connecting the auxiliary discharge electrode 9*d* which is not shared, and a main discharge bus electrode 6*a* becomes a straight line orthogonal to a bulkhead 13.

Like the eighteenth embodiment, the twenty-third embodiment can produce the effect of remarkably reducing the number of auxiliary discharge electrodes 9 because one electrode 9 in an auxiliary discharge electrode pair 140 is shared by two adjacent discharge cells. If the size of the common auxiliary discharge electrode 9*c* is decreased, the area of the auxiliary discharge electrode 9*d* can be increased, increasing the area where the auxiliary discharge electrode 9*d* and the priming path 3*e* overlap when viewed vertically from the front of the display panel, thereby facilitating alignment of main discharge electrodes 5*a* and 6*a*, the auxiliary discharge electrode 9*d*, and the priming path 3*e*. Thus, in addition to the effects of the twenty-first embodiment, the twenty-third embodiment can also produce the effects of a stable manufacturing process compared with the twenty-first embodiment and decrease the inner diameter of the priming path 3*e*.

Embodiment 24

In a twenty-fourth embodiment of the invention, a gas discharge display panel is manufactured as in the twenty-first embodiment. However, in manufacturing a bulkhead substrate 3 in the twenty-fourth embodiment, barrier ribs 11 on the front substrate side are formed like stripes.

Figure 37A:
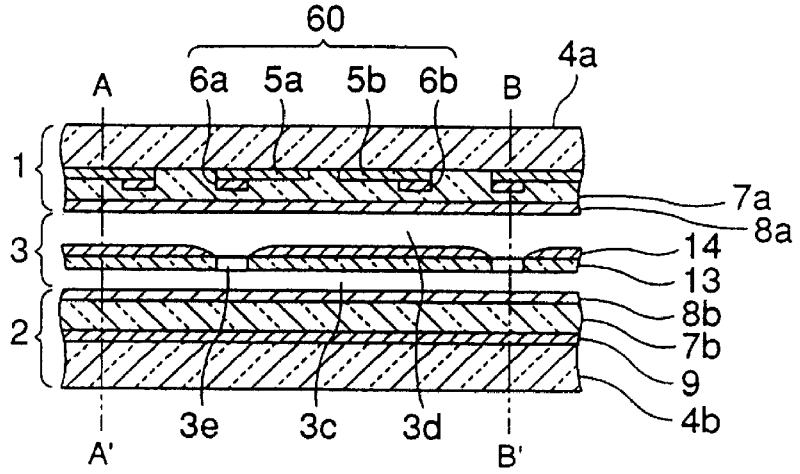
FIGS. 37A–37C are partially enlarged sectional views showing the structure of a gas discharge color display panel of a twenty-fourth embodiment.
Figure 37B:
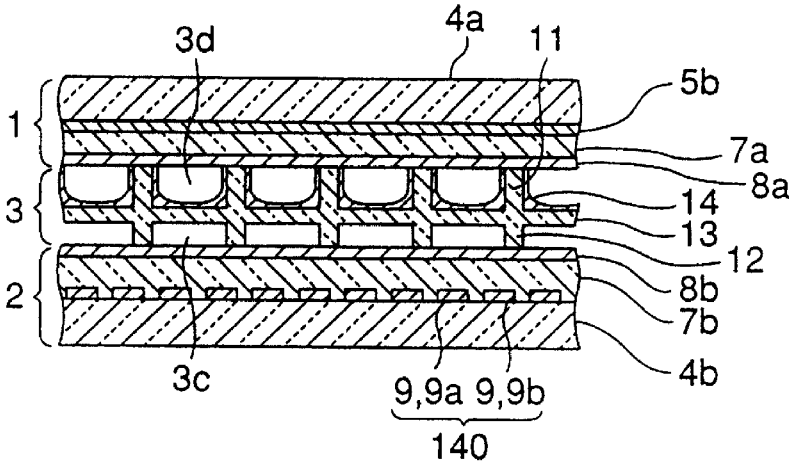
Figure 37C:
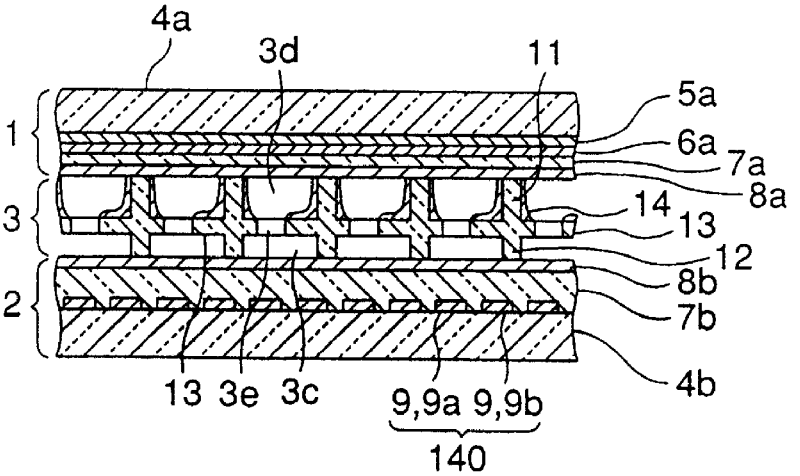

FIGS. 37A–37C are sectional views of the gas discharge display panel manufactured in the twenty-fourth embodiment of the invention. FIG. 37A is a sectional view of the display panel when a part thereof is cut away on a plane parallel with address electrodes 9 and perpendicular to the surfaces of substrates 1 and 2. FIG. 37B is a sectional view taken on line A-A' of FIG. 37A; the cut-away face is a plane perpendicular to the address electrodes 9 and the surfaces of the substrates 1 and 2. FIG. 37C is a sectional view taken on line B-B' of FIG. 37A; the cut-away face is a plane perpendicular to the address electrodes 9 and the surfaces of the substrates 1 and 2.

As seen in FIGS. 37A and 37B, the difference between the twenty-fourth and twenty-first embodiments is that the barrier ribs 11 on the front substrate side are formed like stripes, namely, a main discharge space 3*d* of each discharge cell is contiguous to its adjacent main discharge space 3*d* in a direction along the auxiliary discharge electrode 9 and each cell in a cell row along the auxiliary discharge electrode 9 shares one space as main discharge space 3*d*. The remaining configuration and the manufacturing method of the present embodiment is the same as that of the twenty-first embodiment.

Since the twenty-fourth embodiment provides wider main discharge space 3*d* than the twenty-first embodiment, the amount of a phosphor 14 applied can be increased. Thus, in addition to the effects of the twenty-first embodiment, the twenty-fourth embodiment can produce the effect of increasing the brightness. It also facilitates vacuum exhaust and gas injection after assembly of the gas discharge display panel.

Embodiment 25

In a twenty-fifth embodiment of the invention, a gas discharge display panel is manufactured as in the twenty-fourth embodiment. However, instead of providing two address electrodes 9 (9*a* and 9*b*) for each cell row, one electrode 9*c* is shared with an adjacent cell row and three electrodes 9*d*, 9*c*, and 9*d* are provided for every two cell rows in the twenty-fifth embodiment as in the eighteenth embodiment. In the twenty-fourth embodiment, the priming path 3*e* is formed leaning to the side in a given direction from the center of the bulkhead 13 (on the left as the observer faces the paper face of FIG. 37C; in the twenty-fifth embodiment, the leaning direction is reversed alternately for each cell. That is, in the embodiment, a barrier rib 3*a* becomes an axis in the shape of two adjacent cells.

Figure 38A:
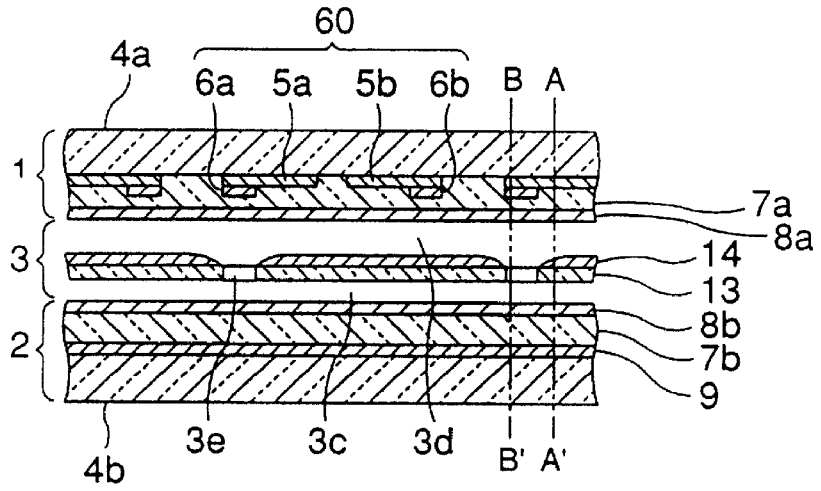
FIGS. 38A–38C are partially enlarged sectional views showing the structure of a gas discharge color display panel of a twenty-fifth embodiment.
Figure 38B:
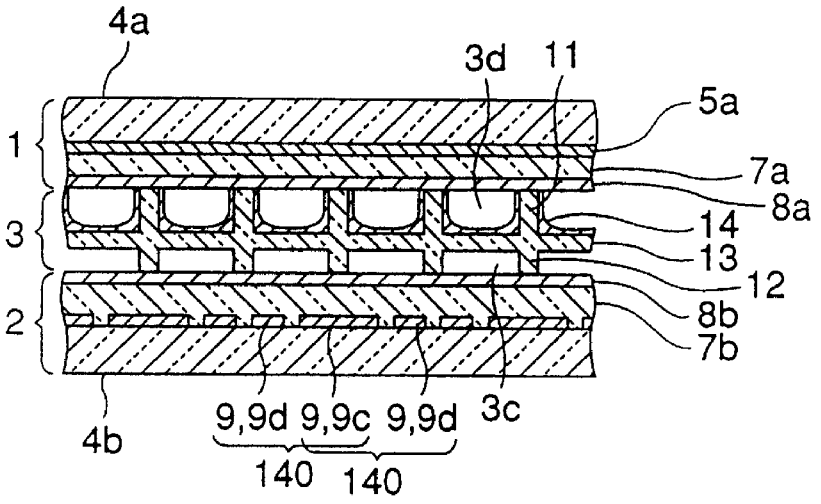
Figure 38C:
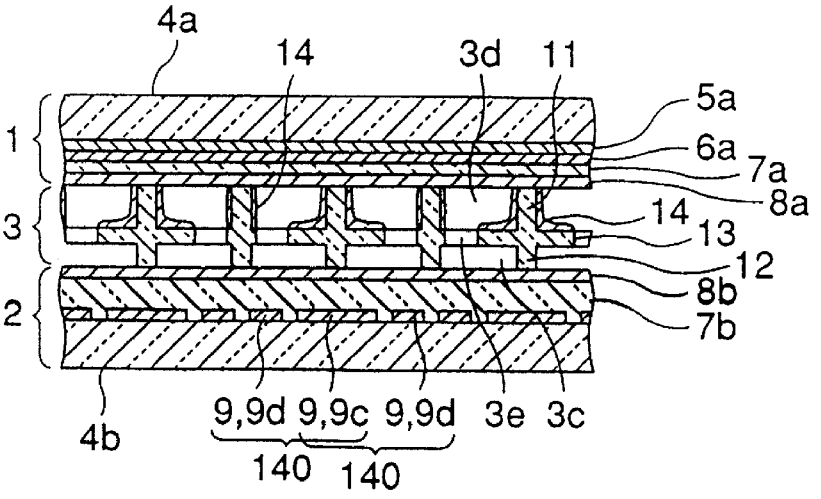

FIGS. 38A–38C are sectional views of the gas discharge display panel manufactured in the twenty-fifth embodiment of the invention. FIG. 38A is a sectional view of the display panel when a part thereof is cut away on a plane parallel with address electrodes 9 and perpendicular to the surfaces of substrates 1 and 2. FIG. 38B is a sectional view taken on line A-A' of FIG. 38A; the cut-away face is a plane perpendicular to the address electrodes 9 and the surfaces of the substrates 1 and 2. FIG. 38C is a sectional view taken on line B-B' of FIG. 38A; the cut-away face is a plane perpendicular to the address electrodes 9 and the surfaces of the substrates 1 and 2.

In addition to the effects of the twenty-fourth embodiment, the twenty-fifth embodiment can produce the effect of remarkably reducing the number of auxiliary discharge electrodes as in the eighteenth embodiment and the effect associated with unshared auxiliary discharge space 9*d* widened.

Embodiment 26

In a twenty-sixth embodiment of the invention, a gas discharge display panel is manufactured as in the twenty-first embodiment. However, in the twenty-sixth embodiment, auxiliary discharge electrodes 9 and 10 are formed so that both address electrode 9 and bus electrode 10 separated up and down via a dielectric 7*b* pass through the position of a priming path 3*e* when the display panel placed horizontally is viewed vertically from the front thereof.

Figure 39A:
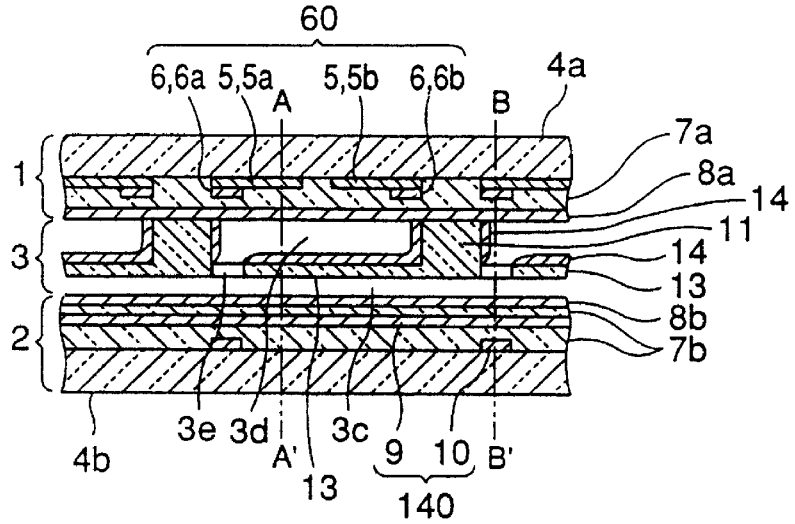
FIGS. 39A–39C are partially enlarged sectional views showing the structure of a gas discharge color display panel of a twenty-sixth embodiment.
Figure 39B:
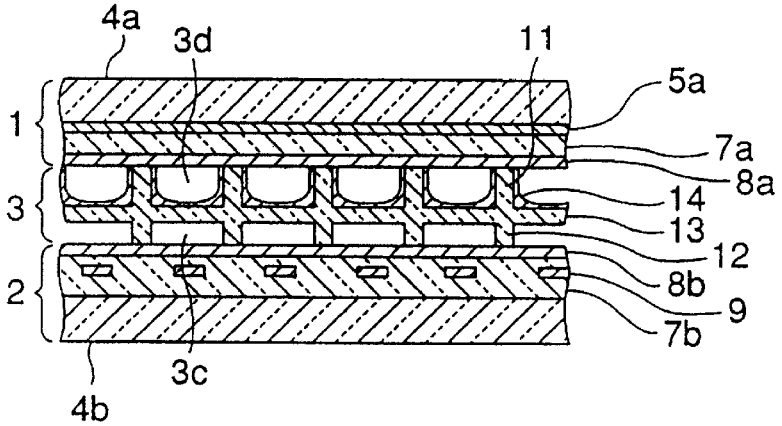
Figure 39C:
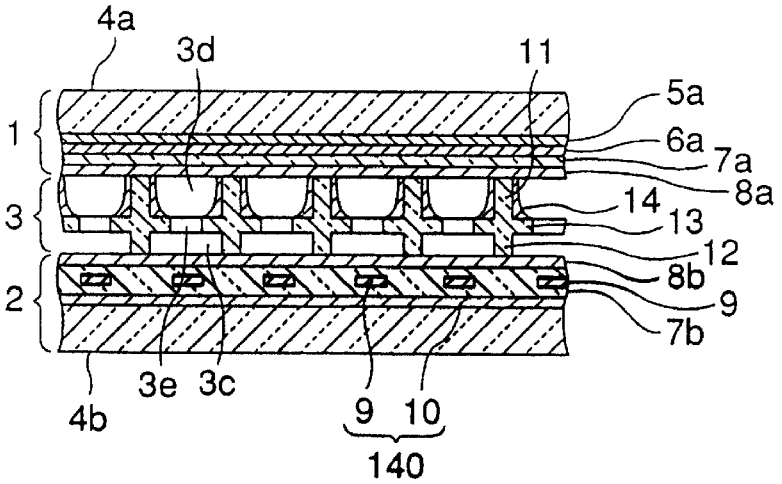

FIGS. 39A–39C are sectional views of the gas discharge display panel manufactured in the twenty-sixth embodiment of the invention. FIG. 39A is a sectional view of the display panel when a part thereof is cut away on a plane parallel with address electrodes 9 and perpendicular to the surfaces of substrates 1 and 2. FIG. 39B is a sectional view taken on line A-A' of FIG. 39A; the cut-away face is a plane perpendicular to the address electrodes 9 and the surfaces of the substrates 1 and 2. FIG. 39C is a sectional view taken on line B-B' of FIG. 39A; the cut-away face is a plane perpendicular to the address electrodes 9 and the surfaces of the substrates 1 and 2.

The display panel manufacturing method of the twenty-sixth embodiment differs from that of the twenty-first embodiment only in the manufacturing process of a rear substrate 2. Therefore, only the manufacturing process of the rear substrate 2 will be discussed.

(26-1) A Cr/Cu/Cr laminated film comprising a Cu film sandwiched between Cr films is formed by a technique such as a sputtering method or electron beam evaporation method on the surface of a rear substrate glass plate 4*b* made of soda lime glass or the like washed with a neutral detergent, etc.

(26-2) The Cr/Cu/Cr laminated film is processed using a known photoetching method to form a pattern of auxiliary discharge electrodes (trigger electrodes) 10 as shown in FIG. 10 (*f*). The film thickness of the Cr/Cu/Cr laminated film and the pattern dimensions of the trigger electrodes 10 may be determined by the resistance value required for the auxiliary discharge electrodes.

(26-3) A hydrolysis-type coating agent, as used in the eighth embodiment, is applied to the surface of a glass plate 4*b* using a technique such as a blade method or spray method so as to cover the trigger electrodes 10 and heat is applied for 1-60 minutes at a temperature of 100°–400° C., forming a part 7*c* of a dielectric layer 7*b* of 0.001–0.03 mm thick as shown in FIG. 10 (*g*).

(26-4) A Cr/Cu/Cr laminated film comprising a Cu film sandwiched between Cr films is formed on the surface of the dielectric layer 7*c* by a technique such as the sputtering method or electron beam evaporation method and is processed using the known photoetching method for forming a pattern of auxiliary discharge electrodes (address electrodes) 9, as shown in FIG. 10 (*h*). The film thickness of the Cr/Cu/Cr laminated film and the pattern dimensions of the address electrodes 9 may be determined by the resistance value required for the auxiliary discharge electrodes.

(26-5) A hydrolysis-type coating agent, as used in step (26-3), is applied to the surface of the dielectric layer 7*c* using a technique such as the blade method or spray method so as to cover the address electrodes 9 and heat is applied for 1–60 minutes at a temperature of 100°–400° C., thereby forming the remainder of the dielectric layer 7*b* of 0.001–0.03 mm thick as shown in FIG. 10 (*i*).

(26-6) Lastly, a protective film 8*b* made of MgO as shown in FIG. 10 (*j*) is formed using a technique such as the sputtering method or electron beam evaporation method, whereby the rear substrate 2 is manufactured. A tip tube (not shown) for exhaust and gas introduction after the panel is assembled is attached to the rear substrate 2.

In this embodiment, like the first embodiment, the address electrodes 9 for auxiliary discharge formed on the rear substrate 2 are electrodes extended in a direction perpendicular to the extension direction of the main discharge electrodes 5 and 6 on the front substrate 1 and the trigger electrodes 10 for auxiliary discharge are electrodes extended in the same direction as the extension direction of the main discharge electrodes 5 and 6 on the front substrate 1.

In the fifteenth to twenty-fifth embodiments, application of voltage between two parallel electrodes 9 on the same plane causes auxiliary discharge to occur. Therefore, in this embodiments, auxiliary discharge occurs in all cells in the cell row along the electrodes 9 to which voltage is applied. For this reason, auxiliary discharge occurs in some of the cells where main discharge is not caused to occur.

In contrast, in the twenty-sixth embodiment, application of voltage between an address electrode 9 and a trigger electrode 10 orthogonal to each other via the dielectric 7*b* causes auxiliary discharge to occur, as in the first embodiment. That is, in the display panel of the twenty-sixth embodiment, an address electrode 9 and a trigger electrode 10 are selected to specify an auxiliary discharge space 3*c*, thereby selecting a discharge cell. Therefore, in the embodiment, auxiliary discharge does not occur in undisplayed discharge cells. Therefore, even if light caused by auxiliary discharge is observed from the outside of the front substrate, the display panel of the embodiment does not lower contrast.

In this embodiment, the auxiliary discharge electrodes 9 and 10 are separated up and down, namely, formed on different layers, thus the existence density of the auxiliary discharge electrodes is low compared with the fifteenth to twenty-fifth embodiments. For this reason, placement of the auxiliary discharge electrodes 9 opposed to the electrodes 5 on the front substrate 1 becomes more flexible and the area overlapping the priming path 3*e* can be increased. Thus, the effect of light emission caused by auxiliary discharge on the display picture quality can be almost eliminated and applied the voltage for spreading out auxiliary discharge over the main discharge space can be lowered.

Embodiment 27

In a twenty-seventh embodiment of the invention, a gas discharge display panel is manufactured as in the twenty-sixth embodiment. However, in manufacturing a bulkhead substrate 3 in the twenty-seventh embodiment, barrier ribs 11 on the front substrate side are formed like stripes, as in the twenty-fourth embodiment.

Figure 40A:
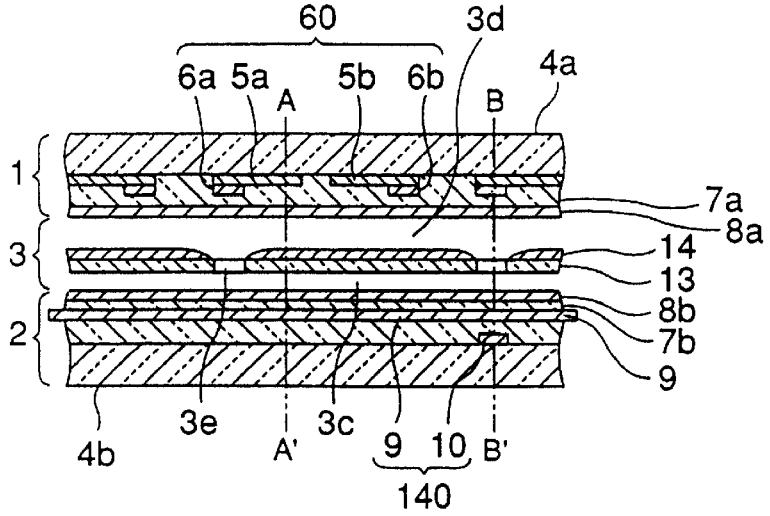
FIGS. 40A–40C are partially enlarged sectional views showing the structure of a gas discharge color display panel of a twenty-seventh embodiment.
Figure 40B:
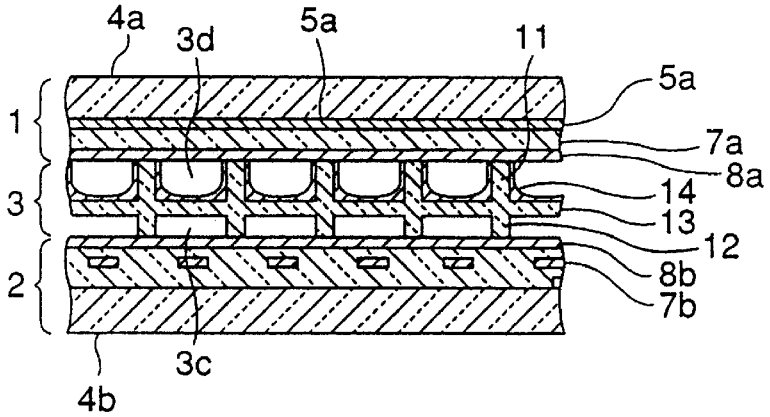
Figure 40C:
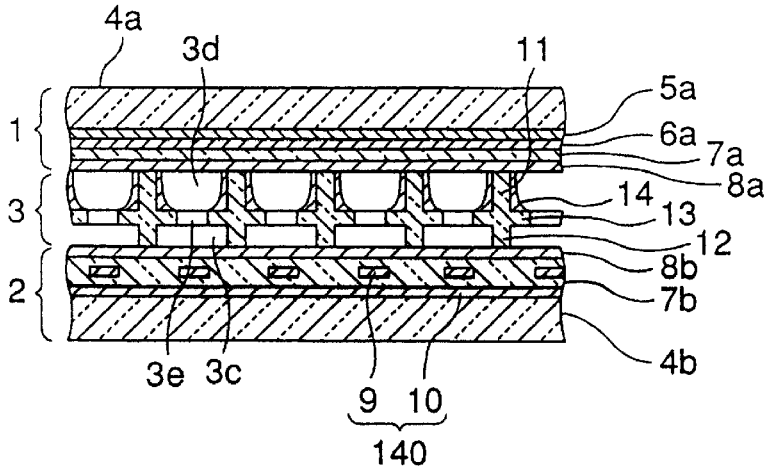

FIGS. 40A–40C are sectional views of the gas discharge display panel manufactured in the twenty-seventh embodiment of the invention. FIG. 40A is a sectional view of the display panel when a part thereof is cut away on a plane parallel with address electrodes 9 and perpendicular to the surfaces of substrates 1 and 2. FIG. 40B is a sectional view taken on line A-A' of FIG. 40A; the cut-away face is a plane perpendicular to the address electrodes 9 and the surfaces of the substrates 1 and 2. FIG. 40C is a sectional view taken on line B-B' of FIG. 40A; the cut-away face is a plane perpendicular to the address electrodes 9 and the surfaces of the substrates 1 and 2.

As seen in FIGS. 40A and 40B, the difference between the twenty-seventh and twenty-sixth embodiments is that the barrier ribs 11 on the front substrate side are formed like stripes, namely, a main discharge space 3*d* of each discharge cell is contiguous to its adjacent main discharge space 3*d* in a direction along the auxiliary discharge electrode 9 and each cell in a cell row along the auxiliary discharge electrode 9 shares one space as a main discharge space 3*d*. The remaining configuration of the manufacturing method of the present embodiment is the same as that of the twenty-sixth embodiment.

Since the display panel of the twenty-seventh embodiment provides a wider main discharge space 3*d* than that of the twenty-sixth embodiment, the twenty-seventh embodiment can produce the effect of increasing the amount of a phosphor 14 applied thereby enhancing display brightness, in addition to the effects of the twenty-sixth embodiment. It also facilitates vacuum exhaust and gas injection after assembly of the gas discharge display panel.

Embodiment 28

In a twenty-eighth embodiment of the invention, a display panel having the same structure as that of the twenty-sixth embodiment, except that a barrier rib 12 on the rear substrate side is shaped like lattice like a barrier rib 11 on the front substrate side, is manufactured as in the fourth embodiment. That is, in the twenty-eighth embodiment, the barrier rib 12 on the rear substrate side is formed on the surface of a protective film 8*b* on a rear substrate 2 without being formed integrally with the barrier rib 11 on the front substrate side when a bulkhead substrate 3 is manufactured.

Figure 41A:
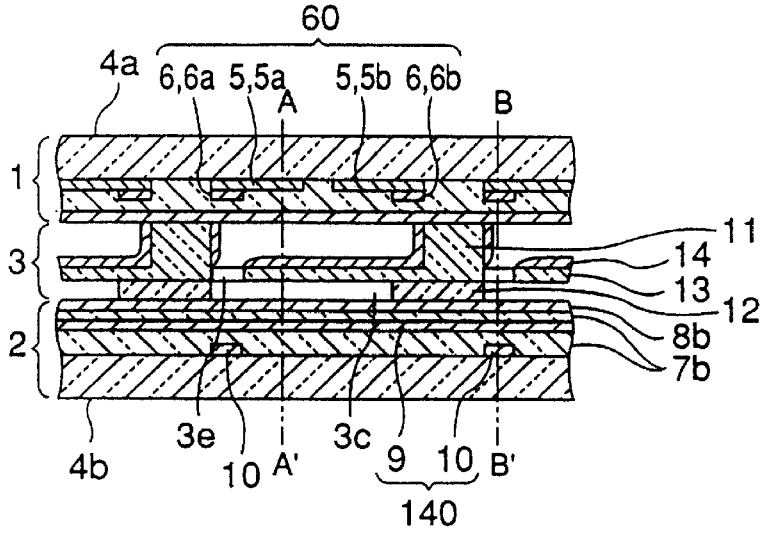
FIGS. 41A–41C are partially enlarged sectional views showing the structure of a gas discharge color display panel of a twenty-eighth embodiment.
Figure 41B:
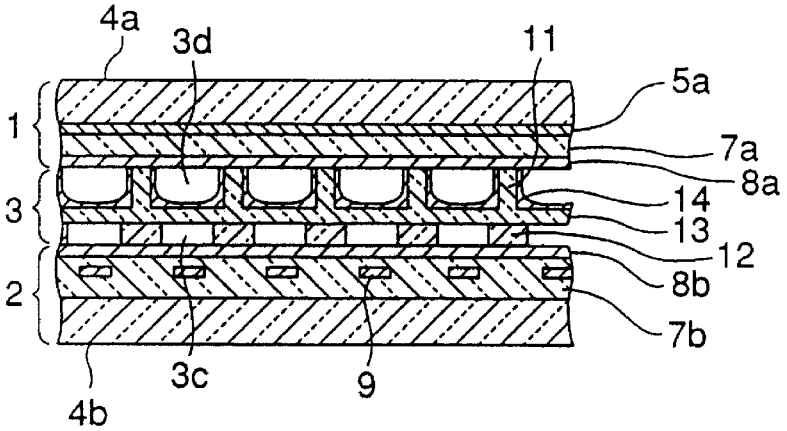
Figure 41C:
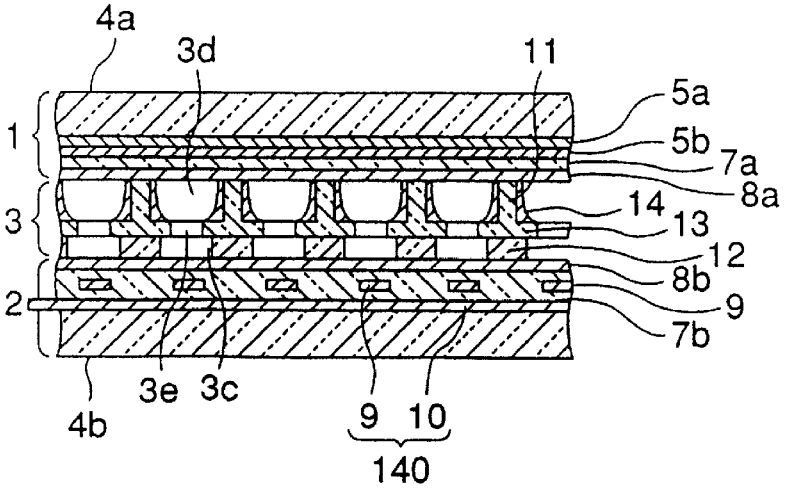

FIGS. 41A–41C are sectional views of the gas discharge display panel manufactured in the twenty-eighth embodiment of the invention. FIG. 41A is a sectional view of the display panel when a part thereof is cut away on a plane parallel with address electrodes 9 and perpendicular to the surfaces of substrates 1 and 2. FIG. 41B is a sectional view taken on line A-A' of FIG. 41A; the cut-away face is a plane perpendicular to the address electrodes 9 and the surfaces of the substrates 1 and 2. FIG. 41C is a sectional view taken on line B-B' of FIG. 41A; the cut-away face is a plane perpendicular to the address electrodes 9 and the surfaces of the substrates 1 and 2.

In the twenty-eighth embodiment, with a glass plate or ceramic plate as a substrate material, the barrier rib 11 and the bulkhead 3 having priming paths 3*e* and bulkheads 13 are formed by a method similar to that of the twenty-sixth embodiment. On the other hand, a hydrolysis-type coating agent, as used in the twenty-sixth embodiment, and a mixture of alumina spherical particles and potassium titanate fiber, are applied using a technique such as a blade method, spray method, or printing method to a predetermined position on the protective layer 8*b* on the rear substrate 2 manufactured by a method similar to that of the twenty-sixth embodiment and heat is applied for hardening, thereby forming the barrier rib 12 defining auxiliary discharge spaces 3*c* each 0.02–0.1 mm high. Next, the front substrate 1, the rear substrate 2, and the bulkhead substrate 3 are aligned and sealed with frit glass, etc., thereby providing a display panel similar to the display panel of the twenty-sixth embodiment, comprising main discharge spaces 3*d* and auxiliary discharge spaces 3*c*.

As described above, according to the invention, a gas discharge color display panel having good color contrast can be provided. According to the invention, a gas discharge color display panel having good accuracy can be provided.

What is claimed is:

1. A gas discharge display panel comprising:

a front substrate comprising main discharge electrodes and a rear substrate comprising auxiliary discharge electrodes, said substrates being parallel with and opposed to each other; and between said front and rear substrates, barrier ribs for partitioning a gap between said front and rear substrates into discharge cells, a fluorescent layer, and discharge space separation bulkheads for separating space in the discharge cells into main discharge space on the front substrate side and auxiliary discharge space on the rear substrate side, wherein each of said discharge space separation bulkheads has a priming path which is a through hole made for making the main discharge space and the auxiliary discharge space communicate with each other.

2. The gas discharge display panel as claimed in claim 1 wherein said discharge space separation bulkheads are connected to said barrier ribs.

3. The gas discharge display panel as claimed in claim 1 wherein said fluorescent layer is formed on barrier rib side faces forming inner walls of the main discharge space and surfaces of said discharge space separation bulkheads.

4. The gas discharge display panel as claimed in claim 1 wherein said auxiliary discharge electrodes comprise:

a plurality of strip address electrodes formed on a first plane parallel with a main surface of said front substrate; and a plurality of strip trigger electrodes formed on a second plane parallel with and different from the first plane, said address and trigger electrodes being separated from each other via a dielectric, an extension direction of said address electrodes being orthogonal to an extension direction of said trigger electrodes, wherein a voltage is applied between any of said address electrodes and any of said trigger electrodes, thereby causing auxiliary discharge to occur.

5. The gas discharge display panel as claimed in claim 4 wherein cross sections provided by projecting said address electrodes, said priming paths, and said trigger electrodes perpendicularly to any plane perpendicular to a lamination direction of said gas discharge display panel, overlap each other at least partially.

6. The gas discharge display panel as claimed in claim 1 wherein said auxiliary discharge electrodes are a plurality of strip electrodes formed on a first plane parallel with a main surface of said front substrate, an extension direction of said auxiliary discharge electrodes being orthogonal to an extension direction of said main discharge electrodes, wherein a voltage is applied between two adjacent electrodes of said auxiliary discharge electrodes, thereby causing auxiliary discharge to occur.

7. The gas discharge display panel as claimed in claim 6 wherein two of said auxiliary discharge electrodes are provided for each row of the display cells.

8. The gas discharge display panel as claimed in claim 6 wherein three of said auxiliary discharge electrodes are provided for every two rows of the display cells, and wherein a central one of the three auxiliary discharge electrodes is provided extending over the two display cell rows.

9. The gas discharge display panel as claimed in claim 1 wherein said rear substrate comprises:

a dielectric layer covering said auxiliary discharge electrodes; and a protective film formed on a surface of said dielectric layer, said protective film being exposed to the auxiliary discharge space.

10. The gas discharge display panel as claimed in claim 9 wherein said protective film is made of at least a material selected from the group consisting of magnesium oxide, calcium oxide, and strontium oxide.

11. The gas discharge display panel as claimed in claim 9 wherein said dielectric layer and said protective film are formed by heating a gel resulting from hydrolyzing organometallic compound.

12. The gas discharge display panel as claimed in claim 1 wherein said front substrate comprises:

a dielectric layer covering said main discharge electrodes; and a protective film formed on a surface of said dielectric layer, said protective film being exposed to the main discharge space.

13. The gas discharge display panel as claimed in claim 1 wherein said front substrate comprises a transparent substrate material surface, a color filter, a color filter protective film, and said main discharge electrodes in order.

14. The gas discharge display panel as claimed in claim 13 wherein said color filter comprises a filter area made of an organic material.

15. The gas discharge display panel as claimed in claim 13 wherein said color filter comprises an area allowing no light to be transmitted and a filter area allowing only light of a specific wavelength to be transmitted.

16. The gas discharge display panel as claimed in claim 1 wherein cross sections provided by projecting said main discharge electrodes, said priming paths, and said auxiliary discharge electrodes perpendicularly to any plane perpendicular to a lamination direction of said gas discharge display panel, overlap each other at least partially.

17. The gas discharge display panel as claimed in claim 1 wherein the display cells make up a plurality of display cell rows along the same direction parallel with a main surface of said front substrate, and wherein the display cells in the display cell row share the auxiliary discharge space among them.

18. The gas discharge display panel as claimed in claim 1 wherein the display cells make up a plurality of display cell rows along the same direction parallel with a main surface of said front substrate, and wherein the display cells in the display cell row share the main discharge space among them.

19. The gas discharge display panel as claimed in claim 1 wherein said main discharge electrodes comprise:

transparent electrodes made of transparent material; and bus electrodes made of opaque material.

20. The gas discharge display panel as claimed in claim 19 wherein said bus electrodes comprise a layer made of at least a metal selected from the group consisting of copper, aluminum, chromium, titanium, nickel, tungsten, molybdenum, and alloys thereof.

21. The gas discharge display panel as claimed in claim 19 wherein said bus electrodes are strip electrodes formed on a plane parallel with one face of the front and rear of said front substrate, and wherein at least a part of said bus electrode covers an opening of the priming path viewed along a lamination direction of said gas discharge display panel from the front of said front substrate.

22. The gas discharge display panel as claimed in claim 1 wherein said auxiliary discharge electrodes comprise a layer made of at least a metal selected from the group consisting of copper, aluminum, chromium, titanium, nickel, tungsten, molybdenum, and alloys thereof.

* * * * *